US005851753A

United States Patent [19]

Yamada et al.

[11] Patent Number: 5,851,753

[45] Date of Patent: Dec. 22, 1998

[54] SILVER HALIDE PHOTOGRAPHIC LIGHT-SENSITIVE MATERIAL

[75] Inventors: Taketoshi Yamada; Norio Miura; Naoyo Suzuki; Hiroshi Kashiwagi; Hideki Takiguchi, all of Hino, Japan

[73] Assignee: Konica Corporation, Japan

[21] Appl. No.: 727,147

[22] Filed: Oct. 8, 1996

[30] Foreign Application Priority Data

| | | | |
|---|---|---|---|
| Oct. 13, 1995 | [JP] | Japan | 7-265697 |
| Oct. 19, 1995 | [JP] | Japan | 7-271244 |
| Jan. 11, 1996 | [JP] | Japan | 8-003291 |

[51] Int. Cl.[6] ..... G03C 1/09; G03C 1/18; G03C 1/34

[52] U.S. Cl. ..... 430/603; 430/611; 430/613; 430/614; 430/607; 430/966; 430/588

[58] Field of Search ..... 430/611, 607, 430/966, 264, 603, 613, 614

[56] References Cited

U.S. PATENT DOCUMENTS

| | | | |
|---|---|---|---|
| H1608 | 11/1996 | Nishio et al. | 430/264 |
| 2,105,274 | 1/1938 | Steigmann et al. . | |
| 3,554,758 | 1/1971 | Willems et al. | 430/607 |
| 3,674,478 | 7/1972 | Grasshoff et al. | 430/957 |
| 4,416,977 | 11/1983 | Ohashi et al. | 430/611 |
| 5,229,264 | 7/1993 | Patzold et al. | 430/611 |
| 5,320,938 | 6/1994 | House et al. | 430/611 |
| 5,364,754 | 11/1994 | Kim et al. | 430/611 |
| 5,541,047 | 7/1996 | Kashigawi et al. | 430/603 |
| 5,654,134 | 8/1997 | Morimuta et al. | 430/611 |

FOREIGN PATENT DOCUMENTS

| | | |
|---|---|---|
| 0617320 | 9/1994 | European Pat. Off. . |
| 0647880 | 4/1995 | European Pat. Off. . |
| 0658805 | 6/1995 | European Pat. Off. . |

OTHER PUBLICATIONS

European Search Report EP 96 30 7396 and Annex.

*Primary Examiner*—Richard L. Schilling
*Attorney, Agent, or Firm*—Jordan B. Bierman; Bierman, Muserlian and Lucas

[57] ABSTRACT

A silver halide photographic laight-sensitive material is disclosed. The light-sensitive material comprises a support and a silver halide emulsion layer and a non-light-sensitive hydrophilic colloid layer provided on the support, wherein at least one of the silver halide emulsion layer and the non-light-sensitive hydrophilic colloid layer contains a compound represented by the following Formula 1, and the silver halide emulsion layer contains tabular silver halide grains having an average aspect ratio of not less than 2.0 account for at least 50 % of total grain projected area of the emulsion, and the tabular grains have an average silver iodide content is not more than 1 mole-%;

Formula 1

$$R_{11}—(S)_n—R_{12}$$

wherein $R_{11}$ and $R_{12}$ are each independently represent an aliphatic group, an aromatic group or a heterocyclic group, the groups represented by $R_{11}$ and $R_{12}$ may be the same or different and they may be bonded with together to form a ring; and n is an integer of from 2 to 6.

9 Claims, 1 Drawing Sheet

SILVER HALIDE PHOTOGRAPHIC LIGHT-SENSITIVE MATERIAL

FIELD OF THE INVENTION

This invention relates to a silver halide photographic light-sensitive material and an image forming method using the light-sensitive material, particularly relates to a black-and-white silver halide photographic material and an image forming method using the light-sensitive material.

BACKGROUND OF THE INVENTION

Recently, in the processing of silver halide photographic light-sensitive material, hereinafter simply referred to light-sensitive material, it is required to shorten the processing time and to reduce the amount of waste liquid exhausted accompanied with the processing. It is advantageous for shortening the processing time to use a silver chlorobromide or silver chloride emulsion, which have each a solubility higher than that of silver iodobromide emulsion. Further, it is also advantageous for the same purpose to use silver halide grain emulsion or a tabular grain emulsion. On the other hand, it is preferred to obtain a high density by a small amount of silver for reducing the waste liquid. An emulsion of tabular silver halide grains is preferred from the above viewpoint. Further it is known that the tabular grins are suitable for obtaining a high sensitivity, an excellent granularity and sharpness and a high spectral sensitization efficiency of the emulsion. However, the silver chlorobromide and silver chloride emulsion are tend to be fogged compared with the silver iodobromide emulsion. As a countermeasure of such the problem, the use of specific compounds such as described in Japanese Patent Publication Open for Public Inspection (JP O.P.I.) 57-14836/1982 has been proposed. However, it is found that the sensitivity of the light-sensitive material is considerably lowered during storage for a prolonged period before exposure when such the compound is in the emulsion thereof. Particularly, a considerable increasing in the fogging caused by storage for a prolonged period is observed in a light-sensitive material containing a selenium or a tellurium compound.

SUMMARY OF THE INVENTION

The first object of the invention is to provide a silver halide photographic light-sensitive material which can be processed by a rapid processing and has a lowered fog and to provide a producing method of a silver halide emulsion to be used the light-sensitive material and an image forming method using the light-sensitive material. The second object of the invention is to provide a silver halide photographic light-sensitive material which is inhibited in the fogging during storage for a prolonged period and to provide a producing method of a silver halide emulsion to be used the light-sensitive material and an image forming method using the light-sensitive material. The third object of the invention is to provide a silver halide photographic light-sensitive material which is inhibited in the variation of sensitivity during storage for a prolonged period and to provide a producing method of a silver halide emulsion to be used the light-sensitive material and an image forming method using the light-sensitive material.

The above objects of the invention are attained by a silver halide photographic light-sensitive material comprising a support and a silver halide emulsion layer and a non-light-sensitive hydrophilic colloid layer each provided on the support, wherein at least one of the silver halide emulsion layer and the non-light-sensitive hydrophilic colloid layer contains a compound represented by the following Formula I, and in the silver halide emulsion layer the sum of the projection area of tabular silver halide grains having an aspect ratio of not less than 2.0 accounts for at least 50% of the total projected area of the silver halide grains contained in the emulsion, and the tabular grains have an average silver iodide content is not more than 1 mole-%.

Formula 1

$$R_{11}—(S)_n—R_{12}$$

wherein $R_{11}$ and $R_{12}$ are each independently represent an aliphatic group, an aromatic group or a heterocyclic group, the groups represented by $R_{11}$ and $R_{12}$ may be the same or different and they may be bonded with together to form a ring; and n is an integer of from 2 to 6.

In the above light-sensitive material, the tabular silver halide grains are preferably those each having two parallel (100) major faces and has a silver chloride content of not less than 20 mole-%.

DETAILED DESCRIPTION OF THE INVENTION

Figure 1:
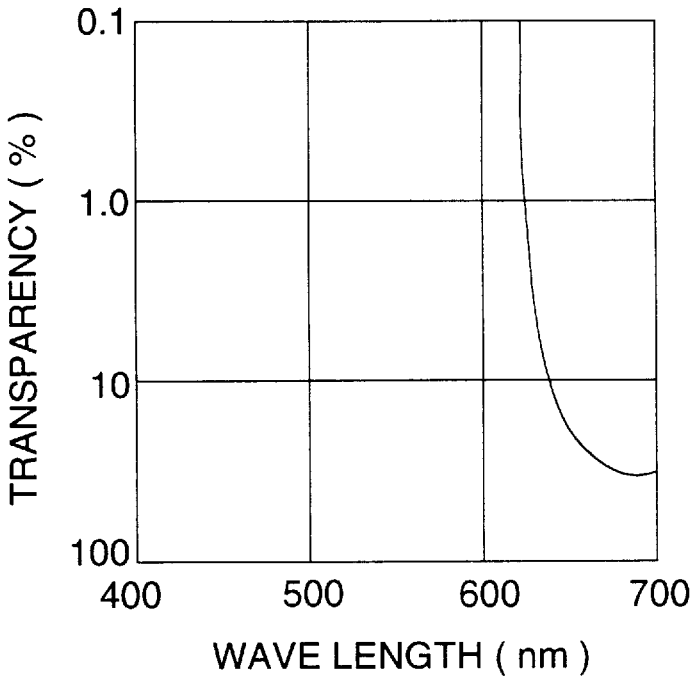
FIG. 1 shows the spectral transmission of the red-filter 2 used in Example.

A compounds represented by Formula 1 is an excellent fog inhibitor for attaining the object of the invention to provide a light-sensitive material having a lowered fog and a good storage ability.

Formula 1

$$R_{11}—(S)_n—R_{12}$$

In the above, $R_{11}$ and $R_{12}$ are each independently an aliphatic group, an aromatic group or a heterocyclic group, the groups represented by $R_{11}$ and $R_{12}$ may be the same or different and they may be bonded with together to form a ring; and n is an integer of from 2 to 6.

The aliphatic group represented by $R_{11}$ and $R_{12}$ includes an alkyl group, an alkenyl group, an alkynyl group or a cycloalkyl group each having 1 to 30, preferably 1 to 20, carbon atoms. Each of them may be one having a straight-chain or one having a branched-chain. Concrete example of the aliphatic group includes a methyl group, ethyl group, propyl group, butyl group, hexyl group, decal group, dodecyl group, isopropyl group, t-butyl group, 2-ethylhexyl group, ally group, 2-butenyl group, 7-octenyl group, propargyl group, 2-butynyl group, cyclopropyl group, cyclopentyl group, cyclohexyl group and cyclododecyl group. The aromatic group represented by $R_{11}$ and $R_{12}$ includes ones having 6 to 20 carbon atoms such as a phenyl group, naphthyl group and anthranyl group. The heterocyclic group represented by $R_{11}$ and $R_{12}$ includes ones derived from 5- and 6-member heterocyclic rings each having at least one of O, S and N atoms in the ring thereof, which may be a single ring or a condensed ring. Concrete example of the heterocyclic ring includes ones derived from pyrrolidine, piperidine, tetrahydrofuran, tetrahydropyran, oxirane, morpholine, thiomorpholine, thiopyran, tetrahydrothiophene, pyrrole, pyridine, furan, thiophene, imidazole, pyrazole, oxazole, thiazole, isooxazole, isothiazole, triazole, tetrazole, thiadiazole and oxadiazole and their benzelogues. The rings formed by bonding $R_{11}$ with $R_{12}$ includes 4- to 7-member rings, preferably 5- to 7-member rings. As the group represented by $R_{11}$ and $R_{12}$, a heterocyclic group is preferable and a aromatic heterocyclic group is more preferable. The aliphatic group, aromatic group and heterocyclic group represented by $R_{11}$ and $R_{12}$ each may have a substituent. The substituent includes a halogen atom such as a chlorine atom or bromine atom; an alkyl group such as methyl group, ethyl group, isopropyl group, hydroxyethyl group, methoxyethyl group, trifluoromethyl group or t-butyl group; a cycloalkyl group such as cyclopentyl group or cyclohexyl group; an aralkyl group such as benzyl group or 2-phenetyl group; an aryl group such as phenyl group, naphthyl group, p-tolyl group or p-chlorophenyl group; an alkoxyl group such as methoxy group, ethoxy group, isopropoxy group or n-butoxy group; an aryloxy group such as phenoxy group; a cyano group; an acylamino group such as acetylamino group or propionylamino group; an alkylthio group such as methylthio group, ethylthio group or n-butylthio group; an arylthio group such as phenylthio group; a sulfonylamino group such as methanesulfonylamino group or benzenesulfonylamino group, a ureido group such as 3-methylureido group, 3,3-dimethylureido group or 1,3-dimethylureido group; a sulfamoylamino group such as dimethylsulfamoyl group; a carbamoyl group such as methylcarbamoyl group, ethylcarbamoyl group or dimethylcarbamoyl group; a sulfamoyl group such as ethylsulfamoyl group or dimethylsulfamoyl group; an alkoxycarbonyl group such as methoxycarbonyl group or ethoxycarbonyl group; an aryloxycarbonyl group such as phenoxycarbonyl group; sulfonyl group such as methanesulfonyl group, butanesulfonyl group or phenylsulfonyl group; an acyl group such as acetyl group, porpanoyl group or butyloyl group; an amino group such as methylamino group, ethylamino group or dimethylamino group; a hydroxyl group; a nitro group; a nitroso group; an amine oxide group such as pyridine oxide group; an imido group such as phthalimido group; a disulfide group such as benzene disulfide group or benzothizolyl-2-disulfide group; and a heterocyclic group such as pyridyl group, benzimidazolyl group, benzothiazolyl group or benzoxazolyl group, a carboxyl group; and a sulfo group. n is an integer of 2 to 6, preferably 2 to 5, more preferably 2. The group represented by $R_{11}$ and $R_{12}$ each may have one or more substituent among the above-mentioned. The substituent of the group represented by $R_{11}$ and $R_{12}$ may further be substituted with a substituent above-mentioned. Among them, a group having a water-solubilizing ability, i.e., a carboxyl group, sulfo group and substituent having a carboxyl group or sulfo group are particularly preferable.

Examples of the compound represented by Formula 1 are given below. However, the invention is not limited thereto.

1-1

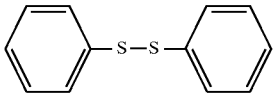

1-2

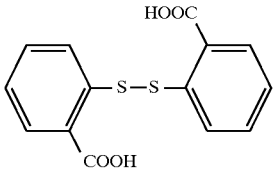

-continued 1-3

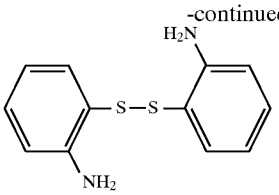

1-4

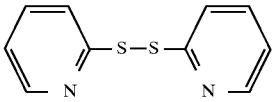

1-5

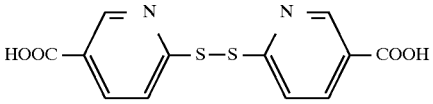

1-6

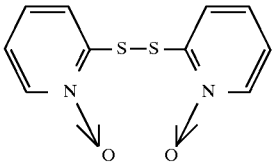

1-7

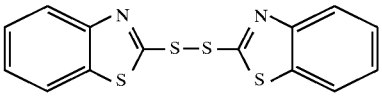

1-8

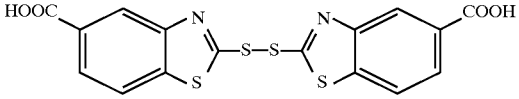

1-9

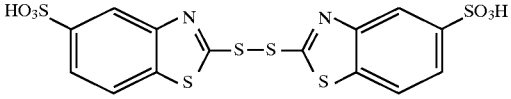

1-10

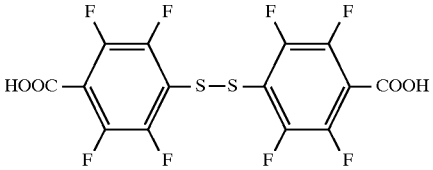

1-11

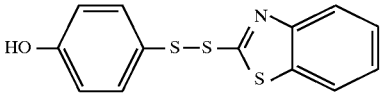

1-12

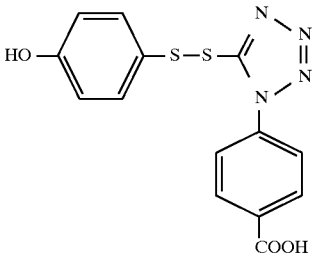

1-13

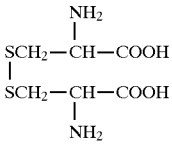

-continued

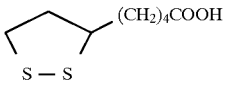

1-14

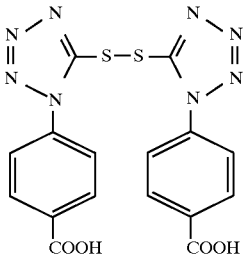

1-15

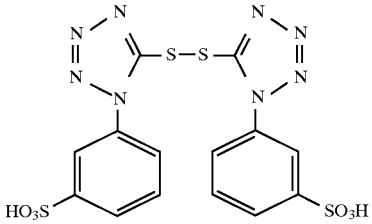

1-16

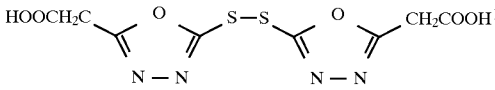

1-17

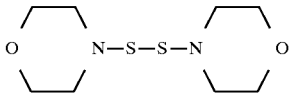

1-18

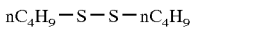

1-19

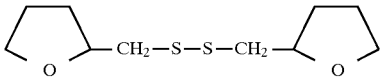

1-20

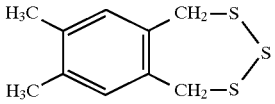

1-21

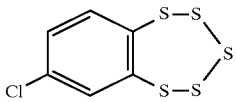

1-22

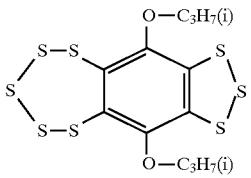

1-23

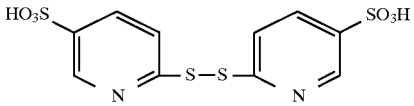

1-24

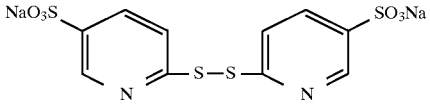

1-25

-continued

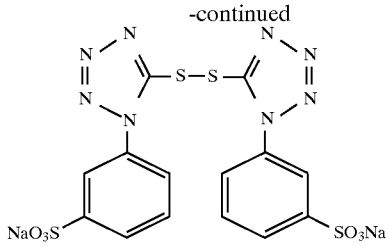

1-26

The compound represented by Formula 1 is contained the light-sensitive layer in an amount of preferably $1\times10^{-8}$ to $5\times10^{-1}$ moles, more preferably $1\times10^{-7}$ to $5\times10^{-2}$ moles, per mole of silver halide contained in the light-sensitive material.

The compound represented by Formula 1 can be used in a form of solution in a proper water-miscible organic solvent such as alcohols, ketones, dimethyl sulfoxide, dimethylformamide or methyl cellosolve. The compound can also be used in a form of emulsified dispersion using an oil, The compound further can be used in a form of a dispersion prepared by a method known as a solid dispersing method, in which the compound is dispersed in water by means of a ball mill, colloid mill, impeller disperser or by ultrasonic wave.

The compound represented by Formula 1 may be existed in the silver halide emulsion layer, a layer adjacent to the emulsion layer, or another layer adjacent the emulsion layer trough the adjacent layer. It is particularly preferred the compound is contained in th e emulsion layer and/or a hydrophilic colloid layer adjacent to the emulsion layer, the compound may be contained in plural layers different from each other.

Although the compound represented by Formula 1 may be added at any step of preparation of the light-sensitive material, it is preferably added at a time between the time of two hours before starting the chemical sensitization of the silver halide emulsion and the time of just before of coating the silver halide emulsion on the support, when the compound is added to the silver halide emulsion.

The compound represented by Formula 1 of the invention is preferably used for enhancing the effects thereof with a compound represented Formula 2, a compound represented by Formula 3, a tetrazolium compound represented by Formula 4 or a redox compound capable of releasing a development inhibitor upon oxidation reaction with the oxidation product of a developing agent, of the compound of Formula 1.

Compounds represented by Formula 2 are described below.

Formula 2

$$R_{21}—I^{+}—R_{22}\ I^{-}$$

In the formula, $R_{21}$ and $R_{22}$ are each independently an aromatic group of an aromatic heterocyclic group. $R_{11}$ and $R_{22}$ may be the same or different.

The aromatic group represented by $R_{21}$ and $R_{22}$ in Formula 2 includes one having 6 to 20 carbon atoms. Concrete examples of the group include a phenyl group, naphthyl group and anthranyl group.

The aromatic heterocyclic group represented by $R_{21}$ and $R_{22}$ includes ones derived from 5- and 6-member heterocyclic rings each having at least one of O, S and N atoms in the ring thereof, which may be a single ring or a condensed ring. In concrete, the groups include ones derived from, for example, pyrrole, pyridine, pyrimidine, triazine, furan, thiophene, imidazole,, pyrazole, oxazole, thiazole, isooxazole, isothiazole, triazole, tetrazole, thiadiazole, oxadiazole and benzologues thereof.

A group derived from benzene ring is most preferred as the group represented $R_{21}$ and $R_{22}$. The aromatic group or the aromatic heterocyclic group each may has a substituent. The substituent includes a halogen atom such as a chlorine atom or bromine atom; an alkyl group such as methyl group, ethyl group, isopropyl group, hydroxyethyl group, methoxyethyl group, trifluoromethyl group or t-butyl group; a cycloalkyl group such as cyclopentyl group or cyclohexyl group; an aralkyl group such as benzyl group or 2-phenetyl group; an aryl group such as phenyl group, naphthyl group, p-tolyl group or p-chlorophenyl group; an alkoxyl group such as methoxy group, ethoxy group, isopropoxy group or n-butoxy group; an aryloxy group such as phenoxy group; a cyano group; an acylamino group such as acetylamino group or propionylamino group; an alkylthio group such as methylthio group, ethylthio group or n-butylthio group; an arylthio group such as phenylthio group; a sulfonylamino group such as methanesulfonylamino group or benzenesulfonylamino group, a ureido group such as 3-methylureido group, 3,3-dimethylureido group or 1,3-dimethylureido group; a sulfamoylamino group such as dimethylsulfamoyl group; a carbamoyl group such as methylcarbamoyl group, ethylcarbamoyl group or dimethylcarbamoyl group; a sulfamoyl group such as ethylsulfamoyl group or dimethylsulfamoyl group; an alkoxycarbonyl group such as methoxycarbonyl group or ethoxycarbonyl group; an aryloxycarbonyl group such as phenoxycarbonyl group; sulfonyl group such as methanesulfonyl group, butanesulfonyl group or phenylsulfonyl group; an acyl group such as acetyl group, porpanoyl group or butyloyl group; an amino group such as methylamino group, ethylamino group or dimethylamino group; a hydroxyl group; a nitro group; a niroso group; an amine oxide group such as pyridine oxide group; an imido group such as phthalimido group; a disulfide group such as benzene disulfide group or benzothizolyl-2-disulfide group; and a heterocyclic group such as pyridyl group, benzimidazolyl group, benzothiazolyl group or benzoxazolyl group; a carboxyl group and a sulfo group. Among them, the carboxyl group and sulfo group are particularly preferable. The group represented by $R_{21}$ and $R_{22}$ each may have one or more substituent among the above-mentioned. The substituent of the group represented by $R_{21}$ and $R_{22}$ may further be substituted with a substituent above-mentioned.

Examples of the compound represented by Formula 2 are given below. However, the invention is not limited thereto.

2-1

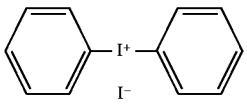

2-2

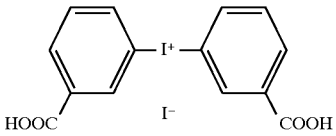

2-3

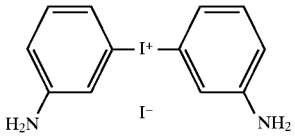

-continued 2-4

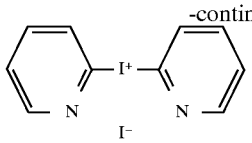

2-5

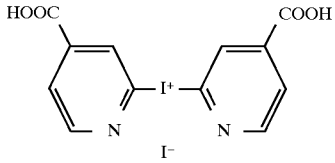

2-6

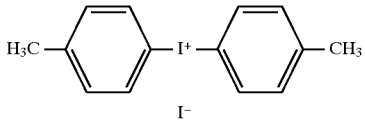

2-7

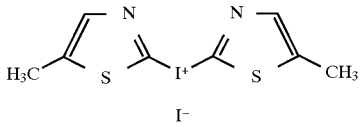

2-8

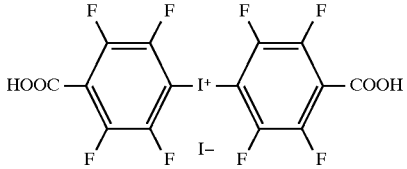

2-9

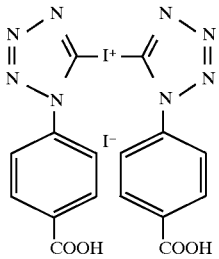

2-10

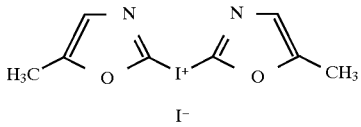

Compounds represented by Formula 3 are described below.

Formula 3

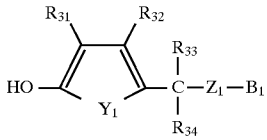

In Formula 3, R31, R32, $R_{33}$ and $R_{34}$ are each independently a hydrogen atom, a halogen atom, an alkyl group, an aralkyl group, a cycloalkyl group, an aryl group, an alkoxyl group, an aryloxy group, a cyano group,, an acylamino group, an alkylthio group, an arylthio group, a sulfonylamino group, a ureido group, a sulfamoylamino group, a carbamoyl group, a sulfamoyl group, an alkoxycarbonyl group, aryloxycarbonyl group, an acyl group, a hydroxyl group, a nitro group, an imido group or a heterocyclic group; $Y_1$ is a group of atoms for forming an aromatic carbon ring or an aromatic heterocyclic ring; $Z_1$ is an oxygen atom or a sulfur atom; and $B_1$ is a group having an ability of adsorption to silver halide solely or in a form of $—Z_1—B_1$.

As the moiety of ring formed by $Y_1$ in Formula 3, an aromatic carbon ring or an aromatic heterocyclic ring is preferred. Examples of the ring include a phenyl group, naphthyl group, furan group and thiophene group, in which phenyl group is particularly preferred. The groups each represented by $R_{31}$, $R_{32}$, $R_{33}$ and $R_{34}$ in Formula 3 include the groups described as substituents of the group represented by $R_{11}$ and $R_{12}$ of Formula 1, and are preferably a hydrogen atom, substituted or unsubstituted alkyl group or a halogen atom, particularly preferably a hydrogen atom or a unsubstituted alkyl group. $Z_1$ is an oxygen atom or a sulfur atom and is preferably a sulfur atom. The group having a adsorption ability to silver halide represented by $—B_1$, or in a form of $—Z_1—B_1$, includes, for example, a 5- or 6-member nitrogen-containing heterocyclic group, in which groups derived from benzotriazole, triazole, tetrazole, indazole, benzimidazole, imidazole, benzothiazole, thiazole, benzoxazole, oxazole, thiadiazole, oxadiazole, pyrimidine, pyridine and triazine are preferred, and those derived from tetrazole, benzimidazole and pyrimidine are particularly preferred. These groups each may have a substituent. As examples of the substituent, groups exemplified in the case of $R_{31}$ and $R_{32}$ are cited. Among the compounds represented by Formula 3, a compound represented by the following Formula 3a is particularly preferred.

Formula 3a

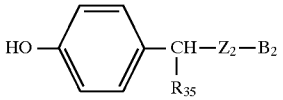

In formula 4, $R_{35}$, $Z_2$ and $B_2$ are each synonymous with $R_{33}$, $Z_1$ and $B_1$ in Formula 3, respectively.

Concrete examples of the compound represented by Formula or 3a are shown below.

3-1

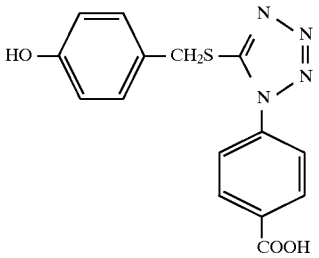

3-2

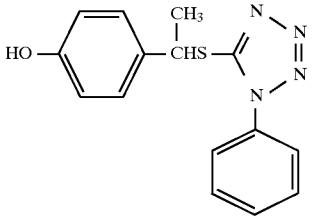

3-3

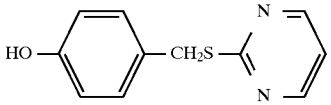

3-4

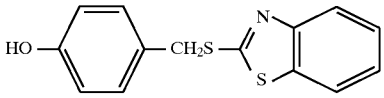

-continued 3-5

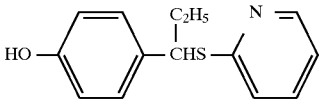

3-6

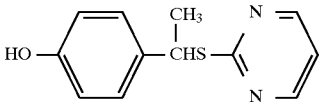

3-7

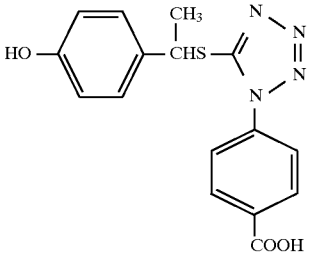

3-8

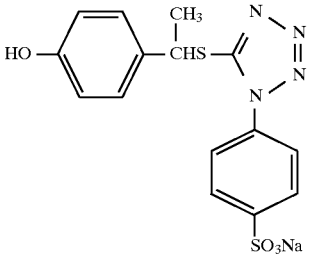

3-9

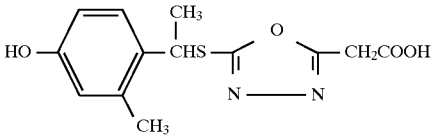

3-10

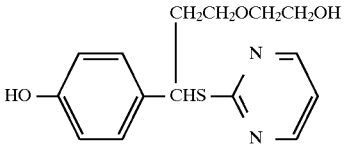

3-11

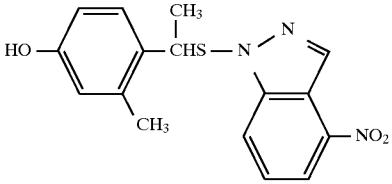

3-12

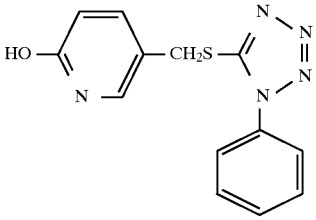

3-13

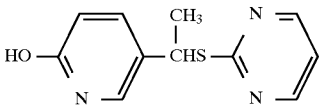

-continued 3-14

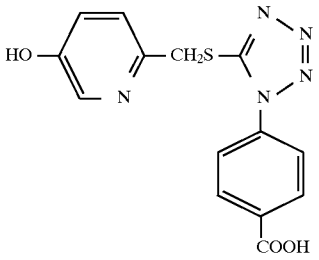

3-15

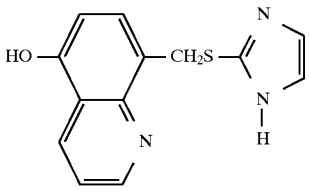

3-16

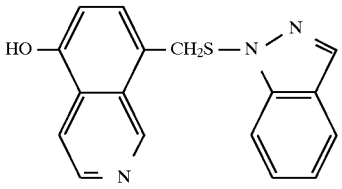

3-17

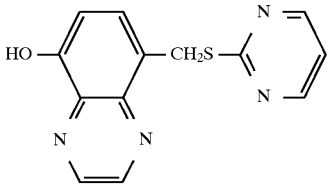

3-18

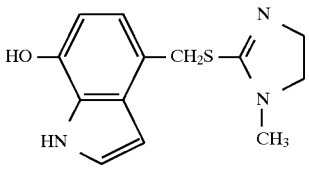

3-19

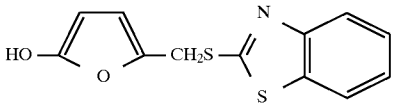

3-20

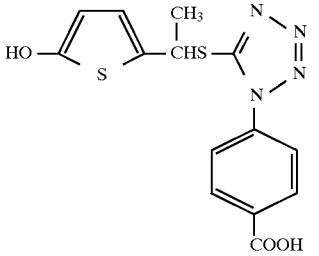

3-21

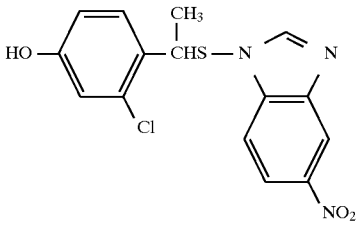

Preferable tetrazolium compounds preferably usable in the light-sensitive material of the invention are ones represented by the following Formula 4.

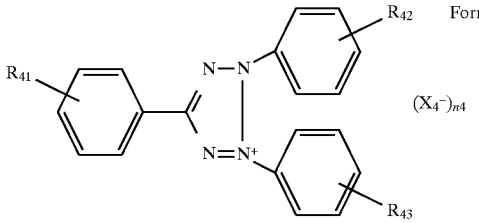

Formula 4

In the above formula, $R_{41}$, $R_{42}$ and $R_{43}$ are each independently a hydrogen atom, an aliphatic group, an aromatic group or a heterocyclic group; $X_4$ is an ion for neutralizing the electric charge; and $n_4$ is a number of ions necessary for neutralizing the charge.

As the groups represented by $R_{41}$, $R_{42}$ and $R_{43}$ in Formula 4, a hydrogen atom and the groups described as the substituent or the group represented by $R_{11}$ and $R_{12}$ in Formula 1 are cited. $X^-$ is an ion for neutralizing the charge of the compound, for example, a halogen ion such as chloride ion or bromide ion, an inorganic acid ion, an organic acid ion or an alkali metal ion.

Concrete examples of the compound represented by Formula 4 are shown below.

| | $R_{51}$ | $R_{52}$ | $R_{53}$ | $X_5$ | $n_5$ |
|---|---|---|---|---|---|
| 4-1 | H | H | p-$CH_3$ | Cl— | 1 |
| 4-2 | H | p-$CH_3$ | p-$CH_3$ | Cl— | 1 |
| 4-3 | p-$CH_3$ | H | p-$CH_3$ | Cl— | 1 |
| 4-4 | p-$CH_3$ | p-$CH_3$ | p-$CH_3$ | Cl— | 1 |
| 4-5 | H | p-$OCH_3$ | p-$CH_3$ | Cl— | 1 |
| 4-6 | H | p-$OCH_3$ | p-$OCH_3$ | Cl— | 1 |
| 4-7 | H | m-$C_2H_5$ | m-$C_2H_5$ | Cl— | 1 |
| 4-8 | H | p-$OC_3H_7$(i) | p-$OC_3H_7$(i) | Cl— | 1 |
| 4-9 | p-$NH_2$ | H | H | Cl— | 1 |
| 4-10 | p-$NH_2$ | p-$NH_2$ | H | Cl— | 1 |
| 4-11 | H | p-OH | p-OH | Cl— | 1 |
| 4-12 | H | p-$NO_2$ | p-$OCH_3$ | Cl— | 1 |
| 4-13 | p-$COOC_2H_5$ | H | H | Cl— | 1 |
| 4-14 | H | p-$CONH_2$ | p-$CONH_2$ | Cl— | 1 |
| 4-15 | H | p-CN | p-CN | Cl— | 1 |
| 4-16 | H | p-Cl | p-Cl | Cl— | 1 |
| 4-17 | H | p-Br | p-Br | Cl— | 1 |
| 4-18 | H | p-$OCH_3$ | p-$OCH_3$ | Cl— | 1 |
| 4-19 | H | p-$COOC_2H_5$ | p-$COOC_2H_5$ | Cl— | 1 |
| 4-20 | H | p-$OCH_3$ | p-CN | Cl— | 1 |
| 4-21 | H | p-$CF_3$ | p-$CF_3$ | Cl— | 1 |
| 4-22 | p-$CF_3$ | p-$CF_3$ | p-$CF_3$ | Cl— | 1 |
| 4-23 | p-$COCH_3$ | H | H | Cl— | 1 |
| 4-24 | p-NHC(=S)$NCH_3$ | H | H | Cl— | 1 |

Next, a redox compound preferably usable in the invention, which is capable of releasing a development inhibitor by oxidation reaction with the oxidation product of a developing agent, hereinafter referred to redox compound, is described.

The redox compound has a redox group selected from hydroquinones, catechols, naphthohydroquinones, aminophenols, hydrazines and reductones.

Preferable redox compounds are ones having an —NHNH— group as the redox group and compounds represented by the following Formula RE-1 to RE-5 or RE-6.

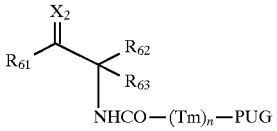

Formula RE-1

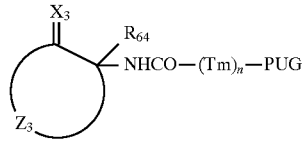

Formula RE-2

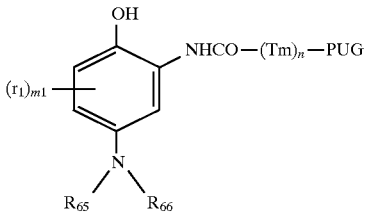

Formula RE-3

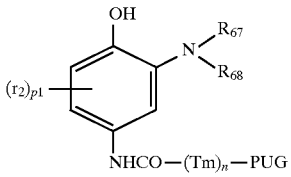

Formula RE-4

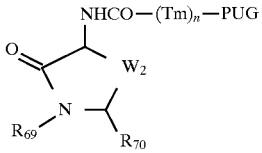

Formula RE-5

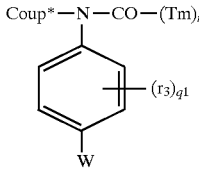

Formula RE-6

In Formulas RE-1 through RE-6, $R_{61}$ is an alkyl group, aryl group or heterocyclic group. $R_{62}$ and $R_{63}$ are each a hydrogen atom, acyl group, carbamoyl group, cyano group, nitro group, sulfonyl group, aryl group, oxalyl group, heterocyclic group, alkoxycarbonyl group, or aryloxycarbonyl group. $R_{64}$ is a hydrogen atom. $R_{65}$ through $R_{70}$ are each a hydrogen atom, alkyl group, aryl group or a heterocyclic group. $r_1$, $r_2$ and $r_3$ are each a group capable of being a substituent of the benzene ring. $X_2$ and $X_3$ are each O or NH. $Z_3$ is a group of atoms necessary to form a 5- or 6-member heterocyclic ring. $W_1$ is $N(R_{71})R_{72}$ or O, and $W_2$ is $N(R_{73})R_{74}$ or OH. $R_{71}$, $R_{72}$, $R_{73}$ and $R_{74}$ are each a hydrogen atom, alkyl group, aryl group, or heterocyclic group. "Coup" is a coupler residue capable of coupling with the oxidation product of an aromatic primary amine developing agent, and ★ represents the coupling position of the coupler residue. Tm is a timing group, $m_1$ and $P_1$ are each an integer of 0 to 3. $q_1$ is an integer 0 to 4 and n is 0 or 1. PUG is a residue of development inhibitor.

In Formulas RE-1 through RE-6, the alkyl group, aryl group and heterocyclic group represented by $R_{61}$ and $R_{65}$ to $R_{70}$ are preferably methyl group, p-methoxyphenyl group and pyridyl group. Among the acyl group, carbamoyl group, cyano group, nitro group, sulfonyl group, aryl group, oxalyl group, heterocyclic group, alkoxycarbonyl group, aryloxycarbonyl group each represented by $R_{62}$ and $R_{63}$, an acyl group, carbamoyl group and cyano group are preferred. It is preferable that the total number of the carbon atoms contained in each of these groups is 1 to 20. The groups represented by $R_{61}$ through $R_{74}$ each may have a substituent. As the substituent, for example, those described as the substituent of the group represented by $R_{11}$ and $R_{12}$ of Formula 1. As the coupler residue represented by "Coup", the followings can be described. Cyan coupler residues include those of phenol couplers and naphthol couplers. Magenta coupler residues include those of 5-pyrazolone couplers, pyrazolone couplers, cyanoacetylcumarone couplers, open-chain acylacetonitryl couplers and indazolone couplers. Yellow coupler residues include benzoylacetonitryl couplers, pivaloylacetonitryl couplers and malondianilide couplers. Non-color forming coupler residues include open-chain or cyclic active methylene compounds such as indanone, cyclopentanone, diesters of malonic acid, imidazolinone, oxazolinone and thiazolinone. Among the coupler residues represented by "Coup", those represented by Formulas Coup-1 through Coup-8 are preferably usable.

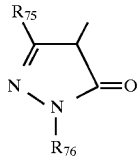

Formula Coup-1

In the formula, $R_{75}$ is an acylamido group, anilino group or ureido group; and $R_{76}$ is a phenyl group which may be substituted by one or more chlorine atoms, alkyl groups, alkoxy groups or cyano groups.

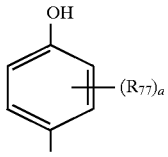

Formula Coup-2

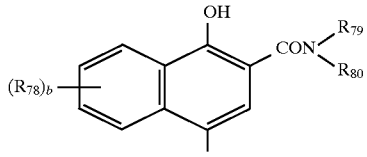

Formula Coup-3

In the formulas, $R_{77}$ and $R_{78}$ are each a halogen atom, acylamido group, alkoxycarbonylamido group, sulfoureido group, alkoxyl group, alkylthio group, hydroxyl group or aliphatic group; and $R_{79}$ and $R_{80}$ are each an aliphatic group, aromatic group or heterocyclic group. One of $R_{79}$ and $R_{80}$ may be a hydrogen atom. a is an integer of 1 to 4, and b is an integer of 0 to 5. When a or b is 2 or more, a plurality of groups represented by $R_{77}$ and $R_{88}$ may be each the same or different.

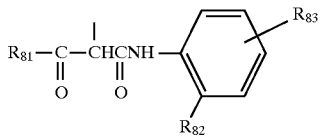

Formula Coup-4

-continued

Formula Coup-5

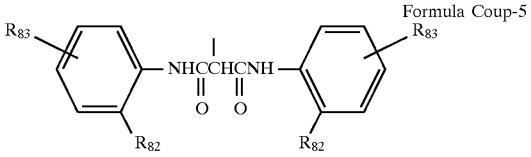

In the formula, $R_{81}$ is a tertiary alkyl group or an aromatic group; and $R_{82}$ is a hydrogen atom halogen atom or alkoxyl group. $R_{83}$ is an acylamido group, aliphatic group, alkoxycarbonyl group, sulfamoyl group, carbamoyl group, alkoxyl group, halogen atom or sulfonamido group.

Formula Coup-6

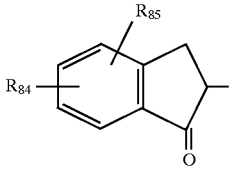

In the formula, $R_{84}$ an aliphatic group, alkoxyl group, acylamino group, sulfonamido group, sulfamoyl group or diacylamino group; and $R_{85}$ is a hydrogen atom, halogen atom or nitro group.

Formula Coup-7

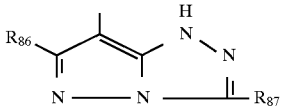

-continued

Formula Coup-8

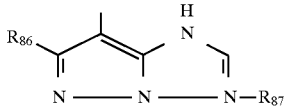

$R_{86}$ and $R_{87}$ are each a hydrogen atom, aliphatic group, aromatic group or a heterocyclic group.

The 5- or 6-member heterocyclic group represented by $Z_3$ includes 5- and 6-member rings each having at least one of O, S and N atoms therein, the ring may be a single ring or condensed ring. The rings each may have a substituent. As the substituent, those described as the substituents of the group represented by $R_{11}$ and $R_{12}$ if Formula 1 are cited.

Preferable timing groups represented by Tm include —$OCH_2$— group and other divalent timing groups described in, for example, U.S. Pat. (USP) Nos. 4,248,962, 4,409,323 and 3,674,478, Research Disclosure 21228 (December 1981), and JP O.P.I. Nos. 57-56837/1982 and 4-438/1992.

As preferable development inhibitors represented by PUG, those described in, for example, U.S. Pat. No. 4,477,563, JP O.P.I. Nos. 60-218644/1985, 60-221750/1985, 60-233650/1985 and 61-11743/1986 are cited.

Among the compounds represented Formulas RE-1 through RE-6, examples of the compounds having one timing group are described below.

Compound No. 1~No. 5

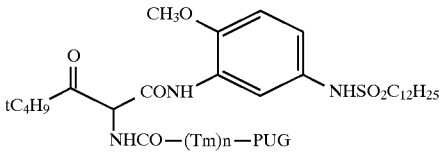

Compound No. 6~No. 10

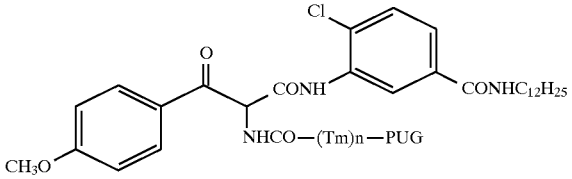

Compound No. 11~No. 15

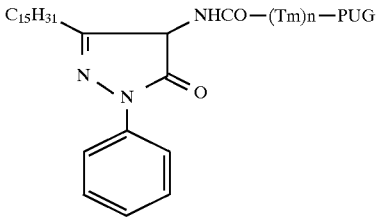

Compound No. 16~No. 25

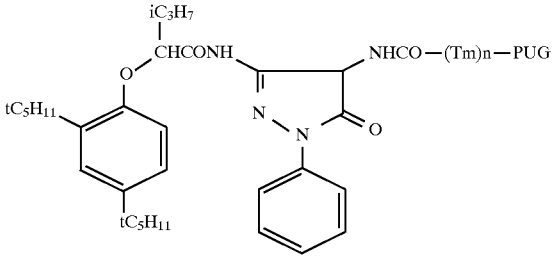

-continued
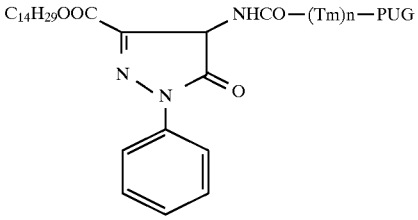
Compound No. 26~No. 30
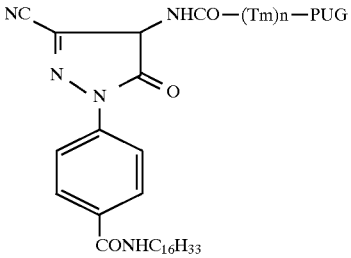
Compound No. 31~No. 35
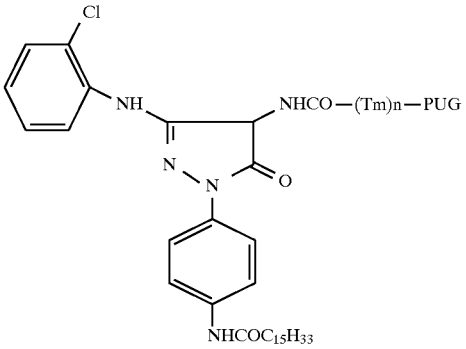
Compound No. 36~No. 40
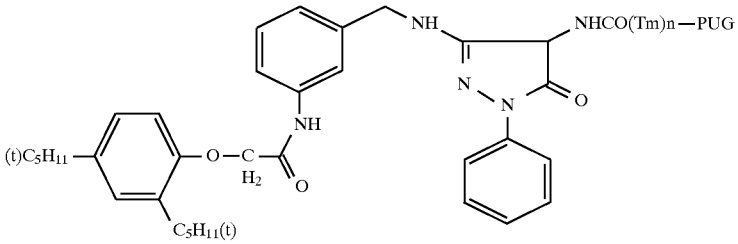
Compound No. 41~No. 45
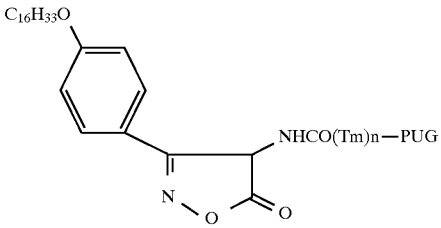
Compound No. 46~No 50
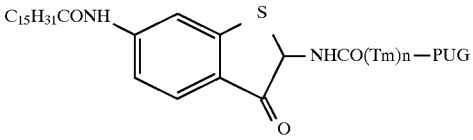
Compound No. 51~No. 55
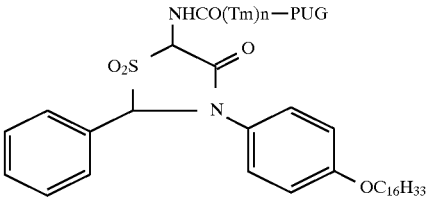
Compound No. 56~No 60

-continued
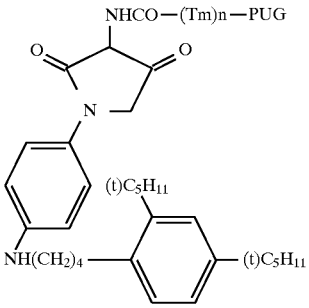
Comound No. 61~No 65
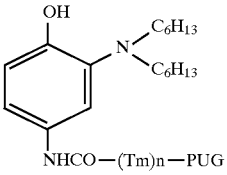
Compound No. 66~No. 70
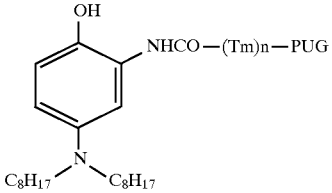
Compound No. 71~No. 75
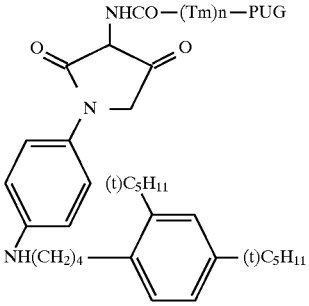
Compound No. 76~No. 80
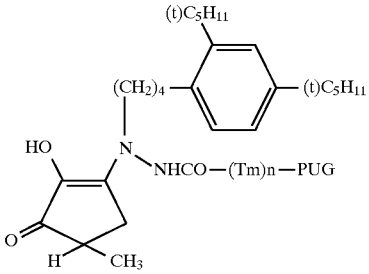
Compound No. 81~No. 85
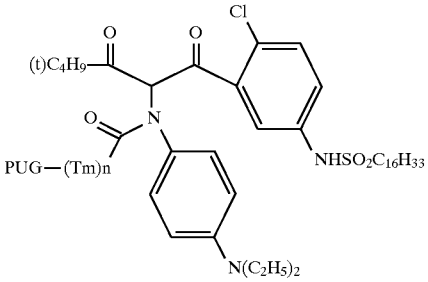
Compound No. 86~No. 90

-continued
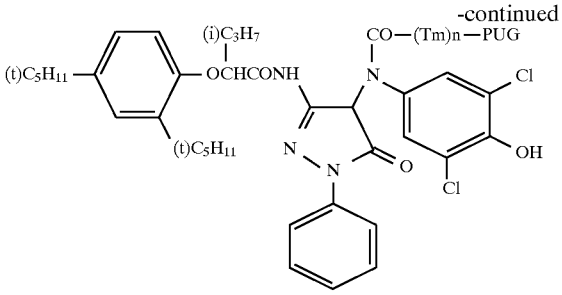
Compound No. 91~No. 95
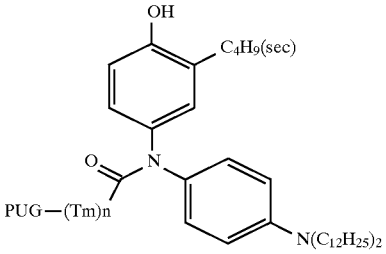
Compound No. 96~No. 100
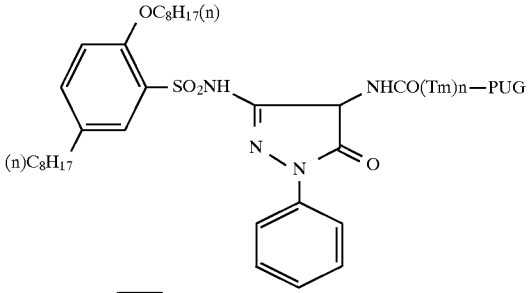
Compound No. 101~No. 105
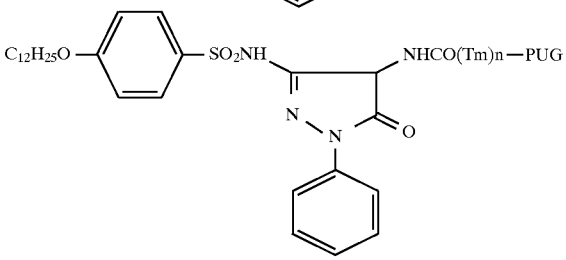
Compound No. 106~No. 110
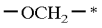
Tm-1
Tm-2
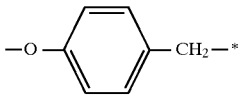
Tm-3
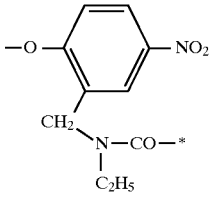
-continued
Tm-4
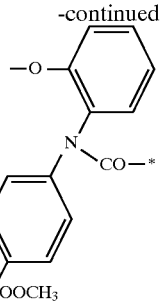
Tm-5
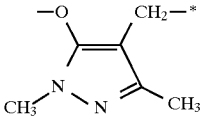

-continued
Tm-6
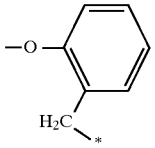
Tm-7
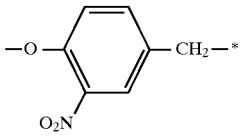
Tm-8
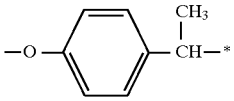
Tm-9
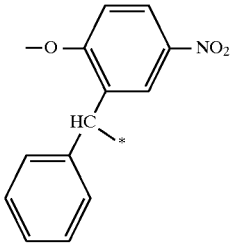
Tm-10
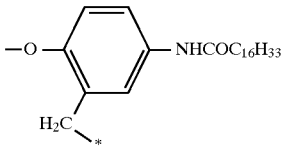
Tm-11
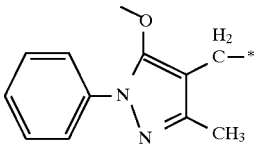
Tm-12
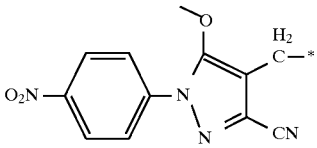
Tm-13
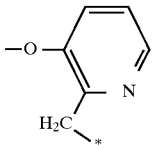
Tm-14
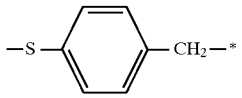
Tm-15
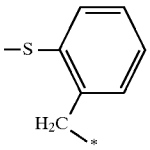
-continued
Tm-16
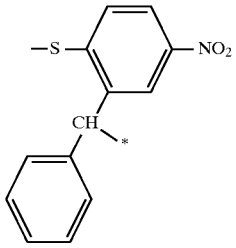
Tm-17
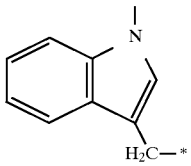
Tm-18
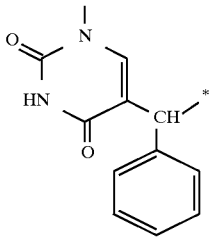
Tm-19
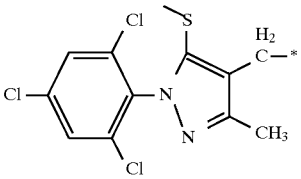
Tm-20
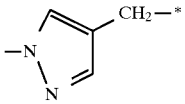
Tm-21
n = 0
* PUG bonding position
*—PUG
1
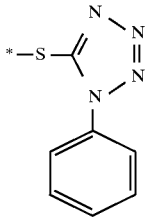
2
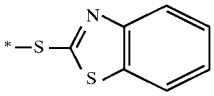
3
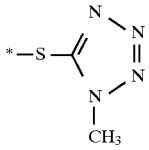

-continued
4 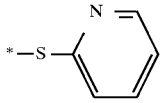
5 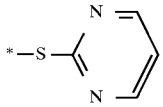
6 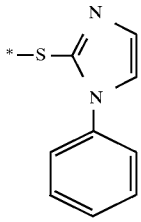
7 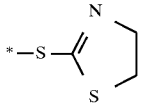
8 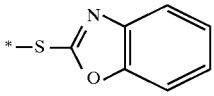
9 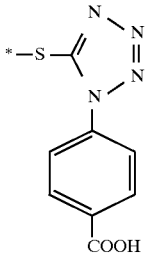
10 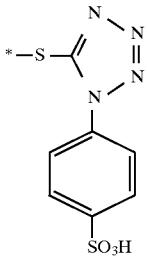
11 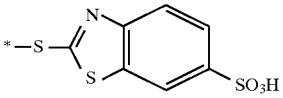
12 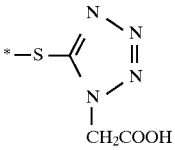
13 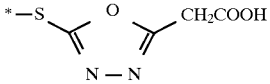
-continued
14 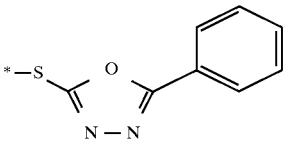
15 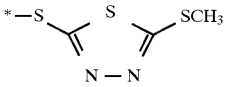
16 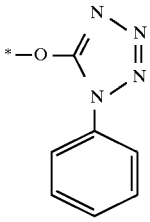
17 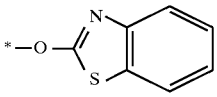
18 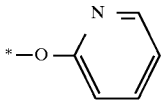
19 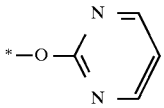
20 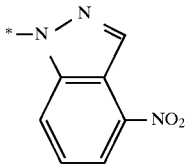
21 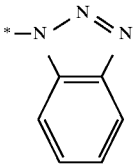
22 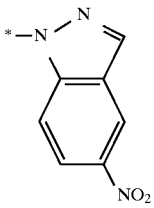
23 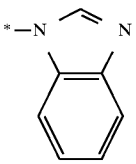

-continued
24
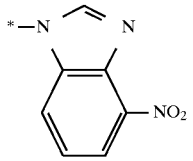
25
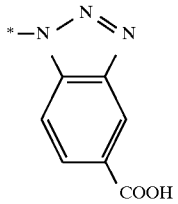
26
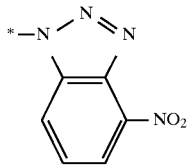
27
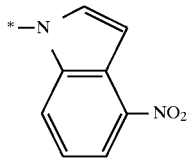
| Compound No. | Tm | PUG |
|---|---|---|
| 1 | 1 | 1 |
| 2 | 2 | 4 |
| 3 | 4 | 14 |
| 4 | 17 | 17 |
| 5 | 21 | 22 |
| 6 | 2 | 2 |
| 7 | 3 | 6 |
| 8 | 6 | 10 |
| 9 | 11 | 13 |
| 10 | 20 | 24 |
| 11 | 1 | 1 |
| 12 | 2 | 5 |
| 13 | 5 | 2 |
| 14 | 6 | 15 |
| 15 | 17 | 3 |
| 16 | 1 | 1 |
| 17 | 2 | 1 |
| 18 | 2 | 4 |
| 19 | 2 | 5 |
| 20 | 6 | 2 |
| 21 | 8 | 5 |
| 22 | 8 | 1 |
| 23 | 18 | 22 |
| 24 | 20 | 2 |
| 25 | 21 | 20 |
| 26 | 2 | 4 |
| 27 | 4 | 8 |
| 28 | 12 | 9 |
| 29 | 13 | 12 |
| 30 | 16 | 16 |
| 31 | 2 | 3 |
| 32 | 7 | 7 |
| 33 | 8 | 11 |
| 34 | 14 | 14 |
| 35 | 19 | 18 |
| 36 | 2 | 2 |
| 37 | 5 | 8 |
| 38 | 9 | 18 |
| 39 | 10 | 21 |
| 40 | 19 | 27 |
| 41 | 2 | 4 |
-continued
| Compound No. | Tm | PUG |
|---|---|---|
| 42 | 2 | 5 |
| 43 | 5 | 15 |
| 44 | 6 | 6 |
| 45 | 21 | 26 |
| 46 | 1 | 2 |
| 47 | 2 | 4 |
| 48 | 8 | 8 |
| 49 | 14 | 12 |
| 50 | 20 | 19 |
| 51 | 2 | 1 |
| 52 | 5 | 3 |
| 53 | 9 | 2 |
| 54 | 16 | 7 |
| 55 | 18 | 13 |
| 56 | 2 | 24 |
| 57 | 3 | 1 |
| 58 | 9 | 8 |
| 59 | 18 | 7 |
| 60 | 21 | 20 |
| 61 | 2 | 2 |
| 62 | 3 | 17 |
| 63 | 6 | 15 |
| 64 | 12 | 11 |
| 65 | 15 | 6 |
| 66 | 1 | 1 |
| 67 | 5 | 5 |
| 68 | 6 | 23 |
| 69 | 9 | 21 |
| 70 | 14 | 3 |
| 71 | 2 | 22 |
| 72 | 8 | 13 |
| 73 | 10 | 1 |
| 74 | 13 | 4 |
| 75 | 17 | 9 |
| 76 | 2 | 12 |
| 77 | 5 | 24 |
| 78 | 16 | 15 |
| 79 | 18 | 17 |
| 80 | 20 | 2 |
| 81 | 1 | 2 |
| 82 | 3 | 6 |
| 83 | 8 | 9 |
| 84 | 13 | 4 |
| 85 | 17 | 19 |
| 86 | 1 | 15 |
| 87 | 2 | 1 |
| 88 | 4 | 2 |
| 89 | 7 | 4 |
| 90 | 11 | 8 |
| 91 | 3 | 27 |
| 92 | 6 | 25 |
| 93 | 14 | 9 |
| 94 | 20 | 1 |
| 95 | 21 | 5 |
| 96 | 1 | 14 |
| 97 | 3 | 15 |
| 98 | 18 | 1 |
| 99 | 19 | 6 |
| 100 | 21 | 5 |
| 101 | 2 | 4 |
| 102 | 8 | 5 |
| 103 | 8 | 1 |
| 104 | 1 | 15 |
| 105 | 17 | 18 |
| 106 | 2 | 4 |
| 107 | 8 | 5 |
| 108 | 8 | 1 |
| 109 | 1 | 20 |
| 110 | 14 | 23 |
Compounds having an —NHNH— group are those represented by the following Formula RE-a or RE-b.
Formula RE-a
$T_1$—NHNHCO$V_1$—(Time)—PUG
Formula RE-b
$T_2$—NHNHCOCO$V_2$—(Time)—PUG In Formulas RE-a and RE-b, $T_1$, $T_2$, $V_1$ and $V_2$ are each an aryl group or alkyl group, these groups may have a substituent. Examples of the aryl group represented by $T_1$, $T_2$, $V_1$ or $V_2$ include benzene ring and naphthalene ring, they may have a substituent. As the preferable substituent of the rings, the followings are cited: a straight- or branched-chain alkyl group, preferably one having 2 to 20 carbon atoms such as a methyl group, ethyl group, isopropyl group or dodecyl group; an alkoxyl group, preferably one having 2 to 21 carbon atoms such as a methoxy group or ethoxy group; an aliphatic acylamino group, preferably one having an alkyl group having 2 to 21 carbon atoms such as an acetylamino group or heptylamno group; and an aromatic acylamino group. The preferable substituent further includes ones each formed by bonding substituted or unsubstituted aromatic rings through a bonding group such as —CONH—, —O—, —$SO_2$NH—, —NHCONH— or —$CH_2$CHN—. A preferable development inhibitor group represented by PUG includes residues of 5-nitroindazole, 4-nitroindazole, 1-phenyltetrazole, 1-(3-sulfophenyl)tetrazole, 5-nitrobenzotriazole, 4-nitrobenzotriazole, 5-nitroimidazole and 4-nitroimidazole. These development inhibiting compounds may be bonded with the CO portion of $T_1$—NHNH—CO— or the COCO portion of $T_2$—NHNH—COCO— through a hetero atom such as N or S, or through an alkylene group, aralkylene group or aryl group and further through a hetero atom such as N or S. On the other hand, compounds each formed by introducing a developing inhibiting group such as a residue of triazole, indazole, imidazole, thiazole or thiadiazole, to a hydroquinone compound having a ballast group may be used as the redox compound. Examples of such the compound include 2-(dodecylethylene oxide thiopropionamide)-5-(5-nitroindazole-2-yl)hydroquinone, 2-(stearylamide)-5-(1-phenyltetrazole-5-thio)hydroquinone, 2-(2,4-di-t-amylphenoxypropionamide)-5-(5-nitrotriazole-2-yl) hydroquinone and 2-dodecylthio-5-(2-mercaptothiodiazole-5-thio)hydroquinone. The redox compounds can be synthesized referring the description of U.S. Pat. No. 4,269,929.The redox compound may be contained in the silver halide emulsion layer, the hydrophilic colloid layer adjacent to the emulsion layer, or another hydrophilic layer adjacent to the emulsion layer through an interlayer.

Particularly preferable ones of the compounds represented by Formula RE-a or RE-b are described below.

RE-1

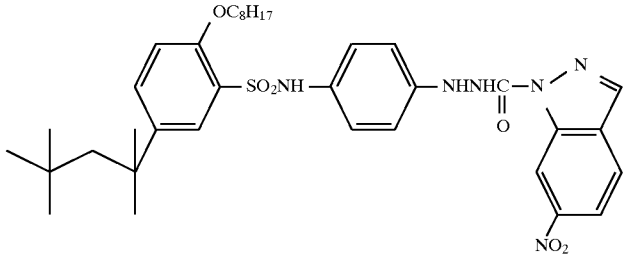

RE-2

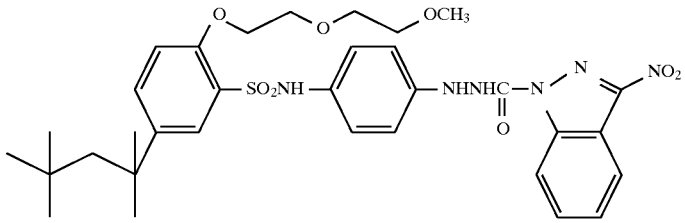

RE-3

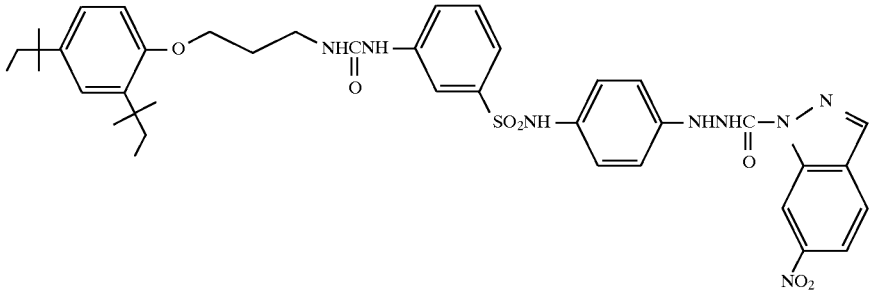

RE-4

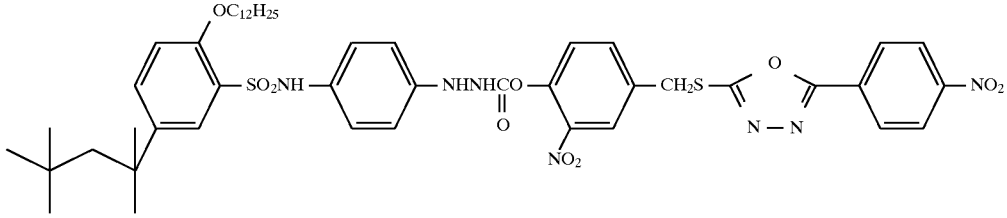

-continued

RE-5

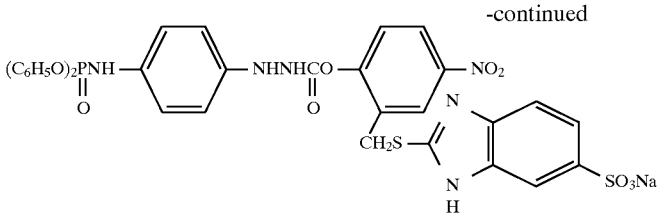

RE-6

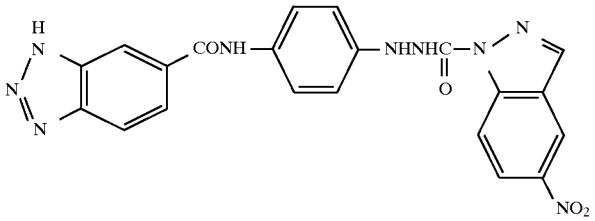

RE-7

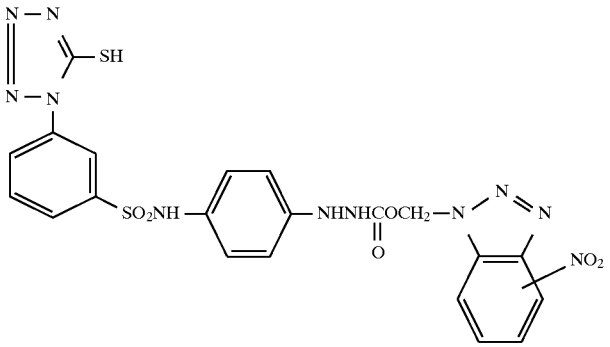

RE-8

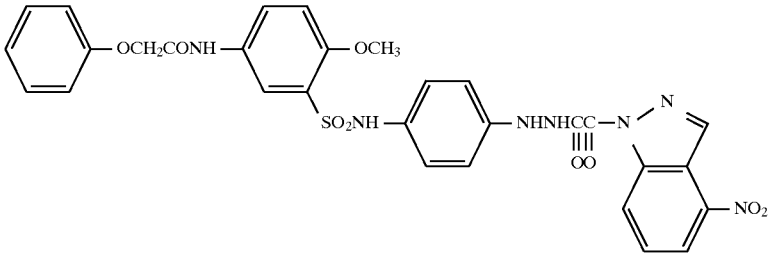

RE-9

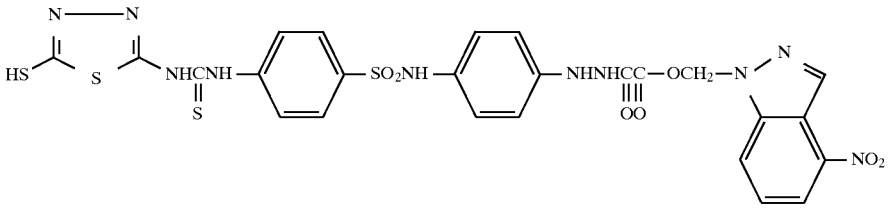

RE-10

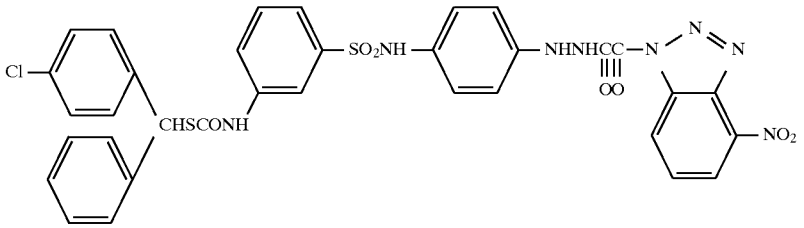

As concrete preferable examples of the redox compounds other than the above, Compound R-1 to R-50 described in JP O.P.I. 4-245243/1992, p.236 (8) [0053] to p. 250 (22) [0068], are cited.

The foregoing compound represented by Formula 2, 3, 4, RE-1 to RE-6, RE-a or RE-b is contained the light-sensitive layer in an amount of preferably $1\times10^{-8}$ to $5\times10^{-1}$ moles, more preferably $1\times10^{-7}$ to $5\times10^{-2}$ moles, per mole of silver halide contained in the light-sensitive material.

The compound can be added in a form of solution using a proper water-miscible organic solvent such as alcohols, ketones, dimethyl sulfoxide, dimethylformamide or methyl cellosolve. The compound can also be used in a form of emulsified dispersion using an oil, The compound further can be used in a form of a dispersion prepared by a method known as a solid dispersing method, by which the compound is dispersed in water by means of a ball mill, colloid mill, impeller disperser or by ultrasonic wave.

The compound may be existed in the silver halide emulsion layer, a layer adjacent to the emulsion layer, or another layer adjacent the emulsion layer trough the adjacent layer. It is particularly preferred the compound is contained in the emulsion layer and/or a hydrophilic colloid layer adjacent to the emulsion layer, the compound may be contained in plural layers different from each other.

Although the compound may be added at any step of preparation of the light-sensitive material, it is preferably to be added at a time between the time of two hours before starting the chemical sensitization of the silver halide emulsion and the time of just before coating the silver halide emulsion on the support.

The silver halide emulsion to be used in the light-sensitive material of the invention may be spectrally sensitized by a spectral sensitizing dye usually used for the purpose of spectral sensitization of silver halide emulsion. Usable sensitizing dye includes cyanine dyes, merocyanine dyes, polynuclear cyanine dyes, polynuclear merocyanine dyes, holopolar cyanine dyes, hemicyanine dyes, styryl dyes and hemioxonol dyes. Any nuclei usually used in sensitizing dyes may be applied in the above-mentioned sensitizing dyes. The nuclei usable in the senitizing dye include a pyrroline nucleus, oxazoline nucleus, thiazoline nucleus, pyrrole nucleus, oxazole nucleus, thiazole nucleus, selenazole nucleus, imidazole nucleus, tetrazole nucleus, pyridine nucleus, and a nucleus formed by condensing each of the above-mentioned nuclei with a aromatic hydrocarbon ring, i.e., indolenine nucleus, benzindolenine nucleus, indole nucleus, benzoxazole nucleus, benzothiazole nucleus, naphthoxazole nucleus, benzoselenazole nucleus, benzimidazole nucleus and quinoline nucleus. Theses nuclei each may have a substituent on the carbon atom thereof.

To the merocyanine dyes and polynuclear merocyanine dyes, 5- or 6-member heterocyclic nucleus such as a pyrazoline-one nucleus, thiohydantoin nucleus, 2-thiooxazolidine-,4-dione nucleus, thiazoline-2,4-dione nucleus, rhodanine nucleus and thiobarbituric acid nucleus may be applied as a nucleus having ketomethine structure.

It is preferred in the invention that a dye having one or two benzimidazole nuclei and one trimethine group in the molecule thereof is used solely or in combination with another dye as the spectral sensitizing dye. Among such the dyes, ones in each of which the one or two benzimidazole nuclei in the molecule each has a sulfonyl group are more preferred, and ones further having at least one electron attractive group in the molecule are particularly preferred.

Such the dyes are described in, for example, German Patent No. 929,080, U.S. Pat. Nos. 2,231,658, 2,493,748, 2,503,776, 2,519,001, 2,912,329, 3,655,394, 3,656,959, 3,672,897, 3,649,217, British Patent No.1,242,588 and Japanese Patent 44-14030/1969.

Among the above-mentioned dyes having benzimidazole nuclei, ones represented by the following Formula 5 are particularly preferred for the light-sensitive material of the invention.

Formula 5

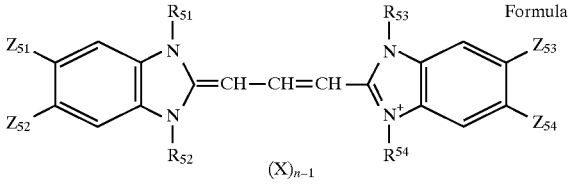

In the above formula, $R_{51}$ and $R_{53}$ are each an alkyl group, or alkenyl which may have a substituent; $R_{52}$ and $R_{54}$ are each a lower alkyl group and at least one of $R_{52}$ and $R_{54}$ is an alkyl group having a hydrophilic substituent. X is an ion necessary for neutralizing the intramolecular electric charge, n is 1 or 2, provided that n is 1 when an intramolecular salt is formed. $Z_{51}$, $Z_{52}$, $Z_{53}$ and $Z_{54}$ are each a halogen atom, alkyl group, alkoxyl group, alkylthio group, trifluoromethyl group, cyano group, carboxyl group, alkoxycarbonyl group, acyl group, sulfonyl group, carbamoyl group, sulfamoyl group, acetylamino group, acetyloxy group or aryl group.

In Formula 5, the substituted alkyl group represented by $R_{51}$ or $R_{53}$ includes, for example, a hydroxylmethyl group, ethoxycarbonylethyl group, ethoxycarbonylmethyl group, allyl group, benzyl group, phenetyl group, methoxyethyl group, methanesulfonylaminoethyl group and 3-oxobutyl group. The unsubstituted alkyl group represented by $R_{51}$ or $R_{53}$ includes alkyl groups having 1 to 4 carbon atoms such as a methyl group, ethyl group, propyl group and butyl group. The alkenyl group represented by $R_{51}$ or $R_{53}$ includes a vinyl group.

The lower alkyl group represented by $R_{52}$ or $R_{54}$ is preferably 1 to 4 carbon atoms including, for example, a methyl group, ethyl group, butyl group and trifluoromethyl group. The alkyl group has a hydrophilic group as a substituent. Examples of the hydrophilic group include a sulfo group, a carboxyl group, methanesulfonylamino-crabonyl group, methanesulfonylamino-sulfonyl group, acetylamino-sulfonyl group, sulfoamino group, trifluoroacetylaminosulfonyl group, acetylaminocarbonyl group and N-methylsulfamoyl group. Concrete examples of alkyl group having a thehydrophilic group include a carboxymethyl group, carboxyethyl group, methanesulfonylaminoethyl group, sulfobutyl group, sulfopropyl group, sulfopentyl group, 6-sulfo-3-oxahexyl group, 4-sulfo-3-oxapentyl group, 10 sulfo-3,6-dioxadecyl group, 6-sulfo-3-thiahexyl group, o-sulfobenzyl group and p-carboxybenzyl group.

The substituent represented by $Z_{51}$, $Z_{52}$, $Z_{53}$ or $Z_{54}$ includes, for example, a halogen atom such as a fluorine atom, chlorine atom, bromine atom or iodine atom; an alkyl group such as a methyl group, ethyl group or t-butyl group; an alkoxyl group such as methoxy group; an alkylthio group such as methylthio group; a trifluoromethyl group; a cyano group; a carboxyl group; an alkoxycarbonyl group such as methoxycarbonyl group or ethoxycarbonyl group; an acyl group such as acetyl group; sulfonyl group such as methanesulfonyl group; a carbamoyl group such as carbamoyl group, N,N-dimethylcarbamoyl group or N-morpholinocarbamoyl group; a sulfamoyl group such as sulfamoyl group or N,N-dimethylsulfamoyl group; an acetylamino group; an acetyloxy group and an aryl group.

The ion represented by $X_1$ necessary to neutralize the intramolecular charge may be either an anion or a cation. As the anion, for example, a halogen ion such as chlorine ion, bromine ion or iodine ion; perchlorate ion, ethylsulfate ion, thiocyanate ion, p-toluenesulfonate ion and perfluoroborate ion are cited. As the anion, for example, a hydrogen ion, n alkali metal ion such as lithium ion, sodium ion or potassium ion, an alkali-earth metal ion such as magnesium ion or calcium ion; and an ammonium ion; an organic ammonium ion such as triethylammonium ion, triethnolammonium ion or tetramethylammonium ion are cited.

Examples of the spectral sensitizing dye represented by Formula 5 are shown below.

| Dye | $R_{51}$ | $R_{52}$ | $R_{53}$ | $R_{54}$ | X | $Z_{51}$ | $Z_{52}$ | $Z_{53}$ | $Z_{54}$ |
|---|---|---|---|---|---|---|---|---|---|
| 5-1 | $CH_3$ | $(CH_2)_3SO_3H$ | $CH_3$ | $(CH_2)_3SO_3^-$ | — | Cl | H | Cl | H |
| 5-2 | $CH_3$ | $(CH_2)_3SO_3H$ | $CH_3$ | $(CH_2)_3SO_3^-$ | — | H | $SCH_3$ | H | $SCH_3$ |
| 5-3 | $CH_3$ | $(CH_2)_3SO_3H$ | $CH_3$ | $(CH_2)_3SO_3^-$ | — | H | F | H | F |
| 5-4 | $CH_3$ | $(CH_2)_4SO_3Na$ | $CH_3$ | $(CH_2)_4SO_3^-$ | — | H | CN | H | CN |
| 5-5 | $CH_3$ | $(CH_2)_3SO_3^-$ | $CH_3$ | $C_2H_4NHSO_2CH_3$ | — | H | $CONH_2$ | H | $CONH_2$ |
| 5-6 | $CH_3$ | $CH_3$ | $CH_3$ | $(CH_2)_3SO_3^-$ | — | $CH_3$ | $CH_3$ | H | $CF_3$ |
| 5-7 | $C_2H_4OH$ | $(CH_2)_3SO_3^-$ | $C_2H_4OH$ | $(CH_2)_3SO_3^-$ | — | H | $SO_2NH_2$ | H | $SO_2NH_2$ |
| 5-8 | $C_2H_5$ | $(CH_2)_3SO_3^-$ | $CH_3$ | $C_2H_5$ | — | H | $CF_3$ | $CH_3$ | $CH_3$ |
| 5-9 | $CH_3$ | $(C_2H_4O)_2C_3H_6SO_3^-$ | $CH_3$ | $(C_2H_4O)_2C_3H_5SO_3$ | — | H | $COCH_3$ | H | $COCH_3$ |
| 5-10 | $C_2H_5$ | $(CH_2)_3SO_3^-$ | $CH_3$ | $C_3H7$ | — | H | CF | H | $CH_3$ |
| 5-11 | $C_2H_4COCH_3$ | $CH_2COOH$ | $C_2H_4OCH_3$ | $(CH_2)_2SO_3^-$ | — | H | $CF_3$ | H | $CF_3$ |
| 5-12 | $CH_3$ | $(CH_2)_3SO_3^-$ | $CH_3$ | $(CH_2)_3SO_3^-$ | — | H | $SO_2F$ | H | $SO_2F$ |
| 5-13 | $CH_3$ | $C_2H_5$ | $CH_3$ | $(CH_2)_3SO_3^-$ | — | H | $SCH_3$ | H | $CF_3$ |
| 5-14 | $C_2H_5$ | $C_2H_4NHSO_2CH_3$ | $CH_3$ | $(CH_2)_4SO_3^-$ | — | H | F | H | F |
| 5-15 | $CH_3$ | $(CH_2)_3SO_3^-$ | $C_2H_5$ | $CH_2CF_3$ | — | H | $CF_3$ | H | $CF_3$ |
| 5-16 | $CH_3$ | $(CH_2)_3SO_3^-$ | $CH_3$ | $(CH_2)_3SO_3^-$ | — | H | $CF_3$ | H | $CF_3$ |
| 5-17 | $CH_3$ | m-sulfonium-tolyl | $C_2H_5$ | $(CH_2)_4SO_3^-$ | — | H | $COOCH_3$ | H | $COOCH_3$ |
| 5-18 | $C_2H_5$ | $C_2H_5$ | $CH_3$ | $(CH_2)_2SO_3^-$ | — | H | $CF_3$ | H | $CF_3$ |
| 5-19 | $CH_3$ | $C_2H_5OC_3H_6SO_3^-$ | $CH_3$ | $C_2H_4OC_3H_5SO_3^-$ | — | H | $SO_2CH_3$ | H | $SO_2CH_3$ |
| 5-20 | $CH_3$ | $CH_2CF_3$ | $CH_3$ | $(CH_2)_3SO_3^-$ | — | H | $CF_3$ | H | $CF_3$ |
| 5-21 | $CH_3$ | $(CH_2)_3SO_3^-$ | $C_2H_5$ | $(CH_2)_3SO_3^-$ | — | H | $SO_2CH_3$ | H | $SO_2CH_3$ |
| 5-22 | $CH_3$ | $(CH_2)SO_3H$ | $CH_3$ | $(CH_2)_3SO_3^-$ | — | H | $CF_3$ | H | $CF_3$ |
| 5-23 | $C_2H_5$ | $CH_2CF_3$ | $CH_3$ | $(CH_2)_3SO_3^-$ | — | H | 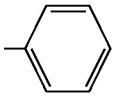 | H | $CF_3$ |
| 5-24 | $CH_3$ | $CH_2COOH$ | $CH_3$ | $(CH_2)_4SO_3^-$ | — | H | $COCH_3$ | H | $SCH_3$ |
| 5-25 | $CH_3$ | $CH_2COOCH_3$ | $CH_3$ | $(CH_2)_3SO_3^-$ | — | H | $CF_3$ | H | $CF_3$ |
| 5-26 | $C_2H_5$ | $CH_2COOCH_3$ | $CH_3$ | $(CH_2)_3SO_3^-$ | — | H | $CF_3$ | Cl | $CF_3$ |
| 5-27 | $CH_2COOC_2H_5$ | $(CH_2)_3SO_3^-$ | $CH_3$ | $CH_2COOH$ | — | $CONH_2$ | H | H | $COCH_3$ |
| 5-28 | $CH_3$ | $CH_2COOCH_3$ | $C_2H_5$ | $(CH_2)_3SO_3^-$ | — | H | $CF_3$ | H | $CF_3$ |
| 5-29 | $CH_3$ | $CH_2COOH$ | $CH_3$ | $CH_2COO^-$ | — | H | $SC_3$ | H | $SCH_3$ |
| 5-30 | $C_2H_5$ | $CH_2CONH_2$ | $CH_3$ | $(CH_2)_3SO_3^-$ | — | H | $CF_3$ | H | $CF_3$ |
| 5-31 | $C_2H_5$ | $CH_2COOC_2H_5$ | $CH_3$ | $(CH_2)_3SO_3^-$ | — | H | $CF_3$ | H | $CF_3$ |
| 5-32 | $C_2H_4OH$ | $(CH_2)_2SO_3^-$ | $C_2H_5$ | $(CH_2)_4SO_3^-$ | — | H | H | H | H |
| 5-33 | $C_2H_5$ | $CH_2COOC_3H_7$ | $CH_3$ | $(CH_2)_3SO_3^-$ | — | H | $CF_3$ | H | $CF_3$ |
| 5-34 | $CH_3$ | $(CH_2)_4SO_3^-$ | $CH_3$ | $(CH_2)_3SO_3^-$ | — | $CH_3$ | Cl | $CH_3$ | Cl |
| 5-35 | $C_2H_5$ | $CH_2CON(CH_3)_2$ | $CH_3$ | $(CH_2)_3SO_3^-$ | — | H | $CF_3$ | H | $CF_3$ |
| 5-36 | $CH_3$ | m-sulfonium-tolyl | $CH_3$ | $C_2H_4NHSO_2CH_3$ | — | H | $COCH_3$ | H | $COCH_3$ |
| 5-37 | $CH_3$ | $CH_2NHC_2H_4SO_3^-$ | $CH_3$ | $CH_2CF_3$ | — | $SCH_3$ | $CF_3$ | $SCH_3$ | $CH_3$ |
| 5-38 | $CH_3$ | $(CH_2)_4SO_3^-$ | $C_2H_5$ | $(CH_2)_4SO_3^-$ | — | H | CN | H | CN |
| 5-39 | $CH_3$ | $CH_2CN$ | $C_3H7$ | $(CH_2)_3SO_3^-$ | — | H | 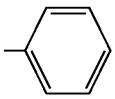 | H | $CH_3$ |
| 5-40 | $C_2H_5$ | $(CH_2)_3SO_3^-$ | $CH_3$ | $CH_2COOH$ | $NH(C_2H_5)_3$ | H | $SO_2CH_3$ | H | $SCH_3$ |
| 5-41 | $CH_3$ | $CH_2COCNHCH_2SO_3^-$ | $CH_3$ | $C_2H_4$ | — | H | $CF_3$ | H | $CF_3$ |
| 5-42 | $CH_3$ | $CH_2CF_3$ | $CH_3$ | $(CH_2)_4SO_3^-$ | — | H | $CF_3H$ | $CF_3$ | |
| 5-43 | $CH_3$ | $CH_2COOCH_3$ | $CH_3$ | $(CH_2)_3SO_3^-$ | — | H | COOH | H | COOH |
| 5-44 | $C_2H_2CF_3$ | $CH_3$ | $CH_3$ | $C_2H_4CH(CH_3)_3SO_3^-$ | — | $CF_3$ | H | H | $CF_3$ |
| 5-45 | $C_2H_4OCH_3$ | $(CH_2)_3SO_3^-$ | $C_2H_4OCH_3$ | $(CH_2)_3SO_3^-$ | — | H | $SO_2NH_2$ | H | $SO_2NH_2$ |
| 5-46 | $CH_3$ | $CH_2CF_3$ | $C_3H_7$ | $(CH_2)_2SO_3^-$ | — | H | $CF_3$ | H | 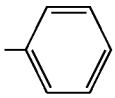 |
| 5-47 | $CH_3$ | $CH_2CF_3$ | $CH_3$ | $CH_2CONHCH_2SO_3^-$ | — | H | $CF_3$ | H | $CF_3$ |
| 5-48 | $CH_3$ | $(C_2H_4O)_2C_3H_6SO_3^-$ | $CH_3$ | $(C_2H_4O)_2C_3H6SO_3^-$ | — | H | $COCH_3$ | H | $COCH_3$ |
| 5-49 | $CH_2CH{=}CH$ | $(CH_2)_2SO_3^-$ | $CH_2CH{=}CH_2$ | $(CH_2)_2SO_3^-$ | — | H | $CONH_2$ | H | $CONH_2$ |
| 5-50 | $CH_2CH_2OH$ | $(CH_2)_4SO_3^-$ | $CH_2CH_2OH$ | $(CH_2)_4SO_3^-$ | — | H | $COOCH_3$ | H | $COOCH_3$ |
| 5-51 | $CH_3$ | $(CH_2)_2SO_3^-$ | $CH_2H_4OH$ | $(CH_2)_2SO_3^-$ | — | H | F | H | Cl |
| 5-52 | $CH_2CH_2OH$ | $CH_2COOH$ | $C_2H_5$ | $(CH_2)_3SO_3^-$ | — | H | $SO_2CF_3$ | H | $OCH_3$ |
| 5-53 | $(C_2H_4O)_2H$ | $(CH_2)_3SO_3^-$ | $CH_3$ | $C_2H_4COCH_3$ | — | H | $SO_2NH_2$ | $CH_3$ | $CH_3$ |
| 5-54 | $CH_3$ | $C_2H_4S(CH_2)_4SO_3^-$ | $CH_3$ | $C_2H_4S(CH_2)_4SO_3^-$ | — | H | $SO_2CH_3$ | H | $SO_2CH_3$ |
| 5-55 | $C_2H_5$ | $(CH_2)_3SO_3^-$ | $C_2H_5$ | $(CH_2)_3SO_3^-$ | — | H | CN | H | $CN_3$ |
| 5-56 | $C_2H_5$ | $(CH_2)_4SO_3^-$ | $C_2H_5$ | $(CH_2)_4SO_3^-$ | — | H | $COOHC_4H_9$ | H | $COOC_4H_9$ |
| 5-57 | $C_2H_5$ | $(CH_2)_3SO_3^-$ | $C_3H_4$ | $(CH_2)_4SO_3^-$ | — | Cl | Cl | Cl | Cl |
| 5-58 | $C_2H_3$ | $(CH_2)_3SO_3^-$ | $C_2H_4OH$ | $CH_2COOH$ | $NH(C_2H_5)_3$ | H | $CF_3$ | H | $CF_3$ |

-continued

| Dye | $R_{51}$ | $R_{52}$ | $R_{53}$ | $R_{54}$ | X | $Z_{51}$ | $Z_{52}$ | $Z_{53}$ | $Z_{54}$ |
|---|---|---|---|---|---|---|---|---|---|
| 5-59 | $C_2H_5$ | $(CH_2)_4SO_3Na$ | $C_2H_5$ | $(CH_2)_4SO_3^-$ | — | H | 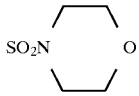 | H | $CF_3$ |
| 5-60 | $C_2H_5$ | $(CH_2)_2CH(CH_3)SO_3^-$ | $CH_3$ | $(CH_2)_2OH$ | — | Cl | $CF_3$ | H | $CF_3$ |
| 5-61 | $CH_2{=}CH-$ | $(CH_2)_3SO_3^-$ | $C_2H_5$ | $(CH_2)_4SO_3^-$ | $K^+$ | Cl | 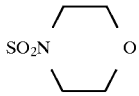 | H | $CF_3$ |
| 5-62 | $CH_2{=}CH-$ | $(CH_2)_3SO_3^-$ | $CH_3$ | $CH_2COO^-$ | H | H | $CF_3$ | H | $CF_3$ |

The compounds described in Tables 1 and 2 in JP O.P.I. 7-114131/1995 and those described in Table in Table 1 in JP O.P.I. No. 5-88293/1993 are also usable as the benzimidazolocarbocyanine dye represented by Formula 5.

It is preferred that the benzimidazolocarbocyanine dye represented by Formula 5 is used in a ratio of not less than 40% based on the total amount of sensitizing dyes contained in the light-sensitive material to obtain a high sensitivity and an improved remaining color stain.

The "spectral sensitizing dye" means one which is adsorbed by a silver halide grain and contributes to the sensitization. In the present invention, preferable sensitizing dyes are ones having a maximum absorbing wavelength of J-aggregate absorption band of not more than 555 nm when the absorption is determined by measuring the spectral reflective absorption of the dye adsorbed on a silver halide grain. When the light-sensitive material is used as a medical radiographic light-sensitive material, it is preferred that the adsorption band of J-aggregate of the dye is formed at a spectral range similar to that of green-light emitted from a fluorescent substance of a intensifying screen, the above adsorption band of J-aggregate is determined by measuring the spectral reflective absorption of the dye adsorbed on a silver halide grain. Namely, it is preferred that the sensitizing dye is selected or combined with another dye so as to form the maximum absorption band of J-aggregate within the range of 520 to 555 nm. The maximum absorption wavelength oof the dye is more preferably 530 to 553 nm, and most preferably 540 to 550 nm. The temperature at which the spectral sensitizing dye is added to the emulsion is preferably within the range of from 25° to 45° C., more preferably 30° to 45° C., further preferably 35° to 45° C. The ripening temperature for sensitization may preferably be set an optional temperature within the range of from 50° to 80° C., more preferably 50° to 60° C.

The adding amount of the spectral sensitizing dye is preferably set so that the covering ratio of the molecular monolayer of the dye to the surface area of each of the light-sensitive grains in the silver halide emulsion layer is 40% to 90%, more preferably 50% to 80%, even though the amount may be changed depending on the kind of dye, and on the structure, composition, ripening condition, purpose and use of the silver halide grains.

The above covering ratio is defined as the value of a percentage of the amount of dye actually added to the silver halide emulsion to the saturated adsorption amount of the dye to the silver halide grain determined from an isothermal adsorption curve of the dye at 50° C., which is accounted for the covering ratio of 100%.

The adding amount of the dye is preferably less than 600 mg, more preferably not more than 450 mg, per mole of silver halide even though the preferable amount is changed depending on the total surface area of silver halide grains contained in the emulsion.

As the solvent for the sensitizing dye, usually used water-miscible organic solvents may be used. Examples of the solvent include alcohols, ketones, nitryls, alkoxyalcohols, concrete examples of which include methanol, ethanol, n-propyl alcohol, isopropyl alcohol, ethylene glycol, propylene glycol, 1,3-propanediol, acetone, acetonitryl, 2-methoxymethanol and 2-ethoxyethanol.

A surfactant has been used as a dispersing agent of the sensitizing dye. The surfactant includes that of anion-type, cation-type and amphotelic-type. Any types of the surfactant may be used in the emulsion to be used in the light-sensitive material of the invention.

In the invention, the effect of the sensitizing dye is enhanced when the dye is added to the emulsion in a form of dispersion of fine solid particle compared to the effect of the dye when the dye is added in a form of solution in the organic solvent. It is preferred that at least one of the sensitizing dye is added to the emulsion in a form of fine solid particles, which are hardly soluble in water and dispersed in water containing substantially no organic solvent nor surfactant.

When the sensitizing dye is added in the form of dispersion of fine solid particles, the solubility of the sensitizing dye in water is preferably $2\times10^{-4}$ to $4\times10^{-2}$ moles per liter, more preferably $1\times10^{-3}$ to $4\times10^{-2}$ moles per liter.

The solubility of the sensitizing dye in water is determined by the following method.

Thirty milliliter of ion-exchanged water is put in an Erlenmeyer flask with a capacity of 50 ml, and a dye in an amount exceeding the amount completely dissolvable in water is added to water in the flask. The water is stirred for 10 minutes by a magnetic stirrer while keeping at 27° C.

Thus obtained suspension is filtered through Filter Paper No.2, manufactured by Toyo Co. Ltd. The filtrate is further filtered by a disposal filter, manufactured by Toso Co. Ltd.,. The filtrate is appropriately diluted and the spectral absorption subjected to measuring spectral absorption by a spectrophotometer U-3410 manufactured by Hitachi Co. Ltd. The solubility is calculated by the following equation according to Lambert-Beer's law.

$$D=\epsilon lc$$

wherein D is absorbance, $\epsilon$ is spectral absorption coefficient, l is the length of the cell and c is concentration (moles/liter).

A substance showing a super-sensitization effect which is a dye having no sensitizing effect or a substance absorbing no visible light may be used together with the above sensitizing dye.

The spectral sensitizing dye may be added to the emulsion at a time in the corse the chemical ripening of the emulsion, preferably at the time of starting the chemical ripening. A high-sensitive emulsion excellent in the spectral sensitization efficiency can be obtained by adding the sensitizing dye at a time during from the nucleation period to the completion of the desalting process of the emulsion. Further, the same kind of the dye added at the above-mentioned period or another dye may be additionally added to the emulsion at a time in the course of after completion of desalting to, through the chemical ripening process, just before the coating process of the emulsion.

In the present invention, it is preferred that the tabular silver halide grains are chemically sensitized by at least one compound selected from selenium compounds and tellurium compounds.

The usable selenium sensitizer includes various kinds of selenium compound. The selenium sensitizer are described, for example, in U.S. Pat. Nos. 1,574,944, 1,602,592 and 1,623,499, JP O.P.I. Nos. 60-150046, 4-25832, 4-109240 and 4-147250. Examples of useful selenium sensitizer include colloidal metallic selenium; isoselenocyanates such as allyl isoselenocyanate; selenoureas such as N,N-dimethylselenourea, N,N,N'-triethylselenourea, N,N,N'-trimethyl-N'-heptafluoro-propylcarbonylselenourea, N,N,N'-trimethyl-N'-4-heptafluoroselenourea and N,N,N'-trimethyl-N'-nitrophenylcarbonylselenourea; selenoketones such as selenoacetone and selenoacetophenone; selenoamides such as selenoacetoamide and N,N-dimethylselenobenzamide; selenocarbonic acids and their esters such as 2-selenopropionic acid and methyl 3-selenobutylate; selenophosphates such as tri-p-triselenophosphate; selenides such as triphenylphosphine selenide, diethyl selenide and diethyl diselenide. Particularly referable selenium sensitizers are selenides, selenoureas, selenoamides and selenoketones. Concrete examples of techniques for using the selenium sensitizer are described in the following patent documents: U.S. Pat. Nos. 1,574,944, 1,602,592, 1,623,499, 3,297,446, 3,297,447, 3,320,069, 3,408,196, 3,408,197, 3,442,653, 3,420,670 and 3,591,385, French Patent Nos. 2,693,038 and 2,093, 209, Japanese Patent (JP) Nos. 52-34491/1977, 52-34492/1977, 53-295/1978 and 57-22090/1982 and JP O.P.I. Nos. 59-180536/1984, 59-185330/1984, 59-181337/1984, 59-187338/1984, 59-192241/1984, 60-150046/1985, 60-151637/1985, 61-246738/1986, 3-4221/1991, 3-24537/1991, 3-111838/1991, 3-116132/1991, 3-148648/1991, 3-237450/1991, 4-16838/1992, 4-25832/1992, 4-32831/1992, 4-96059/1992, 4-109240/1992, 4-140738/1992, 4-140739/1992, 4-147250/1992, 4-149437/1992, 4-184331/1992, 4-190225/1992, 4-191729/1992 and 4-195035/1992 and British Patent Nos. 255,846 and 861,984. The technique is also described in H. E. Spencer, Journal of Photographic Science, vol. 31, p.p. 158–169, 1983.

The selenium is usually used in an amount of $10^{-8}$ to $10^{-4}$ moles per mole of silver halide, even though the amount may be changed depending on the kind of selenium compound, the kind of silver halide grains and the condition of chemical ripening.

The selenium sensitizer may be added to the emulsion by various method according to the property of the selenium compound, i.e., a method by which the selenium compound is dissolved in water or an organic solvent such as methanol and added to the emulsion, or another method by which the selenium compound is previously mixed with a gelatin solution and added to the emulsion or a method described in JP O.P.I. No. 4-140739/1992 by which the selenium sensitizer is added to the emulsion in a form of dispersion of mixed solution with an organic solvent-soluble polymer.

The temperature of chemical ripening using the selenium sensitizer is preferably 40° to 90° C., more preferably 45° to 80° C., The pH value of the emulsion is preferably 4 to 9, more preferably 6 to 9.5.

Tellurium sensitizers and sensitizing methods using those are described in U.S. Pat. Nos. 1,623,499, 3,320,069, 3,772,031, 3,531,289 and 3,655,394, British Patent Nos. 235,211, 1,121,496, 1,295,462 and 1,396,696, Canadian Patent No. 800,958, JP O.P.I. Nos. 4-204640/1992 and 4-333043/1992. Examples of useful tellurium sensitizer include telluroureas such as N,N-dimethyltellurourea, tetramethyltellurourea, N-carboxyethyl-N,N'dimethyltellurourea and N,N'-dimethyl-N'-phenyltellurourea; phosphine tellurides such as tributylphosphine telluride, tricyclohexylphosphine telluride, triisopropylphosphine telluride, butyldiisopropylphosphine telluride and dibutylphenylphosphine telluride; telluroamides such as telluroacetamide and N,N-dimethyltellurobenzamide; telluroketones; telluroesters; and isotellurocyanates. The techniques for applying the tellurium sensitizer are similar to those for the selenium sensitizer.

It is also preferred to apply a reduction sensitization to the emulsion to be used in the light-sensitive material. The reduction sensitization is preferably applied in the course of growing the silver halide grains. The method for applying the reducing sensitization to the emulsion includes not only the method by which the sensitization is applied to the silver halide grain while the grains are growing but the method by which the growing of the silver halide grains is temporarily reduction sensitization is interrupted and the reduction sensitization is applied in the period of the interruption, thereafter the growing of the grains is further continued.

The emulsion to be used in the invention may be sensitized by a sulfur compound or a noble metal salt such as a gold salt furthermore the sensitization by the selenium sensitizer or the tellurium sensitizer. The emulsion may be sensitized by the reduction sensitization and by a combination of the above-mentioned sensitization methods.

Sulfur sensitizers usable in the invention include those described in U.S. Pat. Nos. 1,574,944, 2,410,689, 2,278,947, 2,728,668, 3,501,313 and 3,656,955, German Patent (OLS) No. 1,422,869, JP O.P.I. Nos. 56-24937/1981 and 55-45016/1980. Concrete examples of the sulfur sensitizer include thiosulfate such as sodium thiosulfate, thiourea derivatives such as 1,3-diphenylthiourea, triethylthiourea and 1-ethyl-3-(2-thiazolyl)thiourea, rhodanine derivatives, dithiacarbamic acids, organic polysulfide compounds and elemental sulfur. As the elemental sulfur, α-sulfur with a rhombic crystal system is suitable.

The gold-sensitizer includes gold chloride, gold thiosulfate, gold thiocyanate, and complexes of gold formed by gold and various compounds such as thioureas and rhodanines.

The using amounts of the sulfur sensitizer and the gold sensitizer are each usually $1\times10^{-9}$ moles to $1\times10^{-4}$ moles, preferably $1\times10^{-8}$ moles to $1\times10^{-5}$ moles, per mole of silver halide even though the amount is changed depending on the kind of silver halide emulsion, taht of the sensitizing compound and the ripening condition.

The sulfur sensitizer and the gold sensitizer may be added to the emulsion in a form of solution with water or an organic solvent such as alcohol, and in a form of dispersion prepared by using a water-insoluble solvent or a medium such as gelatin.

The sulfur sensitization and the gold sensitization may be applied simultaneously or separately and stepwise. In the later case, a preferable result is often obtained when the gold sensitization is applied after of in the course of proper sulfur sensitization.

The reduction sensitization is performed by adding a reducing agent and/or a water-soluble silver salt to the silver halide emulsion so that the sensitization is applied in the course of growing of the silver halide grain of the emulsion.

As preferable examples of the reducing agent, thiourea dioxide and ascorbic acid and its derivatives are described. Preferable reducing agents other than the above include polyamines such as hydrazines, polyamines such as diethylene-triamine, dimethylamineborans, and sulfites.

Although it is preferred to change the adding amount of the reducing agent according to the kind of reducing agent, size, composition and crystal habit of the silver halide grains, and environmental condition such as the temperature, pH and pAg of the reaction system, generally, a good result is obtained when reducing agent is added in an amount is 0.01 to 2 mg per moles of silver halide in the case of thiourea dioxide.

In the case of ascorbic acid, an amount within the range of from 50 mg to 2 g per moles of silver halide is preferred.

In the preferable condition of the reducing sensitization, the temperature is about 40° to 70° C., ripening time is about 10 to 200 minutes and pAg is about 1 to 10, in which pAg is a reciprocal of the ion concentration of $Ag^+$.

Silver nitrate is preferred as the water-soluble silver salt. Silver ripening, a kind of reduction sensitization technique, is performed by addition of the water-soluble silver salt. The pAg value at the silver ripening is preferably 1 to 6, more preferably 2 to 4. The other condition such as the temperature, pH and time for the silver ripening are each preferably within the ranges similar to those in the above-mentioned reducing sensitization.

Although the later-mentioned usual stabilizers may be used for the silver halide emulsion containing silver halide grains sensitized by the reducing sensitization, a good result can be obtained often by using an anti-oxidation agent described in JP O.P.I. No. 57-82831/1982 and/or a thio-sulfinic acid compound described in V. S. Gahler, "Zeitschrift fur wissenschaftliche Photographie" Bd. 63, 133 (1969) and JP O.P.I. 54-1019/1979 with the stabilizer in combination. These compounds may be added to the emulsion at any step of preparation of the emulsion, from the grain formation step to the preparation step just before the coating step of the emulsion.

Fine grains of silver halide may be added to the emulsion at a time in the course of from the chemical ripening to coating of the emulsion. The above "in the course of from the chemical ripening to coating" means that the fine grains of silver halide is added to the emulsion in the period including that of chemical ripening and that from the completion of the chemical sensitization to just before coating of the emulsion for procucing the light-sensitive material.

Foe example, the fine grains is preferably added during the course of chemical ripening process when the silver iodide fine grains are added for the purpose of intensifying adsorption of a sensitizing dye to the emulsion grains, even though the fine grains may be added in any steps of from the chemical sensitization to just before the coating of the emulsion. Here, the "chemical ripening process" means the period of from the time of completion of the physical ripening and desalting of the emulsion to the time of applying a procedure to stop the chemical ripening, during the above period a chemical sensitizer is added to applying the chemical ripening. The addition of the fine grains may be carried out separately at several times. Further, it is allowed to add another emulsion which is chemically ripened in advance. The temperature of the emulsion at the time of addition of the silver iodide fine grains is preferably within the range of 30° to 80° C., more preferably 40° to 65° C. It is preferred that the addition of the fine grains is carried out under a condition so that the all or a part of the fine grains are disappeared during the addition of the fine grains and the time just before the coating of the emulsion. It is more preferable that 20% or more of the fine grains added to the emulsion is disappeared at the time of just before the coating of the emulsion.

Although any kind of silver halide such as silver bromide, silver iodobromide, silver iodochloride, silver chlorobromide silver iodochlorobromide or silver chloride may optionally be used in the invention, silver iodobromide, silver iodochlorobromide and silver chloride are particularly preferred.

As the tabular silver halide grains in the invention, any kind of silver halide such as silver bromide, silver iodobromide, silver iodochloride, silver chlorobromide silver iodochlorobromide or silver chloride may optionally be used. However, the silver iodide content is not more than 1 mol-% if the tabular grain contains silver iodide, since the fog inhibiting effect of the invention is considerably decreased when the iodide content exceeds 1 mole-%. In such the case, silver iodobromide, silver iodochlorobromide and silver chloride are preferred.

It is preferred that the silver halide emulsion layer of the light-sensitive material of the invention contains tabular grains having a core/shell structure which is constituted two or more layers substantially different from each other in the halide composition thereof, in a ratio of 50 to 100% by number even though the tabular grains may be ones each having an uniform structure.

In the core/shell structure of the tabular grain, a domain having a halogen composition different from that of the core may exist at the center portion of the grain. In such the case, the halide composition of the seed grain may be an optional combination of silver bromide, silver iodobromide, silver chloroiodobromide, silver chlorobromide and silver chloride.

In the grain constituted by plural layers different from each other in the silver halide compositions thereof, grains are preferred which have each a layer with a higher iodide content in the internal portion of the grain and a layer with a lower iodide content or a silver bromide layer at the surface of the grain. In such the case, the iodide content of the internal layer (core) having the highest iodide content is preferably not less than 2.5 mole-%, more preferably not less than 5 mole-%, and that of the outermost layer (shell) is preferably 0 to 5 mole-%, more preferably 0 to 3 mole-%, and the iodide content of core is 3 mole-% or more higher than that of the shell layer.

In the emulsion of the invention, the sum of the projection areas of the tabular grains each abing an aspect ratio or the ratio of diameter/thickness of the grain of not less than 2 accounts for 50% or more of the total projection area of the all silver halide grains contained in the emulsion. The aspect ratio of the tabular silver halide grains used in the light-sensitive material of the invention is preferably 2 to 12, more preferably 3 to 8.

The tabular grain relating to the invention may be either one having an outer face substantially constituted by {111} or one having an outer face constituted {100} face. The grain further may be one having both of {111} face and {100} face at the outer face. However, the effect of the invention is enhanced when the tabular grain is one having two parallel major faces constituted by {100} face and having an average silver chloride content of not less than 20 mole-%, and the developing time is less than 20 seconds.

The silver halide grains having two parallel major faces constituted by {100} face can be preparred by the methods described in, for example, JP O.P.I. Nos. 5-204073/1993, 6-5936/1994 and 8-211522, U.S. Pat. Nos. 4,063,951, 4,386,156, 5,275,930, 5,292,632 and 5,264,337. These methods can be applied to prepare silver halide grains preferably usable in the light-sensitive material to be used in the invention.

Although the tabular grains relating to the invention may be either monodispersed or polydispersed, monodispersed grains are preferred. It is preferred, in concrete, that the width of the grain size distribution defined by the relative standard deviation or variation coefficient, which is calculated by the following equation, is not more than 25%, more preferably not more than 20%, particularly preferably not more than 15%.

(Standard deviation of grain diameter/Average grain diameter)×100=Widths of grain diameter distribution(%)

It is preferred that the thickness of the tabular grains relating to the invention have a narrow distribution. In concrete, the widths of the distribution defined by the following equation is preferably not more than 25%, more preferably 20%, particularly preferably 15%.

(Standard deviation of thickness/Average thickness)×100=Widths of thickness distribution (%)

Further, it is also preferred in the tabular grain silver halide emulsion relating to the invention that the distribution of iodide content in each of the grains of the emulsion is narrow. In concrete, the widths of the distribution defined by the following equation is preferably not more than 25%, more preferably 20%, particularly preferably 15%.

(Standard deviation of iodide contents/Average iodide content)×100=Widths of iodide content distribution (%)

In the invention, when tabular silver halide grains having a twin face, each of the tabular grains preferably has a major face having a hexagonal shape. The hexagonal tabular grain is a grain which has a major {111} face with a hexagonal shape, and has a maximum ratio of adjacent sides of 1.0 to 2.0. The maximum ratio of adjacent sides is a ratio of the length of the shortest side to that of the longest side of the hexagon. When the hexagonal tabular grain has a maximum ratio of adjacent sides of 1.0 to 2.0, it is allowed that the corner of the grain has a roundness. When the corner has a roundness, the length of a side is defined as the distance from a point at which the extended line of the straight part of a side and that of the adjacent side. A tabular grain having a almost circular shape formed by increasing the roundness of the all corners of the hexagon is also usable.

In the invention, it is preferred that the half length of each of the sides of the hexagon of the hexagonal tabular grain is substantially straight. In the invention, it is more preferable that the maximum ratio of adjacent sides is within the range of from 1.0 to 1.5.

The silver halide grain relating to the invention may has a dislocation. The dislocation can be observed by direct observation by a transmission electron- microscope at a low temperature according to the method described in, for example, J. F. Hamilton, Journal of Photographic Science and Engineering, 57, (1967) and T. Shiozawa, Journal of Society of Photographic Science of Japan 35, 213 (1972). Silver halide grains carefully taken out from the silver halide emulsion so that any dislocation is not newly generated by pressure applied to the grains in the taking out operation. The silver halide grains are placed on a mesh for electron microscope observation and are observed by a transmission method under a cooled condition for preventing damage caused by the electron beam such as print-out of silver particle. The grains can be more clearly observed by using a high voltage type electron microscope, not less than 200 KV for a grain having a thickness of 0.25 μm, since the electron beam become to difficult to transmit a grain accompanied with increasing the thickness of the grain.

It is preferred that the number of silver halide grains each having one or more dislocation lines accounts for 50% or more of the total number of silver halide grains in the emulsion, and that the ratio of the grains each having the dislocation line is higher.

The diameter of the grain is expressed in terms of the diameter of a circle having an area the same as that of the grain. The projection are of the grains of the emulsion can be obtained from the sum of the area defined as above. The diameter and projection are of the grain can be determined by electron microscopic observation of the sample of the silver halide crystals distributed on a sampling deck so that the grains are not overlapped.

In the invention, the average projection area of the tabular silver halide grains is preferably not less than 0.30 μm, more preferably 0.30 to 5 μm, further preferably 0.40 to 2 μm, when the diameter of the grain is expressed in terms of diameter of a circle having the same area as that of the grain.

The diameter of the grain may be actually determined by measuring the projection area of the grain on a print of a projected image of the grain which is magnified with a magnitude of 10,000 to 70,000 times by an electron microscope.

The average diameter of the grains $\phi_i$ can be obtained by the following equation in which n is the number of measured grains and $n_i$ is the frequency of grains having a diameter of Di.

Average grain diameter $\phi_i = E n_i D_i / n$

The number of grains to be measured is not less than 1,000 at random.

The thickness of the grain can be obtained by observing the grain from a oblique direction by an electron microscope. The thickness of the tabular grain in the invention is preferably 0.03 to 1.0 μm, more preferably 0.05 to 0.5 μm.

It is preferred, when the silver halide grain has two or more parallel twin faces, that the ratio (b/a) of the thickness of the grain (b) to the distance of the twin faces which is largest among the distances between another twin faced included in the grain (a) is not less than 5, and that the ratio of the number of such the grains to the total number of the grains of the emulsion is not less than 50%.

The average of the value of (a) is preferably not less than 0.08 μm, more preferably 0.010 to 0.05 μm.

It is further preferred that the value of (a) is within the above-mentioned range and the variation coefficient thereof is not more than 53%, more preferably not more than 30%.

The tabulality of the grains expressed by the following equation in which the factors of aspect ratio and grain thickness are taken, is preferably not less than 20.

Tabulality $A = ECD/b^2$

In the above, ECD is the average projection diameter of the tabular grains and b is the average thickness of the grains.

In the above, the average projection diameter is the number average of the diameter of the circles each having a areas the same as those of the silver halide grains.

The silver halide grains to be used in the invention may be halide-conversion type grains. The converting ratio is preferably 0.2 to 2.0 mole-% of silver. The conversion may be performed in the course or after completion of the physical ripening of the grains. The conversion is carried out by addition of a halide solution or silver halide fine grains which contained a halide having a solubility product with silver ions smaller than that of silver halide composition of the surface of the silver halide grains to be converted. The size of the fine grains is preferably not more than 0.2 $\mu$m, more preferably 0.02 to 0.1 $\mu$m.

It is preferred in the invention that the tabular grain is grown by precipitating silver halide on a seed crystal.

At the time of preparation of the emulsion relating to the invention, a know silver halide solvent such as ammonia, thioether or thiourea may be existed in the e seed grain formation and growing process of the seed crystals.

A method described, for example, in JP O.P.I. Nos. 51-39027/1976, 55-142329/1980, 58-113928/1983, 54-48521/1979 and 58-49938/1983 may be used as a the condition for growing the seed grains prepared as above to obtain the tabular silver halide grains usable in the invention, by which a solution of water-soluble silver salt and a solution of water-soluble halide are added by a double-jet method and the adding speed of the solutions are gradually changed according to growing of the grains so that new nuclei are not formed and physical ripening is not occurred. A method of growing silver halide grains by dissolving and recrystallizing the silver halide grains may be applied as another condition for growing the seed grains, such the method is described in Resume of Annual Congress of the Society of Photographic Science and Technology of Japan in Showa 58 (1983).

For growing the grains, silver ions and halide ions each may be added respectively in a form of an aqueous solution of silver nitrate and that of halide by a double-jet method, and they may also be added in a form of fine grains of silver halide. The adding speed of the ions is preferably controlled within the range in which new nucleus is not formed and widening of size distribution of the grains caused by Ostwald ripening is not occurred, namely within the range of 30 to 100% of the speed for forming of new nucleus.

In the preparation process of the silver halide emulsion, the mixing condition is important. The mixing apparatus described in JP O.P.I. No. 62-160128/1987 preferably usable, in which a solution adding nozzle is provided under the liquid surface near the liquid sucking mouth of a mixing device. It is preferred for the mixing process that the rotating number of the stirrer is preferably set at within the range of 400 to 1200 rpm.

The silver iodide content and the average silver iodide content of a silver halide grain can be determined by a method using an electron probe micro analyzer (EPMA method). In this method, a sample is prepared in which silver halide grains distributed so that the grains does not contact with each other, and an electron beam is irradiated to the silver halide grain in the sample. X-ray emitted from the sample grain by excitement by the electron beam is analyzed. Thus elemental analysis of an extreme small area of the silver halide grain can be carried out. The halide compositions of individual grain can be determined by measuring the intensities of specific X-ray of silver and halogen emitted from the grain by the above method. The average silver iodide content of the silver halide grains can be determined by averaging the silver iodide content measured by EMPA method with respect to at laeat 1000 silver halide grains. The silver halide grain related to the invention may be contained at least one kind of metal ion in the interior portion and/or surface portion thereof by adding a metal salt such as a cadmium salt, zinc salt, lead salt, thallium salt, iridium salt or its complex salt, rhodium salt or its complex salt, or ion salt or its complex salt in the course of formation and/or growing of the grains. Further, a sensitizing nucleus can be donated in the interior and/or surface portion of the silver halide grains by putting the grain in a reducing atmosphere.

An oxidizing agent such as hydrogen peroxide, or thiosulfonic acid may be added at an optional time in the course of grain formation the silver halide grain.

Unnecessary salt may be removed from or remained in the silver halide emulsion related to the invention after growing of the silver halide grains. For removing the salt, the method described in Research Disclosure No. 17643, item II, can be applied.

In the invention, the silver halide emulsion layer may contain silver halide grains having various shapes as far as the effect of the invention is disturbed.

The latex to be used in the light-sensitive material relating to the invention is preferably one giving no or little bad effect, i.e., the latex has little interaction with the additives and the particle surface thereof is photographically inactive.

Foe example, a latex is preferably used, which is difficult to adsorb a dye and does not cause a color stain, and is difficult to adsorb a development accelerator or a development inhibitor and hardly influences to the sensitivity or fogging of the light-sensitive material.

The latex is preferably on having a low dependency on the pH value and the ion strength in a coating liquid for preparing the light-sensitive material in which the latex is dispersed, since the latex having such the property is difficult to be coagulate and precipitated in the liquid.

The monomer composition and the property of the monomer considerably influence on the properties of the latex.

The glass transition point of the latex is often used as an indicator of the property of the latex. The hardness of the latex particle is become higher with raising of the glass transition point thereof, and as a result of that, the role of the latex as a cushion material becomes hardly to attained. Contrary to that, the latex is tend to interactive with the photographic properties of the emulsion and not preferable effects are occurred when the glass transition point of the latex is too low. Accordingly, the composition and the amount of the latex can not simply decided when the effect of the latex on the photographic properties is considered.

Latexes using monomers such as styrene, butadiene and vinylidene are well known.

Further, it is known that the influence of latex on the photographic properties is inhibited by introduce a monomer having a carbonic acid group such as acrylic acid, itaconic acid or maleic acid at the time of synthesizing of the latex, and such synthesizing of the latex is frequently tried. A latex synthesized by adding a methacrylate unit to the above-mentioned system to control the glass transition point may be used in the light-sensitive material.

As the concrete examples of the above latex, JP O.P.I. Nos. 2-135335/1990, 6-308670/1994 and 6-308658/1994 can be referred.

In the invention, it is advantageous for enhancing the effects of the invention that the amount of hydrophilic colloid is not more than 3.5 g/m$^2$ per one side of the light-sensitive material. However, the surface of the light-sensitive material is tend to easily damaged in the processing when the amount of the hydrophilic colloid is less than 1.0 g pre side of the light-sensitive material. From the point of view, it is preferred that the amount is within the range of from 1.0 to 3.5 g/m$^2$ per side, and is preferred 1.0 to 3.0 g/m$^2$ per side when the developing time of the light-sensitive material is less than 20 seconds.

In the invention, a light-sensitive material having a high sensitivity, a high sharpness and a lowered dye stain can be obtained by adding a dye capable of being discolored or washed out in the processing course to at least one layer optionally selected from the silver halide emulsion layer and another layer of the light-sensitive material. The dye to be used in the light-sensitive material is properly selected from dyes which are capable of improving the sharpness by absorbing required wavelength of light and removing an not preferable effect of the wavelength of light. It is preferable that the color of the dye cannot be visually observed after finishing of the image by discoloration of washing out from the light-sensitive material during the processing.

Concrete examples of the dye usable in the invention are described in, for example, West German patent No. 616,007, British Patent Nos. 584,609 and 1,177,429, JP Nos. 26-7777/1951, 39-22069/1964 and 54-38129/1979, JP O.P.I. 48-5130/1973, 49-99620/1974, 49-114420/1974, 49-129537/1974, 50-288271975, 52-108115/1977 and 57-185038/1982, U.S. Pat. Nos. 1,878,961, 1,884,035, 1,912,797, 2,098,891, 2,150,695, 2,274,782, 2,298,731, 2,409,612, 2,461,484, 2,527,583, 2,533,472, 2,865,752, 2,956,879, 3,094,418, 3,125,448, 3,148,187, 3,177,078, 3,247,127, 3,260,601, 3,282,699, 3,409,433, 3,540,887, 3,575,704, 3,653,905, 3,718,472, 3,865,817, 4,070,352 and 4,071,312, PB Report No. 74,175 and Photographic Abstract 1, 28 (1921).

In the invention, the dye may be contained in any layer constituting the light-sensitive material. Namely, the dyes is contained in at least one of the layers constituting the light-sensitive material, i.e., a light-sensitive emulsion layer, and another hydrophilic colloid layer provided on the emulsion coated side of the light-sensitive material, for example a non-light-sensitive layer such as an interlayer, protective layer or subbing layer. It is preferred that the dye-containing layer is the emulsion layer and/or a layer arranged at a position nearer the support than the emulsion layer. It is more effective that the dye is added in the layer adjacent to the transparent support of the light-sensitive material. It is preferred that the concentration is higher at a position nearer the support.

In the invention, the adding amount of the dye may be changed according to the objective level of the sharpness. The amount of the dye is preferably 0.2 mg/m$^2$ to 20 mg/m$^2$, more preferably 0.8 mg/M$^2$ to 15 mg/M$^2$.

The above-mentioned dye can be added to the hydrophilic colloid layer by an ordinary method. Namely the dye is added to the coating liquid of the layer in a form of an aqueous solution of the dye in a proper concentration or in a form of dispersion of fine solid particles. JP O.P.I. Nos. 1-158430, 2-115830 and 4-251838 can be referred for addition of the dye.

In the invention, when the silver halide emulsion layer is colored, the dye is added to a coating liquid of the silver halide emulsion or a hydrophilic colloid layer, and the liquid is coated directly or through a hydrophilic colloid layer on the support by means of various coating method.

As above-mentioned, it is preferred that the concentration of the dye is higher at a position nearer the support. For fixing the dye so as to distribute the dye in such the situation, a combined product of the dye with a non-diffusible mordant or a fine particles of a dye represented by Formula I to VI may be used. As the non-diffusible mordant to be bonded to one of the above-mentioned dye, ones described in the following documents are preferably usable; for example, West German patent 2,263,031, British Patent Nos. 1,221,131 and 1,221,195, JP O.P.I. Nos. 50-47624/1975 and 50-71332/1975, JP 51-1418/1976, and U.S. Pat. Nos. 2,548,564, 2,576,316, 2,795,519, 2,839,401, 2,882,156, 3,048,487, 3,184,309, 3,444,138, 3,445,231, 3,706,563, 3,709,690 and 3,788,885.

As the method for combining the dye with the non-diffusible mordant, various methods known in the field of the art can be applied, particularly, a method by which the combining is carried out in a gelatin binder is preferably applied. Other than that, a method by which a combined product is formed in an appropriate binder is dispersed in an aqueous solution of gelatin by a ultrasonic wave may be applied.

The combing ratio of the dye and the mordant is usually 0.1 to 10 parts of a non-diffusible mordant per part of a water-soluble dye even though the ratio is varied according to the compound. The adding amount of the dye can be made larger than that when the dye is solely used.

As the dye further preferable for fixing the dye at the portion near the support, dyes represented by the following formulas I through VI are cited.

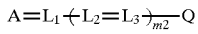

Formula (I)

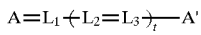

Formula (II)

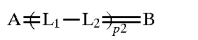

Formula (III)

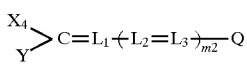

Formula (IV)

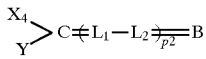

Formula (V)

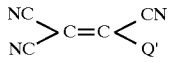

Formula (VI)

In the above formulas, A and A' are each an acidic nucleus which may be the same or different; Q is an aryl group or a heterocyclic group; B is a basic nucleus; Q' is a heterocyclic group; $X_4$ and Y are each an electron withdrawing group which may be the same or different; $L_1$, $L_2$ and $L_3$ are each a methine group; $m_2$ is 0 or 1; t and $P_2$ are each independently 0, 1 or 2, provided that the dye represented by Formula I through VI has at least one of group selected from a carboxyl group, sulfonamido group and sulfamoyl group.

The aryl group represented by Q of the above Formulas I and IV includes, for example, a phenyl group and naphthyl group. The heterocyclic group represented by Q includes, for example, residues of pyridine, quinoline, isoquinoline, pyrrole, pyrazole, imidazole and indole.

The above-mentioned aryl group and heterocyclic group each includes ones having a substituent. As the substituent, for example, an alkyl group, cycloalkyl group, aryl group, halogen atom, alkoxycarbonyl group, aryloxycarbonyl group, carboxyl group, cyano group, hydroxyl group, mercapto group, amino group, alkoxyl group, aryloxy group, acyl group, carbamoyl group, acylamino group, ureido group, sulfamoyl group and sulfonamide group are cited, two or more of these groups may be the substituents in combination. Preferred substituent includes an alkyl group having 1 to 6 carbon atoms such as methyl group, ethyl group, butyl group or 2-hydroxyethyl group, a hydroxyl group, a halogen atom such as fluorine atom or chlorine atom, an alkoxyl group such as methoxy group, ethoxy group, methylenedioxy group, 2-hydroxyethoxy group or n-butoxy group, a substituted amino group such as dimethylamino group, diethylamino group, di(n-butyl)amino group, group, N-ethyl-N-methanesulfonamidoethylamino group, morpholino group, pyperidino group or prrolidino group, a carboxyl group, a sulfonamido group, such as methanesulfonamido group or benzenesulfonamido group, and a sulfamoyl group such as sulfamoyl group, methylsulfamoyl group or phenylsulfamoyl group. These groups may be the substituents in combination.

The acidic nucleus represented by A or A' in Formulas I, II and III is preferably a nucleus of 5-pyrazolone, barbituric acid, thiobarbituric acid, rhodanine, hydantoin, thiohydantoin, oxazolone, isooxazolone, indandione, pyrazolidinedione, oxzolinedione, hydroxypyridone or pyrazolopyridone.

As the basic nucleus represented by D in Formulas III and V, nuclei of pyridine, quinoline, oxazole, benzoxazole, naphthoxazole, thiazole, benzothiazole, naphthothiazole, indolenine, pyrrole and indole are cited.

As the electron withdrawing group represented $X_4$ and Y in Formula IV and V, for example, a cyano group, alkoxycarbonyl group, aryloxycarbonyl group, carbamoyl group, carboxyl group, acyl group, slkylsulfonyl group and sulfamoyl group are cited. The groups represented by $X_4$ and Y may be the same or different in a molecule.

The heterocyclic group represented by Q' in Formula VI includes residues of pyridine, pyridazine, quinoline, pyrrole, pyrazole, imidazole and indole. The methine group represented by $L_1$, $L_2$ and $L_3$ in Formula I through V, includes ones each having a substituent. As the substituent, an alkyl group having 1 to 6 carbon atoms such as methyl group, ethyl group, propyl group or iso-butyl group, an aryl group such as phenyl group, p-tolyl group or p-chlorophenyl group, an alkoxyl group having 1 to 4 carbon atoms such as methoxy group or ethoxy group, an aryloxy group such as phenoxy group, an aralkyl group such as benzyl group or phenetyl group, a heterocyclic group such as pyridyl group, furyl group or thienyl group, a substituted amino group such as dimethyl amino group, tetramethyleneamino group, or anilino group, and an alkylthio group such as methylthio group are cited.

Examples of the dye represented by Formula I through VI are shown below.

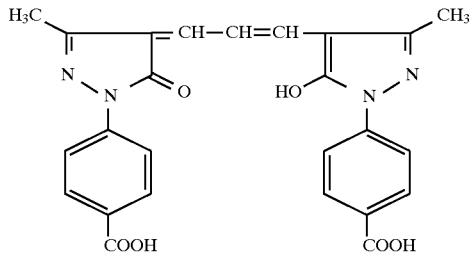

AD-1

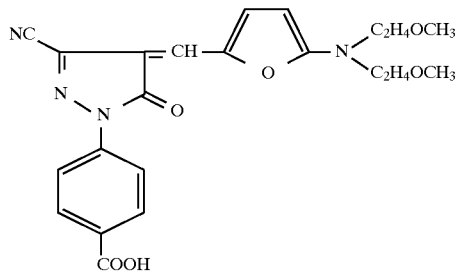

AD-2

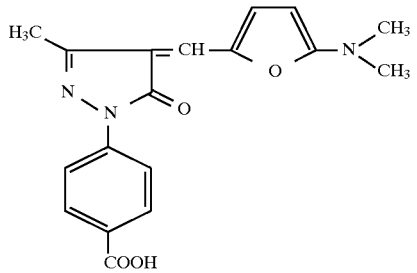

AD-3

-continued
AD-4
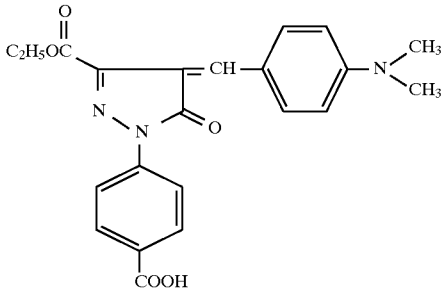
AD-5
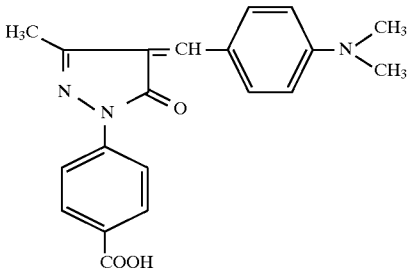
AD-6
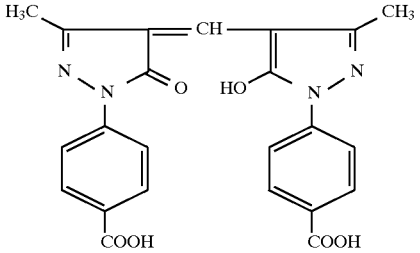
AD-7
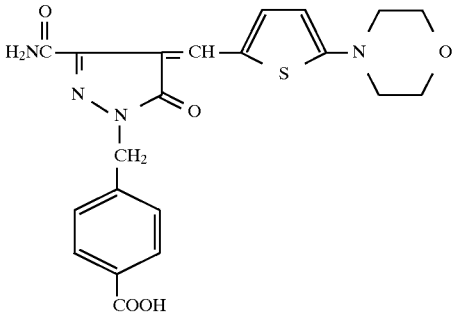
AD-8
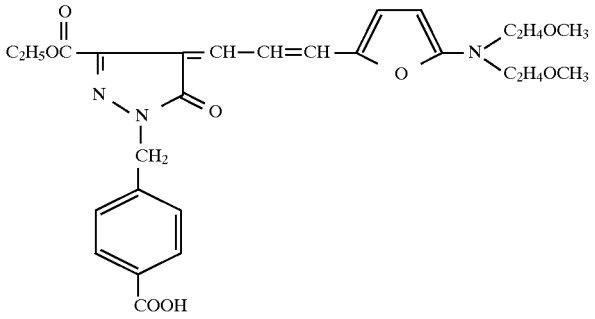
AD-9
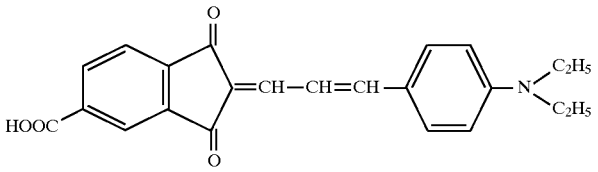

-continued

AD-10

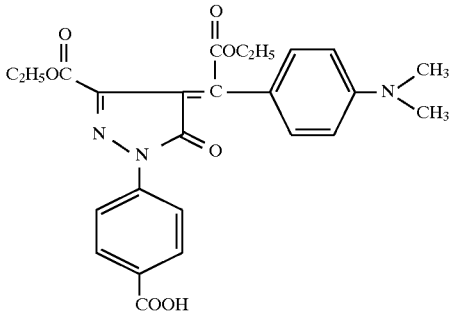

AD-11

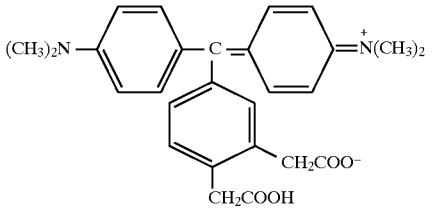

AD-12

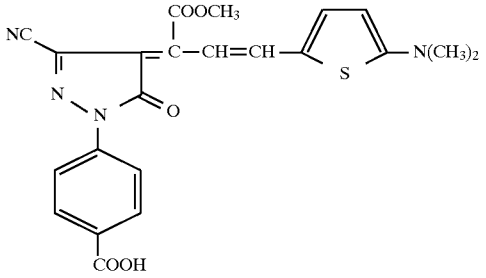

AD-13

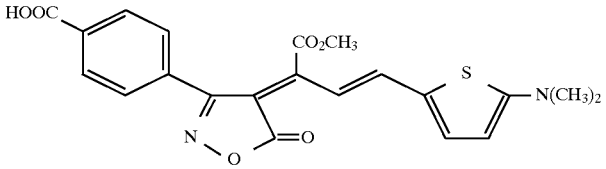

AD-14

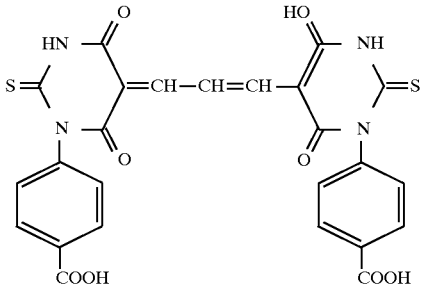

The above-described dye has a dissociable electron having a pK value within the range of 4 to 11, preferably 4.5 to 7.0, in a solvent composed of water and ethanol in a volume ratio of 1:1.

In the invention, the dye can be fixed by using a silver salt or silver complex formed by reaction of the dye with a silver ion. Preferred dyes for forming such the silver salt include ones represented by Formula [I] through [V], Formula [I'] through [V'] and Formula [VI] described in JP O.P.I. No. 5-181230. As examples of concrete dye compounds, I-1 to 37, II-1 to 5, III-1 to 7, IV-1 to 6, V-1 to 5, I'-1 to 12, II'-1 to 9, III'-1 to 9, IV'-1 to 9, V'-1 to 6 and VI-1 to 52 described in the above JP-document are cited.

For dispersing the dyes represented by Formula I to VI, known dispersing method such as an acid precipitation method, a method using a ball mill, jet mill or impeller, may be applied, even though any method may be applied without any limitation. The average size of the solid fine particles of the dispersed dye is preferably 0.01 to 20 $\mu$m, more preferably 0.03 to 2 $\mu$m, even though the size of the partcles may be optionally set. The variation coefficient of particle size is preferably nor more than 60%, more preferably not more than 40%.

A layer in which the dye and the mordant are contained may be newly provided as a layer constituting the light-sensitive material when the combined product thereof is contained in the light-sensitive material. The new layer is preferably provided as a layer adjacent to the transparent support even though the new layer may be arranged at an optional position.

The layer containing the combined product of the dye and the non-diffusible mordant or the fine particles of the dye represented by Formula I through VI is preferably interposed between the silver halide emulsion and the support. It is preferred that a first subbing layer is provided on the support and a second hydrophilic colloid subbing layer which contains fine dye particles is provided on the first subbing layer. Although there is no limitation on the amount of the combined product of the dye and the non-diffusible mordant or fine particles of the dye represented by Formula I to IV, it is preferred that the amount is decided so that the effective transmission density is a value being within the range of from 0.3 to 2.

The coating amount of the layer containing the combined product of the dye and the non-diffusible mordant or fine particles of the dye represented by Formula I to VI is usually nor less than 0.05 g/m$^2$ to less than 0.5 g/m$^2$, preferably not less than 0.18 g/m$^{=}$ to less than 0.42 g/m$^2$. It is preferred that the ratio of the average particle size of the fine particle of the dye to the thickness of the dye-containing layer is within the range of 0.2 to 10.

Various kinds of photographic additives can be added to the silver halide photographic light-sensitive material relating to the invention. As known additives, those described in Research Disclosure No. 17643, December 1978, No. 18716, November 1979, and No. 308119, December 1989 are cited. The kinds of compounds and the position of the description in the above Research Disclosures are listed in the following Table 1.

TABLE 1

| | RD-17643 | | RD-18716 | DR-308119 | |
|---|---|---|---|---|---|
| Additive | Page | Class | Page | Page | Class |
| Chemical sensitizer | 23 | III | 648 R.U. | 996 | III |
| Sensitizing dye | 23 | IV | 648–649 | 996–968 | III |
| Desensitizing dye | 23 | IV | | 998 | B |
| Dye | 25–26 | VIII | 649–650 | 1003 | VIII |
| Deveopment accelerator | 29 | XXI | 648 R.U. | | |
| Fog inhibitor or stabilizer | 24 | IV | 649 R.U. | 1006–1007 | V |
| Whitening agen | 24 | V | | 998 | V |
| Surfactant | 26 | XI | 650 R. | 1005–1006 | XI |
| Anti-static agent | 27 | XII | 650 R. | 1006–1007 | XIII |
| Plasticizer | 27 | XII | 650 R. | 1006 | XII |
| Lubriant | 27 | XII | | | |
| Matting agent | 28 | XVI | 650 R. | 1008–1009 | XVI |
| Binder | 26 | XXII | | 1009–1014 | XXII |
| Support | 28 | XVII | | 1009 | XVII |

R: Right
U: Upper

In the invention, the silver halide emulsion layer or another layer may contain a developing agent such as aminophenol, ascorbic acid, pyrocatechol, hydroquinone, phenylenediamine or 3-pyrazolidone.

Examples of the support usable in the light-sensitive material of the invention are described in Research Disclosure Nos. 17643, page 28, and 308119, page 1009.

A plastic film is appropriately usable. The surface of the support may be subjected to a treatment by coating of subbing layer, corona discharge or UV irradiation.

Next, the processing preferably applicable to the light-sensitive material of the invention is described below.

A preferable developer for processing the light-sensitive material contains a dihydroxybenzene described in JP O.P.I. Nos. 4-15641/1992 and 4-16841/1992 such as hydroquinone, a paraminophenol such as p-aminophenol, N-methyl-p-aminophenol, N-methyl-p-aminophenol or 2,4-diaminophenol or a 3-pyrazolidone such as 1-phenyl-3-pyrazolidone, 1-phenyl-4-methyl-4-hydroxymethyl-3 pyrazolidone or 5,5-dimethyl-1-phenyl-3-pyrazolidone, and these compounds are preferably used in combination.

The preferable amounts of the paraminophenol compound and 3-aminopyrazolidone are each not less than 0.004 moles per liter, more preferably 0.04 to 0.12 moles per liter.

It is preferred that the total amount of a dihydroxybenzene, a p-aminophenol and 3-pyrazolidone is preferably not more than 0.1 moles per liter.

Another type of developer preferably applicable to the light-sensitive material of the invention is one which contains a developing agent represented by Formula 6 and no dihydroxybenzene.

Formula 6

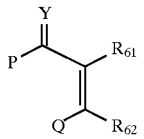

In the above formula, $R_{61}$ and $R_{62}$ are each a hydroxyl group, an -OM group, an amino group, an acylamino group, an aklylsulfonylamino group, an aryksulfonylamino group, an alkoxycarbonylamino group, a mercapto group or an alkylthio group,; M is an alkali metal atom or an ammonia group. Preferable example of the group represented by $R_{61}$ or $R_{62}$ includes a hydroxyl group, amino group, sulfonylamino group and arylsulfonylamino group. P and Q are each a hydroxyl group, a carboxyl group, an alkoxyl group, a hydroxyalkyl group, a carboxyalkyl group, a sulfo group, a sulfoalkyl group, an amino group, an aminoalkyl group, a mercapto group, an alkyl group, an aryl group, or a group of atoms forming a 5-to 8-member ring together with the carbon atom of vinyl bond to which $R_{10}$ and $R_{11}$ are bonded and the carbon atom to which Y is bonded. Y is ═O or ═N—$R_{63}$, in which $R_{63}$ is a hydrogen atom, a hydroxyl group, an alkyl group, an acyl group, a hydroxyalkyl group, a sulfoalkyl group or a carboxyalkyl group. Examples of the 5- to 8-member ring include a dihydrofuranone ring, dihydropyrone ring, pyranone ring, cyclopentenone ring, cyclohexenone ring, pyrrolinone ring, pyrazolinone ring, pyridone ring, azacylohexenone ring and urasil ring. Among them, a dihydrofranone ring, cyclopentenone ring, cyclohexenone ring, pyrazolinone ring, azacylohexenone ring and uracil ring is more preferable.

The above developing agent represented by Formula 6 is preferably used in an amount of 0.005 to 0.5 moles, more preferably 0.02 to 0.4 moles. per liter of developing solution.

Examples of the developing agent represented by Formula 6 are shown below.

6-1

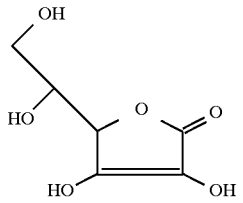

-continued
6-2
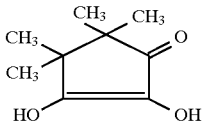
6-3
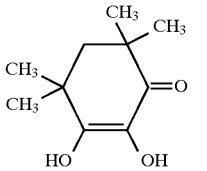
6-4
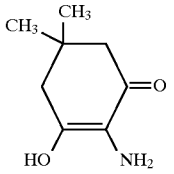
6-5
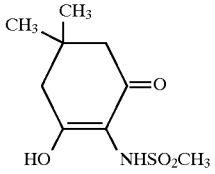
6-6
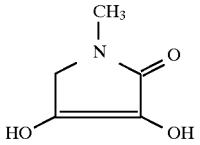
6-7
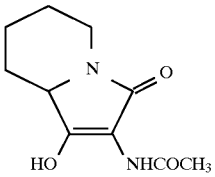
6-8
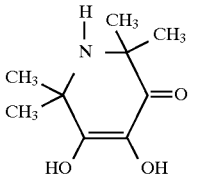
6-9
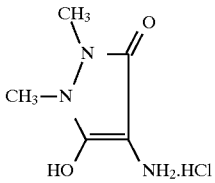
6-10
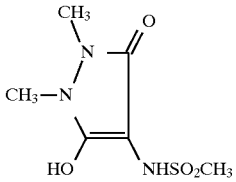
-continued
6-11
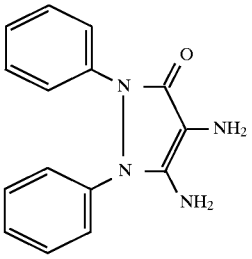
6-12
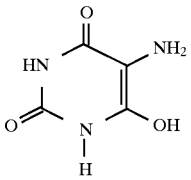
6-13
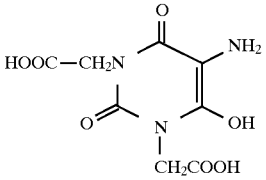
6-14
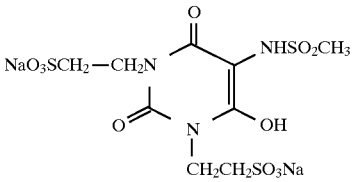
6-15
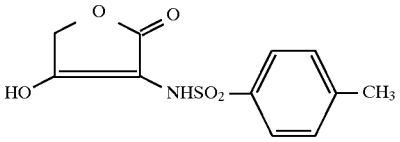
6-16
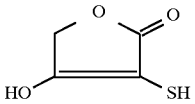
6-17
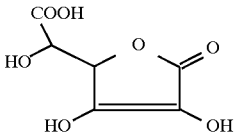
6-18
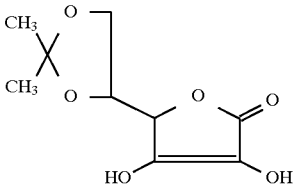

-continued 6-19

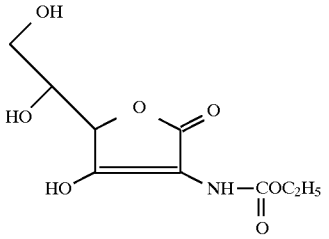

6-20

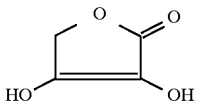

6-21

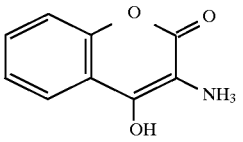

6-22

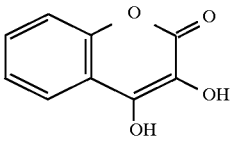

The above-mentioned compounds are available on the market as ascorbic acid, erythorbic acid or derivatives of them, and are able to be synthesized by a known method.

In the developing solution, a sulfite such as potassium sulfite or sodium sulfite, a reductone such as piperidinohexose reductone, may be contained as a preservant. The preservant is preferably used in an amount of 0.2 to 1 mole, more preferably 0.3 to 0.6 moles per liter.

Also in the case of the developing solution containing a developing agent other than that represented by formula 4, an addition of a large amount of ascorbic acid is effective to stabilization of the processing ability.

The alkaline agent in the developing solution includes sodium hydroxide, sodium carbonate, trisodium phosphate, tripotassium phosphate. Further a buffering agent such as a borate described in JP O.P.I. No. 61-28708/1986, saccharose described in JP O.P.I. No. 60-93439/1985, acetoxime, 5-sulfosalicylic acid, a phosphate and carbonate may be used. The sum of the amounts of these agents is preferably set so that the pH value of the solution is within the range of 9.0 to 13, more preferably 10 to 12.5.

In the developing solution, a dissolving aid such as a polyethylene glycol. a sensitizer such as a quartenary ammonium salt, a developing accelerator and a surfactant may be contained. Silver stain inhibiting agents described in JP O.P.I. No. 56-106244/1981, sulfides and disulfides described in JP O.P.I. No. 3-51844/1991, and cystein derivatives and triazine compounds described in JP O.P.I. No. 4-92947/1992 are preferably used as the silver sludge preventing agent.

Azole type organic antifoggants such as a derivatives of indazole, imidazole, benzimidazole, triazole, benzotriazole, tetrazole and thiadiazole are used as the organic inhibitor in the processing solution.

The inorganic inhibitor in the processing solution includes sodium bromide, potassium bromide and potassium iodide. Other than the above, ones described in L. F. A. Menson, "Photographic Prpcessing Chemistry" Forcal Press, 1966, p.p. 226–229, U.S. Pat. Nos. 2,193,015 and 2,592,364 and JP O.P.I. No. 48-64933/1973 may also be used. As the chelating agent for hiding calcium ions contained in city water, organic chelating agents having a chelating stability constant with iron ions of not less than 8 is preferably used.

The inorganic chelating agent includes sodium hexametaphosphate, calcium hexametaphosphate and polyphosphates.

Dialdehyde compounds may be used as the hardener to be contained in the developer, and gultaraldehyde is preferably used.

The light-sensitive material is preferably developed at a temperature of 25° to 50° C., more preferably 30° to 40° C. The developing time is preferably 5 to 90 seconds, more preferably 8 to 60 seconds. The processing time for dry to dry is preferably 10 to 210 seconds, more preferably 10 to 90 seconds. The effect of the invention is enhanced when the processing time for dry to dry is within the range of 10 to 30 seconds.

A replenishing solution is replenished to the developing solution for recovering the developing ability loosed by the processing fatigue and oxidation fatigue. The replenishing may be performed by a method controlled according to the width and the transporting speed of the light sensitive material described in JP O.P.I. No. 55-126243/1980, a method controlled according to the processed area of the processed light-sensitive material described in 60-104946/1985, or a method based on the processed area of the light-sensitive material controlled by the number of the light-sensitive material continuously processed which is described in JP O.P.I. No. 1-149156. The effect of the invention is enhanced when the replenishing amount is not more than 194 ml per square meter of the processed light-sensitive matrial.

The fixing solution to be preferably used for fixing the light-sensitive material of the invention may contain a fixing agent usually used in the field of the art. The pH value of the fixing solution is usually not less than 3.8, preferably 4.2 to 5.5.

As the fixing agent, thiosulfate such as ammonium thiosulfate and sodium thiosulfate is preferably used and ammonium thiosulfate is particularly preferred form the view point of the fixing rate.

The concentration of ammonium thiosulfate is preferably 0.1 to 5 moles, more preferably 0.8 to 3 moles, per liter.

The fixing solution may be an acidic hardening fixing solution. In this case, aluminum ions are preferably used as a hardening agent. The aluminum ions is preferably added to the solution in a form of aluminum sulfate, aluminum chloride or potassium alum.

The fixing solution may contains according to necessity a preservant such as a sulfite, bisulfate, a pH buffering agent such as acetic acid or boric acid, a pH controlling agent selected from various kinds of inorganic or organic acid such as sulfuric acid, nitric acid, citric acid, oxalic acid and malic acid, and a metal hydroxide such as potassium hydroxide or sodium hydroxide and a chelating agent having a water softening ability. As the fixing accelerator, for example, thiourea derivatives described in JP Nos. 45-35754/1970, 58-122535/1983 and 58-122536/1983 and thioethers described in U.S. Pat. No. 4,126,459 are usable.

In the invention, the swelling rate of the silver halide emulsion layer in the course of the processes is preferably 50 to 250%, and the layer thickness after swelling is preferably not more than 70 $\mu$m. Insufficient drying and troubles in transportation of the light-sensitive material in an automatic processor are tend to be occurred when the swelling rate exceeds 250%, particularly in a rapid processing. Contrary to that, unevenness of the development and color remaining are increased when the swelling rate is less than 50%. The swelling rate is defined as 100 times of the ratio of the difference of the thickness of the layer after swelled in individual processing solution and the thickness before processing to the thickness before processing.

EXAMPLES

Example 1

<Preparation of Emulsion-1>

A tabular silver iodobromide emulsion, Emulsion 1, was prepared.

| | |
|---|---|
| **Solution A1** | |
| Ossein gelatin | 24.2 g |
| Water | 9657 ml |
| $HO—(CH_2CH_2O)_n—[CH(CH_3)CH_2O]_{17}—(CH_2CH_2O)_mH$ (n + m = 5 to 7) 10% methanol-water solution | 1.20 ml |
| Potassium bromide | 10.8 ml |
| 10% nitric acid | 160 ml |
| **Solution B1** | |
| 2.5 silver nitrate aqueous solution | 2825 ml |
| **Solution C1** | |
| Potassium bromide | 841 g |
| Water to make | 2825 ml |
| **Solution D1** | |
| Ossein gelatin | 121 g |
| Water | 2040 ml |
| $HO—(CH_2CH_2O)_n—[CH(CH_3)CH_2O]_{17}—(CH_2CH_2O)_mH$ (n + m = 5 to 7) 10% methanol-water solution | 5.70 ml |
| **Solution E1** | |
| 1.75N Potassium bromide aqueous solution: an amount necessary to keep the following silver electrode potential. | |

Each of 475.0 ml of Solution B1 and Solution C1 were addd to Solution A at 35° C. for 2.0 minutes by double-jet method using an mixing device described in JP Nos. 58-58288/1983 and 58-58289 to form nuclei.

After stopping the addition of Solutions B1 and C1, the temperature of Solution A1 was raised to 60° C. spending 60 minutes. Then the pH value of the solution was adjusted to 5.5 and Solution B1 and C1 were added each with a flow rate of 55.1 ml per minute for 42 minutes by double-jet method. The silver electrode potential in the period of temperature rising 35° to 60° C. and the period of addition of Solutions B1 and C1 are each controlled so as to be maintained at +8 mV and +30 mV by using Solution D1. The silver electrode potential was measured by a silver ion selective electrode using a saturated silver-calomel electrode as the comparison electrode.

Just after the addition of the solutions, pH of the emulsion was adjusted to 6.0 by 3%-KOH solution, and the emulsion was desalted and washed immediately. It was confirmed by an electron microscope that thus obtained seed emulsion was comprised of hexagonal tabular grains and the sum of the projection area of the tabualar grains accounts for 90% of the total projection area of the silver halide grains contained in the seed emulsion. The tabular grains have a maximum adjacent side ratio of 1.0 to 2.0, an average thickness of 0.09 μm and an average diameter in terms of circle diameter is 0.510 μm.

The above-mentioned emulsion was heated to 53° C. and the following amounts of Sensitizing dyes A and B were added to the emulsion each in a form of dispersion of solid fine particles. Then the emulsion was ripened for 2 hours 30 minutes in total after addition of 4-hydroxy-6-methyl-1,3,3a,7-tetraazaindene (TAI), adenine, ammonium thiocyanate, a solution of a mixture of chloroauric acid and sodium thiosulfate, silver iodide fine particles, and a dispersion of triphenylphosphine selenide in the following amounts, respectively. At the time of the completion of the ripening, a proper amount of 4-hydroxy-6-methyl-1,3,3a,7-tetraazaindene was further added to the emulsion.

The sensitizing dyes and the other additives and the adding amounts of them in terms of per mole of silver halide are described below.

| | |
|---|---|
| Sensitizing dye A: anhydrous sodium salt of 5-dichloro-9-ethyl-3,3-di-(sulfopropyl)-oxacarbocyanine | 450 mg |
| Sensitizing dye B: anhydrous sodium salt of 5,5-di-(butoxycarbonyl)-1,1'-diethyl-3,3'-di-(4-sulfobutyl)benzoimidazolocarbocyanine | 8 mg |
| 4-hydroxy-6-methyl-1,3,3a,7-tetraazaindene | 60 mg |
| Adenine | 15 mg |
| Sodium thiosulfate | 5.0 mg |
| Ammonium thiocyanate | 50 mg |
| Chloroauric acid | 2.5 mg |
| Silver iodide fine grain emulsion (average diameter: 0.05 μm | 5 mmoles in terms of silver |
| Triphenylphosphine selenide | 6.0 mg |
| Stabilizing agent (TAI) | 750 mg |

The dispersion of the spectral sensitizing dye was prepared according to description in JP O.P.I. No. 5-297496/1993.

Namely, a prescribed amount of the dye is put into water previously adjusted at 27° C., and is stirred by a high speed stirrer or dissolver for a time of 30 to 120 minutes with a rotating speed of the stirrer of 3,500 rpm. The dispersion of selenium sensitizer was prepared as follows. To 30 kg of ethyl acetate, 120 kg of triphenyl-phosphine selenide was added at 35° C., and was stirred to completely dissolve. On the other hand, 3.8 kg of photographic gelatin was dissolved in 38 kg of pure water, and 39 g of a 25 weight % solution of dodecylbenzenesulfonic acid was added to the solution. The above two solutions were mixed and dispersed at 50° C. for 30 seconds by a high speed stirring dispersing machine having a dissolver of a diameter of 10 cm with a peripheral speed of stirrer of 3500 rpm. Thereafter, ethyl acetate was removed rapidly under a reduced pressure while stirring until the remaining concentration of ethyl acetate become to 0.3% by weight or less. The dispersion was made up to 80 kg by addition of water. A part of thus obtained dispersion was divided to use for experiments.

<Preparation of Emulsion 2>

A tabular silver grain iodobromide emulsion, Emulsion 2 was prepared using the following four solutions and a seed emulsion. The seed emulsion was prepared in the same manner as in the above-mentioned Emulsion 1 except that the optical sensitization and the chemical sensitization were not applied.

| | |
|---|---|
| **Solution A2** | |
| Ossein gelatin | 19.04 g |
| $HO—(CH_2CH_2O)_n—[CH(CH_3)CH_2O]_{17}—(CH_2CH_2O)_mH$ (n + m = 5 to 7) 10% methanol-water solution | 2.00 ml |
| Potassium iodide | 7.00 g |
| Seed emulsion | 1.55 moles in terms of silver |
| Water to make | 2800 ml |
| **Solution B2** | |
| Potassium bromide | 1493 g |
| Water to make | 3585 ml |
| **Solution C2** | |
| Silver nitrate | 2131 g |
| Water to make | 3585 ml |
| **Solution D2** | |
| Fine grain emulsion composed of 3% by weight of gelatin and silver iodide grains having an average diameter of 0.05 μm | 0.028 moles in terms of silver |

The fine grain silver iodide emulsion was prepared as follows: to 6.64 liter of an aqueous gelatin solution containing 5.0 weight % of gelatin and 0.05 moles of potassium iodide, 2 liters of an aqueous solution containing 7.06 moles of silver nitrate and 2 liters of an aqueous solution containing 7.06 moles of potassium iodide are added by a double-jet method spending 10 minutes. In the course of formation the fine grains, the pH value and temperature were each controlled at 2.0° and 40° C., respectively. The pH value of the emulsion was adjusted to 6.0 using sodium carbonate after formation of the grains.

To Solution A2 kept at 55° C. in a reaction vessel, the half amount of each of Solutions B2 and C2 were added by a double-jet method while vigorously stirring and maintaining the pH value at 5.8. After adjusting the pH value to 8.8 using 1% solution of KOH, a part of each of Solution B2 and C2 and all of Solution D2 were simultaneously added to the above emulsion. Then the pH value of the emulsion is adjusted 6.0 using a 0.5% citric acid solution and the remained part of each of Solution B2 and C2 were added to the emulsion by a double-jet method spending 25 minutes while maintaining the pH value at 8.9. The adding rates of Solutions B2 and C2 were functionally changed with respect to passing the time corresponding to the critical growing rate of the grains. Namely, the rate of the addition was appropriately controlled so that no small grain were formed other than the seed grains and the size distribution of the grains was not changed to a polydispersed state by proceeding of Ostwald ripening.

After addition of the solutions, the emulsion was desalted, washed and redispersed in the similar manner as in Emulsion 1. After the redispersion pH and pAg of the emulsion were each adjusted to 5.80 and 8.2, respectively, at 40° C.

It was found by electron microscopic observation that the grains of the emulsion were tabular silver halide grains having an average diameter of 0.91 μm, an average thickness of 0.23 μm, an approximate average aspect ratio of 4.0 and a width of size distribution of 20.5%. The emulsion was heated to 47° C. and following amounts of silver iodide fine grain emulsion and Sensitizing dyes A and B each in a form dispersion of solid fine particles, were added to the emulsion. Then the emulsion was ripened for 2 hours 30 minutes in total after addition of adenine, ammonium thiocyanate, a solution of a mixture of chloroauric acid and sodium thiosulfate and a dispersion of triphenylphosphine selenide in the following amounts, respectively. At the time of the completion of the ripening, a proper amount of 4-hydroxy-6-methyl-1,3,3a,7-tetraazaindene (TAI) was further added to the emulsion as a stabilizer.

The sensitizing dyes and the other additives and the adding amounts of them in terms of per mole of silver halide are described below.

| | |
|---|---|
| Sensitizing dye A | 390 mg |
| Sensitizing dye B | 8 mg |
| 4-hydroxy-6-methyl-1,3,3a,7-tetraazaindene | 60 mg |
| Adenine | 10 mg |
| Sodium thiosulfate | 3.3 mg |
| Ammonium thiocyanate | 50 mg |
| Chloroauric acid | 2.0 mg |
| Silver iodide fine grain emulsion (average diameter: 0.05 μm) | 5 mmoles in terms of silver |
| Triphenylphosphirie selenide | 4.0 mg |
| Stabilizing agent (TAI) | 750 mg |

In the above, the silver iodide fine grain emulsion is the same as that used in Solution D2.

The dispersions of Sensitizing dye A and B and that of the selenium sensitizer were prepared in the same manner as in those used in Emulsion 1.

A mixed emulsion containing the above sensitized Emulsion 1 and Emulsion 2 in a ratio of 60%:40% was prepared, and the following additives are added to the mixed emulsion to prepare an emulsion coating liquid. On the other hand a coating liquid of protective layer was prepared.

On the both side of a support which was composed of a blue-tinted polyethylene terephthalate film for X-ray film having an optical density of 0.15 and a thickness of 175 μm and the following crossover light shielding layer coated on the both side of the film, the above-mentioned emulsion coating liquid and protective layer coating liquid were simultaneously coated in this order from the support surface so that the coating amounts of the materials of each layer were as follows and dried to prepare a sample. Samples 1-(1) to 1-(9) were prepared in the above-mentioned manner except that the kind of the compound represented by Formula 1 of the invention was changed as shown in Table 2.

| First layer (Crossover light shielding layer) | |
|---|---|
| Solid dispersion of dye (AD-2) | 180 mg/m$^2$ |
| Gelatin | 0.2 g/m$^2$ |
| Sodium dodecylbenzenesulfonate | 5 mg/m$^2$ |
| A compound represented by Formula 1 or a comparative compound | See Table 1 |
| Compound (I) | 5 mg/m$^2$ |
| Latex (L) | 0.2 mg/m$^2$ |
| Sodium salt of 2,4-dichloro-6-hydroxy-1,3,5-triazine | 5 mg/m$^2$ |
| Colloidal silica (average size: 0.014 mm) | 10 mg/m$^2$ |
| Hardener (A) | 2 mg/m$^2$ |
| Second layer (Emulsion layer) | |

The following addenda were added to the above-mentioned emulsion.

| | |
|---|---|
| A compound represented by Formula 1 or a comparative compound | See Table 1 |
| Compound (G) | 0.5 mg/m$^2$ |
| 2,6-bis(hydroxyamino)-4-diethylamino-1,3,5-triazine | 5 mg/m$^2$ |
| t-butylcatechol | 130 mg/m$^2$ |
| Polyvinylpyrrolidone (mW: 10.000) | 35 mg/m$^2$ |
| Styrene/maleic anhydride copolymer | 80 mg/m$^2$ |
| Sodium polystyrenesulfonate | 80 mg/m$^2$ |
| Trimethylolpropane | 350 mg/m$^2$ |
| Diethylene glycol | 50 mg/m$^2$ |
| Nitrophenyl-triphenyl-phosphonium chloride | 20 mg/m$^2$ |
| Sodium 1,3-dihydroxybenzene-4-sulfonate | 500 mg/m$^2$ |
| Sodium 2-mercaptobenzimidazole-5-sulfonate | 5 mg/m$^2$ |
| Compound (H) | 0.5 mg/m$^2$ |
| n-$C_4H_9OCH_2CH(OH)CH_2N(CH_2COOH)_2$ | 350 mg/m$^2$ |
| Colloidal silica | 0.5 g/m$^2$ |
| Latex (L) | 0.2 g/m$^2$ |
| Dextran (average molecular weight: 1000) | 0.2 g/m$^2$ |
| Compound (P) | 0.2 g/m$^2$ |
| Compound (Q) | 0.2 g/m$^2$ |

The amount of gelatin was adjusted so as to be 0.8 g/m$^2$.

| Third layer (Protective layer) | |
|---|---|
| Gelatin | 0.6 g/m$^2$ |
| Matting agent of polymethyl methacrylate (area average size: 7.0 $\mu$m) | 50 mg/m$^2$ |
| Formaldehyde | 20 mg/m$^2$ |
| Sodium salt of 2,4-dichloro-6-hydroxy-1,3,5-triazine | 10 mg/m$^2$ |
| Bis-vinylsulfonylmethyl ether | 36 mg/m$^2$ |
| Latex (L) | 0.2 g/m$^2$ |
| Polyacrylamide (average molecular weight: 10.000) | 0.1 g/m$^2$ |
| Sodium polyacrylate | 30 mg/m$^2$ |
| Polysiloxane (SI) | 20 mg/m$^2$ |
| Compounds (I) | 12 mg/m$^2$ |
| Compounds (J) | 2 mg/m$^2$ |
| Compounds (S-1) | 7 mg/m$^2$ |
| Compounds (K) | 15 mg/m$^2$ |
| Compounds (O) | 50 mg/m$^2$ |
| Compounds (S-2) | 5 mg/m$^2$ |
| $C_9H_{19}-O-(CH_2CH_2O)_{11}-H$ | 3 mg/m$^2$ |
| $C_8F_{17}SO_2N(C_3H_7)(CH_2CH_2O)_{15}-H$ | 2 mg/m$^2$ |
| A compound represented by Formula 1 or a comparative compound | See Table 1 |
| $C_8F_{17}SO_2N(C_3H_7)(CH_2CH_2O)_4-(CH_2)_4SO_3Na$ | 1 mg/m$^2$ |
| Hardener (B) | 2 mg/m$^2$ |

Compound (I)

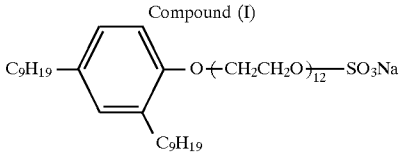

-continued

Third layer (Protective layer)

Latex (L)

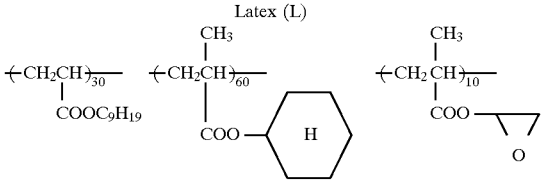

Hardener (A)

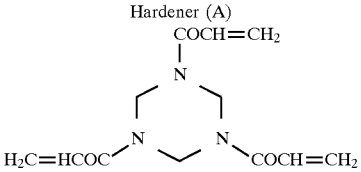

Compound (G)

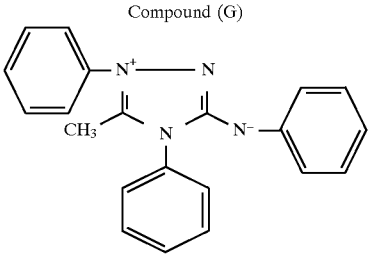

Compound (H)

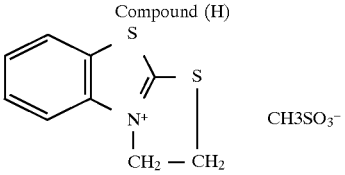

Compound (P)

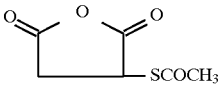

Compound (Q)

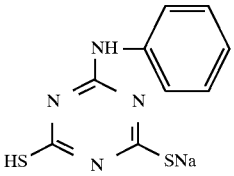

Polysiloxane (S1)

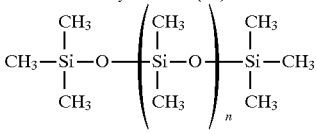

n = approx. 1000

Compound (J)

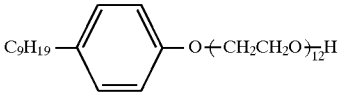

Compound (S-1)

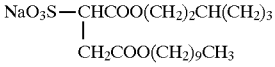

-continued

Third layer (Protective layer)

Compound (K)

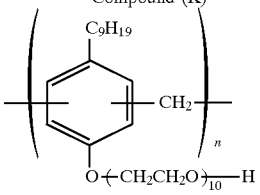

(Mixture of compounds n being 2 to 5)

Compound (O)

$C_{11}H_{23}CONH(CH_2CH_2O)_5H$

Compound (S-2)

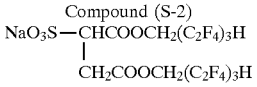

Hardener (B)

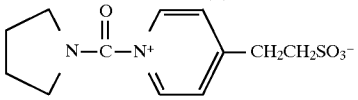

Comparative compound (1)

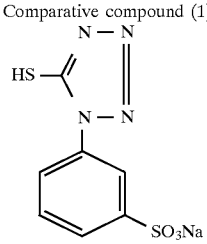

Comparative compound (2)

$C_{12}H_{25}SO_2SNa$

The above-mentioned amount of each of the material was the amount to be coated on one side of the support. The coated amount of silver was adjusted to 1.3 g/m$^2$.

The kind and the amount of the compound represented by Formula 1 or the comparative compound is shown in the following Table 1.

TABLE 1

| Sample No. | Crossover light shielding layer | Silver halide emulsion layer | Protective layer | Note |
|---|---|---|---|---|
| 1-(1) | — | — | — | Comparative |
| 1-(2) | — | Comparative compound 1 ($3.0 \times 10^{-3}$) | — | Comparative |
| 1-(3) | — | Comparative compound 2 ($3.0 \times 10^{-3}$) | — | Comparative |
| 1-(4) | — | Compound 1-16 ($3.0 \times 10^{-3}$) | — | Inventive |
| 1-(5) | — | Compound 1-5 ($3.0 \times 10^{-3}$) | — | Inventive |
| 1-(6) | Compound 1-5 ($3.0 \times 10^{-3}$) | — | — | Inventive |
| 1-(7) | | — | Compound 1-5 ($3.0 \times 10^{-3}$) | Inventive |
| 1-(8) | Compound 1-5 ($1.0 \times 10^{-3}$) | Compound 1-5 ($2.0 \times 10^{-3}$) | — | Inventive |
| 1-(9) | Compound 1-5 ($1.0 \times 10^{-3}$) | Compound 1-5 ($1.0 \times 10^{-3}$) | Compound 1-5 ($1.0 \times 10^{-3}$) | Inventive |

The value included in ( ) is the amount of the additive in terms of moles per mole of silver.

| <Preparation of intensifying fluorescent sheet> | |
|---|---|
| Fluorescent substance $Gd_2O_2$:Tb (average size 1.8 μm) | 200 g |
| Binder: polyurethane thermoplastic elastmer (Modelax TPKL-5-2625, solid content 40%, manufactured by Sumitomo-Bayer Urethane Co., Ltd.) | 20 g |
| Nitrocellulose (nitration degree: 11.5%) | 2 g |

Methyl ethyl ketone was added to the above composition, and the composition was dispersed by a propeller mixer to prepare a coating liquid for forming a fluorescent layer having a viscosity of 25 ps at 25° C.

On the other hand, a coating liquid for forming a under coating layer having a viscosity 3 to 6 ps at 25° C. was prepared by dispersing 90 g of a soft acryl resin in terms of the solid content and 50 g of nitrocellulose in methyl ethyl ketone.

A sheet of polyethylene terephthalate with thickness of 250 μm containing titanium oxide was placed horizontally on a glass plate. On the sheet or support, the foregoing liquid for under coating layer was uniformly coated by a doctor blade coater and dried by gradually raising the temperature from 25° C. to 100° C. to form a under coating layer. The thickness of thus formed under coating layer was 15 μm.

On the under coating layer, the above-mentioned coating liquid for forming a fluorescent layer was uniformly coated with a thickness of 240 μm and dried. The dried layer was subjected to compressing. The compressing process was carried out by means of a calender roll at 80° C. with a pressure of 800 kgw/cm$^2$. After compressing, a transparent protective layer of 3 μm was formed on the fluorescent layer according to the method description in Example 1 of JP O.P.I. No. 6-75097/1994.

Thus obtained intensifying sheet has a X-ray absorbing ratio of 55%, a filling factor of 70% and a thickness of fluorescent layer of 154 μm.

<Evaluation by Rapid Processing>

The foregoing samples were each put between two sheets of the above-obtained intensifying screen and exposed to X-ray through a Penetrometer B, manufactured by Konica Medical Co., Ltd. Then the samples were processed by Automatic Processor SRX-503, manufactured by Konica Corp., using SR-DF Processing Solutions at a development temperature of 35° C. for 45 seconds. The replenishing amount of the developing solution and fixing solution were also 210 ml/m$^2$, respectively.

The sensitivity was measured by the reciprocal of the exposure amount of X-ray necessary to form a density of 1.0 on the minimum density of the sample. The values in the following table are described by a relative value based on the sensitivity of Sample 1-(1) which is set as 100.

The fog is described in the percentage of the different of that fog value of Sample, $F_s$, to be evaluated and that of Sample 1-(1), to the fog value of Sample 1-(1), $F_{1-(-)}$, as follows:

$$100\times(F_1\text{-}(\mathbf{1})-F_s)/F_{1\text{-}(1)}.$$

Accordingly, signs of − and + each means decreasing and increasing in the fogging.

On the other hand, the samples were enclosed in a moistureproof bag after standing for 4 hours at 23° C. and 48% RH. The bag enclosing the samples was incubated for 4 days at 55° C. for simulation of storage. After incubation, the samples were exposed, processed and evaluated in the same manner as in the samples not incubated.

Thus obtained results are shown in Table 2.

TABLE 2

| Exp. No. | Sample No | Before Incubation Sensitivity | Before Incubation Fog (%) | After incubation Sensitivity | After incubation Fog (%) | Note* |
|---|---|---|---|---|---|---|
| A-1 | 1-(1) | 100 | 0 | 71 | +300 | Copm. |
| A-2 | 1-(2) | 52 | −10 | 42 | +120 | Copm. |
| A-3 | 1-(3) | 56 | −12 | 43 | +150 | Copm. |
| A-4 | 1-(4) | 91 | −32 | 84 | −20 | Inv. |
| A-5 | 1-(5) | 92 | −38 | 83 | −25 | Inv. |
| A-6 | 1-(6) | 95 | −28 | 85 | −13 | Inv. |
| A-7 | 1-(7) | 94 | −25 | 84 | −15 | Inv. |
| A-8 | 1-(8) | 93 | −25 | 84 | −12 | Inv. |
| A-9 | 1-(9) | 94 | −20 | 85 | −13 | Inv. |

*Comp.: Comparative,
Inv.: Inventive

The data in Table 2 shows that the samples each containing a compound of Formula 1 according to the invention are lowered in the fog and in the variation in the sensitivity.

<Evaluation by Extreme Rapid Processing>

The samples were exposed to X-ray in the same manner as in the foregoing evaluation with a rapid processing, and the samples were processed by a SRX-503 Processor which was modified so as to be capable for processing the samples under the following processing time, i.e., an extreme rapid processing condition, at 35° C. using SR-DF Processing Solutions. The replenishing amount of the developer and the fixer were each 125 ml per $m^2$ of the processed light-sensitive material.

The sensitivity and fog of the processed samples are each relative values the same as in the foregoing experiments except that the values were calculated based on the sensitivity and fog of Samples 1-(1) obtained in Experiment B-1. Results of the experiments are listed in Table 3.

Developing: 4 seconds
Fixing: 3.1 seconds
Washing: 2 seconds
Squeezing: 1.6 seconds
Drying 4.3 seconds
Total: 15 seconds

TABLE 3

| Exp. No. | Sample No. | Sensitivity | Fog (%) | Note |
|---|---|---|---|---|
| B-1 | 1-(1) | 100 | 0 | Comp. |
| B-2 | 1-(2) | 63 | −15 | Comp. |
| B-3 | 1-(3) | 65 | −17 | Comp. |
| B-4 | 1-(4) | 95 | −37 | Inv. |
| B-5 | 1-(5) | 94 | −39 | Inv. |
| B-6 | 1-(6) | 97 | −31 | Inv. |
| B-7 | 1-(7) | 96 | −27 | Inv. |
| B-8 | 1-(8) | 95 | −28 | Inv. |
| B-9 | 1-(9) | 96 | −25 | Inv. |

As is shown in Table 3, the results similar to those obtained in the foregoing experiments by rapid processing were obtained.

<Evaluation With Processing Replenished by Tableted Replenisher>

Developer replenisher tablets were prepared by the following procedures.

Procedure A

In a bantam mill, 12500 g of erthorbic acid as the developing agent was powdered so that the average sized thereof was become to 10 μm. To the powder thus obtained, 2000 g of sodium sulfite, 2700 g of Dimeson S or 1-phenyl-4-hydroxymethyl-4-methyl-3-pyrazolidone, 1250 g of DTPA, 12.5 g of 5-methylbenzotriazole, 4 g of 1-phenyl-5-mercaptotetrazole, and N-acetyl-D,L-penicilamine were added and mixed in the mill for 30 minutes. Then the mixture was granulated after addition of 30 ml of water, in a stirring granulation machine, for 10 minutes at a room temperature. The granules were almost completely dried by a flowing layer drying machine for 2 hours at 40° C. To thus obtained granules, 1670 g of polyethylene glycol #6000 and 1670 g of mannit were added and the was uniformly mixed for 10 minutes by a mixing machine in a room conditioned at 25° C. and 40% RH or less. Then the mixture was tableted by a tableting machine Tough Press Correct 1527HU, manufactured by Kikusui Seisakusyo Co., Ltd., in a rate of 8.77 g per tablet. Thus 2500 tablets of Developer Replenisher Tablet A were prepared.

Procedure B

In a manner similar to that in Procedure A, 4000 g of potassium carbonate, 2100 g of mannit, and 2100 g of polyethylene glycol #6000 were powdered and granulated. The amount of water for granulation was 30.0 ml and the granules were dried for 30 minutes at 50° C. to remove moisture almost completely. The mixture was tableted by the above-mentioned tableting machine in a rate of 3.28 g per tablet. Thus 2500 tablets of Developer Replenisher Tablet B were prepared.

Fixer replenishing tablets were prepared by the following Procedures C and D.

Procedure C

In a manner similar to that in Procedure A, 14000 g of a mixture of ammonium thiosulfate and sodium thiosulfate in a ratio of 70:30 in weight, 1500 g of sodium sulfite were powdered and then uniformly mixed by a mixing machine available on the market. After that, the mixture was granulated in a manner similar to that in Procedure A except that the water amount for granulation was 500 ml. The granules thus obtained were dried for 30 seconds at 60° C. to remove moisture almost completely. To the dried granules, 4 g of N-lauroylalanine sodium salt was added and mixed by a mixer for 3 minutes in a room conditioned at 25° C. and 40% RH. The mixture was tableted by the above-mentioned tableting machine in a rate of 6.202 g per tablet. Thus 2500 tablets of Fixer Replenisher Tablet C were prepared.

Procedure D

In a manner similar to that in Procedure A, 1000 g of boric acid, 1500 g of aluminum sulfate 18 hydrate, 3000 g of sodium hydrogen acetate obtained by drying an equimole mixture of glacial acetic acid and sodium acetate, and 200 g of tartaric acid were powdered and then uniformly mixed by a mixing machine available on the market. After that, the mixture was granulated in a manner similar to that in Procedure A except that the water amount for granulation was 100 ml. The granules thus obtained were dried for 30 seconds at 50° C. to remove moisture almost completely. To the granules, 4 g of N-lauroylalanine sodium salt was added and mixed by a mixer for 3 minutes. The mixture was tableted by the above-mentioned tableting machine in a rate of 4.562 g per tablet. Thus 1250 tablets of Fixer Replenisher Tablet D were prepared.

At the start of running of continuous processing, the developing tank of the processor was filled by an initial developing solution which was prepared by dissolving each 140 tablets of Developer Replenisher Tablet A and B, respectively, in water so as to make the volume to 16.5 1 and adding 330 ml of the following developer starter. The pH of the developer after addition of the starter was 10.45.

| Developer starter | |
|---|---|
| Glacial acetic acid | 2.98 g |
| KBr | 4.0 g |
| Water to make | 1 l |

Continuos processing was run using a automatic processor SRX-502 modified so as to be capable of carrying out the processing for 25 seconds. On the processor, devices for supplying tableted processing compositions. In the course of the running of the processing, 200 sheets of the sample of light-sensitive material with the size of 35.6 cm×36.5 cm were continuously processed. The sample was uniformly exposed to light so as to form an image density of 1.0 after processing. After the running of the processing. a piece of the sample which was exposed to X-ray in the same manner as the foregoing experiments was processed. In the course of the running of the processing, 2 tablets of each of Developer Replenisher Tablet A and B, respectively, and 76 ml of water were added to the developer per 0.62 $m^2$ of the light-sensitive material. The pH value of the solution prepared by dissolving one of each of Tablet A and B in 38 ml of water was 10.70. To the fixing solution, two of Tablet C, one of Tablet D and 74 ml of water were added per 0.62 $m^2$ or the light-sensitive material. Water was added for 10 minutes with an equal rate proportional with the dissolving speed of the tablet.

Processing Condition

| | | |
|---|---|---|
| Development | 35° C. | 8.2 seconds |
| Fixing | 33° C. | 5 seconds |
| Washing | Ordinary temperature | 4.5 seconds |
| Squeezing | | 1.6 seconds |
| Drying | 40° C. | 5.7 seconds |
| Total | | 25 seconds |

The sensitivity and fog of the processed sampled were evaluated in the same manner as in the foregoing experiment except that the sensitivity and fog of sample 1-(1) of Experiment C-1 was used as the base of the relative values. Thus obtained results are listed in Table 4.

TABLE 4

| Exp. No. | Sample No. | Sensitivity | Fog (%) | Note |
|---|---|---|---|---|
| C-1 | 1-(1) | 100 | 0 | Comp. |
| C-2 | 1-(2) | 49 | −5 | Comp. |
| C-3 | 1-(3) | 52 | −8 | Comp. |
| C-4 | 1-(4) | 89 | −42 | Inv. |
| C-5 | 1-(5) | 88 | −44 | Inv. |
| C-6 | 1-(6) | 92 | −35 | Inv. |
| C-7 | 1-(7) | 91 | −33 | Inv. |
| C-8 | 1-(8) | 89 | −34 | Inv. |
| C-9 | 1-(9) | 91 | −31 | Inv. |

As is shown in Table 4, the results similar to that obtained in the foregoing Experiments by rapid processing were obtained.

Example 2

<Preparation of Silver Chloride Emulsion>

Preparation Silver Chloride Rich Tabular Seed Emulsion EM-3

| Solution A | |
|---|---|
| Ossein gelatin | 37.5 g |
| Potassium iodide | 0.625 g |
| Sodium chloride | 16.5 g |
| Distilled water to make | 7500 ml |
| **Solution B** | |
| Silver nitrate | 1500 g |
| Distilled water to make | 2500 ml |
| **Solution C** | |
| Potassium iodide | 4 g |
| Sodium chloride | 140 g |
| Distilled water to make | 684 ml |
| **Solution D** | |
| Sodium chloride | 375 g |
| Distilled water to make | 1816 ml |

To Solution A stirred in a mixing apparatus described in JP Nos. 58-58288/1983 and 58-58289/1983, 648 ml of Solution A and all of Solution B were added for 1 minute at 40° C. The emulsion was subjected to Ostwald ripening for 20 minutes after adjusting the EAg at 149 mV. Then remained Solution A and all of Solution D were added spending 40 minutes. In the course of the addition, the $E_{Ag}$ was controlled at 149 mV.

The emulsion was desalted and washed immediately after the addition so as to obtain Seed Emulsion Emulsion 3. It was confirmed by electron microscopic observation that, in thus obtained Seed Emulsion 3, the projection area of tabular silver halide grains each having the (100) major face accounts 60% or more of the total projection area of the silver halide grains, and the average thickness, average diameter and variation coefficient of the size distribution of the grains were each 0.07 μm, 0.5 μm and 25%, respectively.

<Preparation of Silver Chloride Rich Emulsion Emulsion 4>

A tabular silver chloride rich emulsion was prepared using the following four kinds of solutions.

| Solution A | |
|---|---|
| Ossein gelatin | 29.4 g |
| $HO—(CH_2CH_2O)_n-[CH(CH_3)CH_2O]_{17}—(CH_2CH_2O)_mH$ (n + m = 5 to 7) 10% methanol-water solution | 1.25 ml |
| Seed Emulsion Em-3 | 0.98 moles in terms of silver |
| Distilled water to make | 3000 ml |
| 3.50 N-silver nitrate solution | 2240 ml |
| **Solution C** | |
| Sodium chloride | 455 g |
| Distilled water to make | 2240 ml |
| **Solution D** | |
| 1.75 N-sodium chloride solution | The amount for necessary to maintain the following silver electrode potential |

Solution B and Solution C were all added to Solution A stirred in a mixing apparatus similar to that used for preparing the foregoing Emulsion 3 by at 40° C. by a double-jet method spending 110 minutes for growing the grains. The adding rate of the solutions a controlled so that the flowing rate at the finishing of the addition is become three times of the rate at the initial time of the addition.

In the course of addition, the silver electrode potential was maintained at +120 mV using Solution D.

After the addition, the emulsion was desalted by the following flocculation method to remove the excessive salt.

1. The temperature of the above emulsion was adjusted to 40° C. after the addition, and a high-molecular flocculation agent G-3 described in JP O.P.I. No. 2-7037/1990 was added to the emulsion in an amount of 20 g per mole of silver halide. After that, 56 wt-% of citric was added so that the pH value of the emulsion was lowered by 4.30. The emulsion was subjected to decantation after standing.

2. Pure water adjusted at 40° C. was added to the emulsion in an amount of 1.8 1 per mole of silver halide. The emulsion was stirred for 10 minutes and decanted after standing.

3. The operation of the above 2 was repeated once more.

4. To the emulsion, was added gelatin in an amount of 15 g per mole of silver halide, and the pH value of the emulsion was adjusted to 6.0 by addition of sodium carbonate to the emulsion. After redispersion, the emulsion was made to a volume of 450 ml per mole of silver halide.

It was confirmed by electron microscopic observation of approximately 3000 grains of silver halide of thus obtained Emulsion 4 that the sum of the projection area of tabular silver halide grains each having the (100) major face accounts for 80% or more of the total projection area of the silver halide grains, and the average thickness, average diameter and variation coefficient of the size distribution of the tabular grains were each 1.17 μm, 0.12 μm and 24%, respectively.

The emulsion was heated to 55° C. and divided to 5 parts. To each of the parts of the emulsion, the following amounts of silver iodide fine grains, spectral sensitizing dyes (1) and (2), a compound represented by Formula 1 of the invention or a comparative compound described in Table 6 were added to the emulsion. The following sulfur sensitizer (Sa) and selenium sensitizer and a gold sensitizer (Sb) were further added to the emulsion. The selenium sensitizer or selenothiourea was added in the same manner as in Example 1. Then the emulsion was ripened for 90 minutes in total. After ripening, 4-hydroxy- 6-methyl-1,3,3a,7-tetraazaindene (TAI) was added as a stabilizer.

The amounts of the compounds added to the emulsion in per mole of silver halide

| | |
|---|---|
| Silver iodide fine grains | 5 mmoles |
| Spectral sensitizing dye (1) | 300 mg |
| Spectral sensitizing dye (2) | 30 mg |
| Sulfur sensitizer (Sa) | 2.0 mg |
| Gold sensitizer (Sb) | 1.0 mg |
| Diinethylselenourea | 3.0 mg |
| Stabilizer (TAI) | 50 mg |

To each of the ripened emulsions, additives the same as in the emulsion of Example 1 were added to prepare an emulsion coating liquid, respectively. The emulsion coating liquid was coated with a crossover-light shielding layer and a protective layer each were the same as those in Example 1. Thus Samples 2-(1) to 2-(5) shown in Table 5 were prepared.

Spectral sensitizing dye (1)

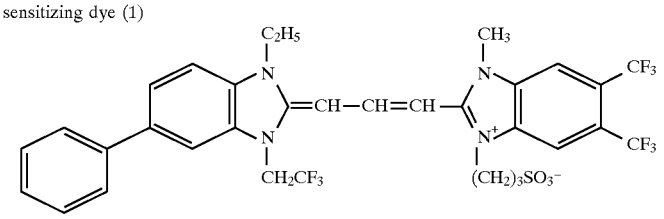

Spectral sensitizing dye (2)

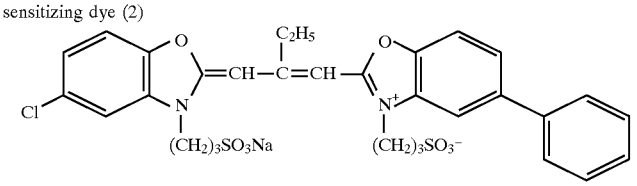

Sulfur sensitizer (Sa)

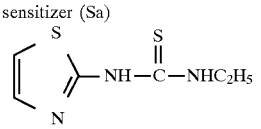

Gold sensitizer (Sb)

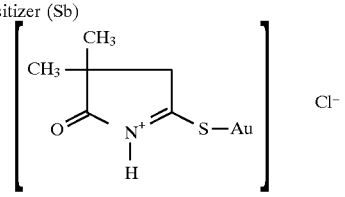

TABLE 5

| Sample No. | Crossover-light shielding layer | Silver halide emulsion layer | Protective layer | Note |
|---|---|---|---|---|
| 2-(1) | — | — | — | Comparative |
| 2-(2) | — | Comparative compound 1 ($5.0 \times 10^{-3}$) | — | Comparative |
| 2-(3) | — | Comparative compound 2 ($5.0 \times 10^{-3}$) | — | Comparative |
| 2-(4) | — | Compound 1-4 ($5.0 \times 10^{-3}$) | — | Inventive |
| 2-(5) | — | Compound 1-12 ($5.0 \times 10^{-3}$) | — | Inventive |

In the above table, the value included in ( ) is the amount of the additive in terms of moles per mole of silver.

The samples were exposed, processed and evaluated in the same manner as in the evaluation with extreme rapid processing in Example 1. Results of the evaluation are listed in Table 6.

TABLE 6

| Exp. No. | Sample No. | Sensitivity | Fog (%) | Note |
|---|---|---|---|---|
| D-1 | 2-(1) | 100 | 0 | Comp. |
| D-2 | 2-(2) | 52 | −20 | Comp. |
| D-3 | 2-(3) | 55 | −26 | Comp. |
| D-4 | 2-(4) | 93 | −40 | Inv. |
| D-5 | 2-(5) | 95 | −38 | Inv. |

The samples were further evaluated in the same manner as in evaluation with processing replenished by tableted replenisher in Example 1. results of the evaluation are listed in Table 7.

TABLE 7

| Exp. No. | Sample No. | Sensitivity | Fog (%) | Note |
|---|---|---|---|---|
| E-1 | 2-(1) | 100 | 0 | Comp. |
| E-2 | 2-(2) | 47 | −12 | Comp. |
| E-3 | 2-(3) | 50 | −16 | Comp. |
| E-4 | 2-(4) | 90 | −45 | Inv. |
| E-5 | 2-(5) | 93 | −40 | Inv. |

It is understood from Tables 5 to 7 that the Samples 2-(4) and 2-(5) according to the invention are considerably inhibited with a slight loss in the sensitivity when the samples are processed with replenishing by tableted replenishing composition.

Example 3

Emulsion 5 and Emulsion 6 were prepared in the same manner as in Emulsions 1 and 2 of Example 1, respectively, except that the amount and kind of sensitizing dye, and the mount of 4-hydroxy-6-methyl-1,3,3a,7-tetraazaindene (TAI) and adenine each added before ripening of Emulsion 1 and Emulsion 2 were respectively changed to as follows:

| (in Emulsion 5) | |
|---|---|
| Sensitizing dye shown in Table 8 | $6.5 \times 10^{-4}$ moles |
| TAI | 20 mg |
| Adenine | 5 mg |

-continued

| (in Emulsion 6) | |
|---|---|
| Sensitizing dye shown in Table 8 | $4.5 \times 10^{-4}$ moles |
| TAI | 12 mg |
| Adenine | 3 mg |

Thus obtained Emulsions 5 and 6 were mixed in the ratio of 60% and 40% and the additive the same as used in the mixture of Emulsions 1 and 2 in Example 1 and Compound M and 5 mg/m$^2$ of Compound N were added to the above mixture of Emulsions 5 and 6 to prepare an emulsion coating liquid. In the emulsion coating liquid a compound relating to the invention was added as shown in Table 8.

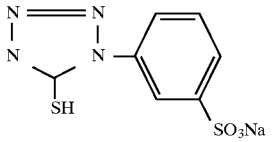

Compound M

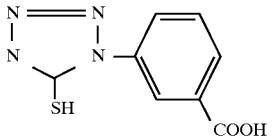

Compound N

Samples 3-(1) to 3-(8) and 3-(10) to 3-(16) were prepared using the above emulsion coating liquid in a manner similar to that in the samples Example 1. On the other hand, Emulsion 4' and 5' were prepared in the same manner as in Emulsions 4 an 5, respectively, except that the selenium sensitizer was omitted. Sample 3-(9) was prepared by using Emulsion 5' and 6', other conditions were the same as in the other samples. The crossover light shielding layer coating liquid and the protective layer coating liquid used in Samples 3-(1) to 3-(16) were the same as those used in Example 1. The compound relating to the invention is not contained in the crossover light shielding layer and protective layer.

TABLE 8

| Sample No. | Compound No. Amount | Sensitizing dye | Selenium sensitizer | Note |
|---|---|---|---|---|
| 3-(1) | 1* | 5-15 | Used | Comp. |
| 3-(2) | 1-5 | 5-15 | Used | Inv. |
| 3-(3) | 4-2 | 5-15 | Used | Comp. |
| 3-(4) | 1-5/4-2 | 5-15 | Used | Inv. |
| 3-(5) | 1-10/4-2 | 5-15 | Used | Inv. |
| 3-(6) | 1-25/4-2 | 5-15 | Used | Inv. |
| 3-(7) | 1-26/4-2 | 5-15 | Used | Inv. |
| 3-(8) | 1-21/4-15 | 5-15 | Used | Inv. |
| 3-(9) | 1-5/4-2 | 5-15 | None | Inv. |
| 3-(10) | 1-5/4-2 | Sen. dye (2) | Used | Inv. |
| 3-(11) | 2-1 | 5-15 | Used | Comp. |
| 3-(12) | 1-5/2-1 | 5-15 | Used | Inv. |
| 3-(13) | 3-7 | 5-15 | Used | Comp. |
| 3-(14) | 1-5/3-7 | 5-15 | Used | Inv. |
| 3-(15) | 1-5/4-2 | 5-61 | Used | Inv. |
| 3-(16) | 1-5/4-2 | 5-62 | Used | Inv. |

Preparation of Processing Composition

Developer replenisher tables and fixer replenisher tablets were prepared according to the following procedure A' to D'.

The developer replenisher tables were prepared by Procedure A' and B'.

Procedure A'

In a bantam mill, 13000 g of erthorbic acid, exemplified compound 6-1, as the developing agent was powdered to that the average sized thereof become to 10 am. To the powder thus obtained, 4877 g of sodium sulfite, 975 g of Phenidone and 1635 g of DTPA were added and mixed in the mill for 30 minutes. Then the mixture was granulated in a stirring granulation machine, after addition of 30 ml of water, for 10 minutes at a room temperature. The granules were almost completely dried by drying for 2 hours at 40° C. by a flowing layer drying machine. To thus obtained granules, 2167 g of polyethylene glycol #6000 was added and the was uniformly mixed for 10 minutes by a mixing machine in a room conditioned at 25° C. and 40% RH or less. Then the mixture was tableted by a tableting machine Tough Press Correct 1527HU, manufactured by Kikusui Seisakusyo Co., Ltd., in a rate of 8.715 g per tablet. Thus tablets of Developer Replenisher Tablet A' were prepared.

Procedure B'

In a manner similar to that in Procedure A', 19500 g of potassium carbonate, 8.15 g of 1-phenyl-5-mercaptotetrazole, 3.25 g of sodium hydrogen carbonate, 650 g of glutaraldehydesulfite adduct and 1354 g of polyethylene glycol 6000 were powdered and granulated. The amount of water for granulation was 30.0 ml and the granules were dried for 30 minutes at 50° C. to remove moisture almost completely. The mixture was tableted by the above-mentioned tableting machine in a rate of 9.90 g per tablet. Thus tablets of Developer Replenisher Tablet B' were prepared.

Fixer replenishing tablets were prepared by the following procedures C' and D'.

Procedure C'

In a manner similar to that in Procedure A', 18560 g of ammonium thiosulfate containg 10 wt % of sodium thio sulfate, 1392 g of sodium sulfite, 580 g of sodium hydroxide, 2.32 g of disodium ethylenediaminetetra-acetate and 700 g of Painflow, manufactured by Matsutani-kagaku Co. as a binder were powdered and granulated. The amount of water for granulation was 150 ml. The granules thus obtained were dried for 30 seconds at 60° C. to remove moisture almost completely. Then 2500 g of sodium acetate and 100 g of sodium 1-octanesulfonate, as a lubricant were mixed with the granules. The mixture was tableted by the above-mentioned tableting machine in a rate of 10.0 g per tablet. Thus Fixer Replenisher Tablet C' were prepared.

Procedure D'

In a manner similar to that in Procedure A', 500 g of boric acid, 1450 g of aluminum sulfate octahydrate, 1500 g of succinic acid, 300 g of tartaric acid, and 250 g of mannitol and 100 g of D-sorbit as binder were powdered and granulated with 100 ml of water. The granules thus obtained were dried for 30 minutes at 50° C. to remove moisture almost completely and mixed with 800 g of sodium acetate and 50 g of sodium 1-octanesulfonate as a lubricant. The mixture were tableted by the above-mentioned tableting machine in a rate of 10.0 g per tablet. Thus Fixer Replenisher Tablet D' were prepared.

An initial developing solution having the following composition and a pH value of 10.7 was prepared by dissolving the above Developer Replenishing tablet A' and Developer Replenishing tablet B' in water and finishing to 165 1, and 330 ml of the following starter added to the above solution so that the pH value of the solution was adjusted to 10.45.

Composition of initial developing solution

| | |
|---|---|
| Potassium carbonate | 120.0 g/l |
| Sodium erthorbate (Exemplified compound 4-1) | 40.0 g/l |
| DTPA | 5.0 g/l |
| 1-phenyl-5-mercaptotetrazole | 0.05 g/l |
| Sodium hydrogen carbonate | 20.0 g/l |
| Phenidone | 3.0 g/l |
| Sodium sulfite | 15.0 g/l |
| Polyethylene glycol | 15.0 g/l |
| Glutaraldehyde sulfite adduct | 4.0 g/l |
| Composition of developer starter | |
| Glacial acetic acid | 2.10 g/l |
| Potassium bromide | 5.30 g/l |
| Water to make | 1 liter |

An initial fixing solution having the following composition was prepared by dissolving tablets of Fixer Replenisher Tablet C' and tablets of Fixer Replenisher Tablet D' in water and adjusting the pH of the solution to 4.5.

Composition of initial fixing solution

| | |
|---|---|
| Ammonium thiosulfate (containing 10 wt % of ammonium thiosulfate) | 185.6 g/l |
| Sodium sulfite | 13.9 g/l |
| Boric acid | 5.0 g/l |
| Sodium hydroxide | 5.8 g/l |
| Succinic acid | 15.0 g/l |
| Tartaric acid | 3.0 g/l |
| Aluminum sulfate 18 hydrate | 14.5 g/l |
| Disodium ethylenediaminetetraacetate | 0.02 g/l |
| Painflow (manufactured by Matsutani-kagaku Co.) | 7.0 g/l |
| Mannitol | 2.5 g/l |
| D-sorbit | 1.0 g/l |
| Sodium acetate | 33.0 g/l |
| Sodium 1-octanesulfonate | 1.5 g/l |

The processing was run by using an automatic processor SRX-503 manufactured by Konica Corp. which was modified so that the processing time was shorten to 25 seconds in total for dry to dry and devices for supplying the solid processing compositions were attached on the processor.

Processing condition

| | | |
|---|---|---|
| Development | 35° C. | 5.0 seconds |
| Fixing | 35° C. | 3.0 seconds |
| Washing | ordinary temperature | 2.5 seconds |
| Squeezing | | 1.5 seconds |
| Drying | | 2.0 seconds |
| Total | | 15 seconds |

One of Tablet A' and two of Tablet B' and 20 ml of water were replenished to the developing solution per square meter of the light-sensitive material processed. To the fixing solution, four of Tablet C', two Tablet D' and 50 ml of water were replenished per square meter of the light-sensitive material processed. Addition of water was started at the same time at which the tables were supplied to the solution to be replenished. Water was supplied for 10 minutes with an equal rate which was approximately proportional with the dissolving rate of the tablets.

<Evaluation>

Each of the samples was put between the two sheets of Intensifying Screen KO-250 manufactured by Konica Corp. and exposed to X-ray through Penetrometer B, manufactured by Konica Medical Co. Ltd. The exposed samples were each processed under the above-mentioned processing conditions. The sensitivity, fog, resistivity against safe light exposure, and color remaining were evaluated with respect to each of the samples processed after running by 200 sheets of the light-sensitive material according to the foregoing running condition.

The sensitivity was given by a relative value of the reciprocal of the exposure amount of X-ray necessary to form a density of $D_{min}$+1.0, based on the sensitivity of Sample No, 3-(1) which was set as 100.

The resistivity against safelight exposure was determined by exposing the sample to an incandescent lamp through a red filter having a spectral transparency as shown in FIG. 1 for 30 minutes. The distance between the lamp and the sample was 1.2 m. The sample was processed and increasing in the fog in the area exposed to red light was measured as an indicator for evaluating the resistivity against safe light exposure of the sample.

The color remaining was evaluated by an optical density of the processed sample at 510 nm measured by a spectrophotometer. The values of the reaming color of the samples shown in Table 10 were relative values based on the value of sample No. 3-(1) which was set as 100.

Results of the evaluation are listed in Table 9.

TABLE 9

| Sample No. | Sensitivity | Fog | Resistivity against safelight | Color remaining | Note |
|---|---|---|---|---|---|
| 3-(1) | 100 | 0.31 | 1.17 | 100 | Comp. |
| 3-(2) | 110 | 0.10 | 0.50 | 100 | Inv. |
| 3-(3) | 113 | 0.15 | 0.76 | 100 | Comp. |
| 3-(4) | 130 | 0.06 | 0.08 | 100 | Inv. |
| 3-(5) | 122 | 0.07 | 0.09 | 100 | Inv. |
| 3-(6) | 145 | 0.05 | 0.07 | 100 | Inv. |
| 3-(7) | 137 | 0.05 | 0.08 | 100 | Inv. |
| 3-(8) | 151 | 0.04 | 0.09 | 100 | Inv. |
| 3-(9) | 69 | 0.06 | 0.10 | 100 | Inv. |
| 3-(10) | 95 | 0.05 | 0.08 | 161 | Inv. |
| 3-(11) | 115 | 0.15 | 0.35 | 100 | Inv. |
| 3-(12) | 115 | 0.05 | 0.09 | 100 | Inv. |
| 3-(13) | 110 | 0.13 | 0.07 | 100 | Inv. |
| 3-(14) | 115 | 0.06 | 0.08 | 100 | Inv. |
| 3-(15) | 125 | 0.05 | 0.10 | 100 | Inv. |
| 3-(16) | 130 | 0.08 | 0.09 | 100 | Inv. |

As is understood from Table 9, the samples containing the compound of the invention are excellent in the resistivity against safelight exposure, lowered fog and sensitivity.

Similar results were obtained when a silver chloride emulsion waas used.

Example 4

Silver halide grains the same as those in Emulsion 5 of Example 3 were prepared. The emulsion was heated at 53° C. and silver iodide fine grains and fine solid dispersion of the spectral sensitizing dye shown in Table 10 were added to the emulsion in a manner similar to that in Emulsion 4 in Example 3. Then the emulsion was ripened for 2 hours and 30 minutes after addition of the sulfur sensitizer, selenium sensitizer and gold sensitizer. At the completion time of the ripening, an appropriate amount of TAI as a stabilizer, the compound represented by Formula 1 and or the compound represented by Formula 2 of the invention were added as shown in Table 10 each in an amount of $1\times10^{-5}$ moles per mole of silver halide. Thus Emulsion 7 was prepared.

Silver halide grains the same as those in Emulsion 6 of Example 3 were prepared. The emulsion was heated at 47° C. and silver iodide fine grains and fine solid dispersion of the spectral sensitizing dye shown in Table 10 were added to the emulsion in a manner similar to that in Emulsion 4 in Example 3. Then the emulsion was ripened for 2 hours and 30 minutes after addition of the sulfur sensitizer, selenium sensitizer and gold sensitizer. At the completion of the ripening, an appropriate amount of TAI as a stabilizer, the compound represented by Formula 1 and or the compound represented by Formula 2 of the invention were added as shown in Table 10 each in an amount of $1\times10^{-5}$ moles per mole of silver halide. Thus Emulsion 8 was prepared.

The above ripened Emulsions 7 and 8 were mixed in a ratio of 60% and 40% and Samples 4-(1) to (10) were prepared using the mixed emulsion in a manner similar to that in the samples In Example 3. The samples were evaluated in the same manner as in Example 3. Thus obtained results are listed in the following Table 11.

TABLE 10

| Sample No. | Compound No. | Sensitizing dye | Selenium sensitizer | Note |
|---|---|---|---|---|
| 4-(1) | 1* | 5-15 | Used | Comp. |
| 4-(2) | 1-5 | 5-15 | Used | Inv. |
| 4-(3) | 2-2 | 5-15 | Used | Comp. |
| 4-(4) | 1-5/2-2 | 5-15 | Used | Inv. |
| 4-(5) | 1-10/2-2 | 5-15 | Used | Inv. |
| 4-(6) | 1-25/2-2 | 5-15 | Used | Inv. |
| 4-(7) | 1-26/2-2 | 5-15 | Used | Inv. |
| 4-(8) | 1-21/2-15 | 5-15 | Used | Inv. |
| 4-(9) | 1-5/2-2 | 5-15 | None | Inv. |
| 4-(10) | 1-5/2-2 | Sen. dye (3) | Used | Inv. |

1*: 1-phenyl-5-mercaptotetrazole

TABLE 11

| Sample No. | Sensitivity | Fog | Resistivity against safelight | Color remaining | Note |
|---|---|---|---|---|---|
| 4-(1) | 100 | 0.33 | 1.19 | 100 | Comp. |
| 4-(2) | 113 | 0.12 | 0.52 | 100 | Inv. |
| 4-(3) | 115 | 0.17 | 0.78 | 100 | Comp. |
| 4-(4) | 132 | 0.08 | 0.10 | 100 | Inv. |
| 4-(5) | 125 | 0.09 | 0.11 | 100 | Inv. |
| 4-(6) | 148 | 0.07 | 0.08 | 100 | Inv. |
| 4-(7) | 140 | 0.07 | 0.09 | 100 | Inv. |
| 4-(8) | 153 | 0.06 | 0.09 | 100 | Inv. |
| 4-(9) | 67Ø | 0.08 | 0.11 | 100 | Inv. |
| 4-(10) | 97 | 0.07 | 0.08 | 161 | Inv. |

Tables 10 and 11 show that the samples according to the invention each have an excellent safelight resistivity, a lowered fog and an high sensitivity.

Example 5

Silver chloride rich tabular emulsions, Emulsion 9 was prepared in the same manner as in Emulsions 3 in Example 2. Then Emulsion 10 was prepared in the same manner as in Emulsion 4 using Emulsion 9 except that a compound represented by Formula 1 and a compound represented by Formula 2, 3 or 4 were added as shown in Table 12 to the emulsion before ripening the emulsion. Thus ten kinds of emulsions were prepared. Then the following silver iodide fine grains, a solid dispersion of sensitizing dye, sulfur sensitizer, selenium sensitizer, tellurium sensitizer and gold sensitizer were added to each of the emulsions. The emulsions were each ripened for 90 minutes at 55° C. and the following amount of TAI was added at the completion time of the ripening as a stabilizer.

Compounds added to the ripening process of the emulsion and the amounts of them per mole of silver.

| | |
|---|---|
| Silver iodide fine grains | 5 mmoles |
| Sensitizing dye (shown in Table 12) | $5.5 \times 10^{-4}$ moles |
| Sensitizing dye 2 | 30 mg |
| Sulfur sensitizer S | 2.0 mg |
| Gold sensitizer R | 1.0 mg |
| Selenium sensitizer (triphenyl-phosphine selenide) | 0.5 mg |
| Tellurium sensitizer (butyl-diiso-propylphosphine telluride) | 0.5 mg |
| Stabilizer (TAI) | 50 mg |

The silver iodide fine grains and the solid dispersion of the sensitizing dye were prepared in the same manner as in Example 3. To the ripened emulsion, additives the same as in Example 3 were added to each of the emulsions to prepare emulsion coating liquids. On the other hand a coating liquid of protective layer the same as in Example 3 was prepared.

Each of the emulsion coating liquids and the protective layer coating liquid were simultaneously coated and dried on both sides of a blue tinted polyethylene terephthalate support for X-ray film with a density of 0.15 and a thickness of 175 μm. On both sided of the support, cross over light shielding layer the same as those in Example 3 were previously provided. Thus Samples 5-(1) to 5-(10) shown in Table 12 were prepared were prepared.

TABLE 12

| Sample No. | Compound No. | Sensitizing dye | Note |
|---|---|---|---|
| 5-(1) | 1* | 5-26 | Comp. |
| 5-(2) | 1-4/4-2 | 5-26 | Inv. |
| 5-(3) | 1-5/4-2 | 5-26 | Inv. |
| 5-(4) | 1-15/4-2 | 5-26 | Inv. |
| 5-(5) | 1-26/2-2 | 5-26 | Inv. |
| 5-(6) | 1-22/4-15 | 5-26 | Inv. |
| 5-(7) | 1-5/2-1 | 5-26 | Inv. |
| 5-(8) | 1-5/3-7 | 5-26 | Inv. |
| 5-(9) | 1-5/4-2 | 5-61 | Inv. |
| 5-(10) | 1-5/4-2 | 5-62 | Inv. |

The samples exposed to X-ray in the same manner as in Example 3 and were processed by the following Processing compositions 1 or Processing composition 2. The processed samples were evaluated in the same manner as in Example 3.

Preparation of Processing Compositions 1

The same processing composition as those in Example 3 were prepared.

Preparation of Processing Compositions 2

Developer replenisher tablets and fixer replenisher tablets were prepared by the following Procedures E to H Procedure E In a bantam mill, 3000 g of hydroquinone as the developing agent was powdered so that the average sized thereof become by 10 μm. To the powder thus obtained, 3000 g of sodium sulfite, 2000 g of potassium sulfite and 1000 g of Dimeson S were added and mixed in the mill for 30 minutes. Then the mixture was granulated in a stirring granulation machine with 30 ml of water for 10 minutes. The granules were almost completely dried by drying for 2 hours at 40° C. by a flowing layer drying machine. To thus obtained granules, 100 g of polyethylene glycol 6000 was added and the was uniformly mixed for 10 minutes by a mixing machine in a room conditioned at 25° C. and 40% RH or less. Then the mixture was tableted by a tableting machine Tough Press Correct 1527HU, manufactured by Kikusui Seisakusyo Co., Ltd., in a rate of 3.84 g per tablet. Thus 2500 tablets of Developer Replenisher Tablet E were prepared.

Procedure F

In a manner similar to that in Procedure E, 100 g of pentasodium diethylenetriaminepentaacetate, 4000 g of potassium carbonate, 10 g of 5-methylbenzotriazole, 7 g of 1-phenyl-5-mercaptotetrazole, 5 g of mercaptohypoxanthine 200 g of potassium hydroxide, and 13.3 g of N-acetyl-D,L, -penicilamine were powdered and granulated. The amount of water for granulation was 30.0 ml and the granules were dried for 30 minutes at 50° C. to remove moisture almost completely. The mixture was tableted by the above-mentioned tableting machine in a rate of 1.73 g per tablet. Thus 2500 tablets of Developer Replenisher Tablet F were prepared.

An initial developing solution having the following composition and a pH value of 10.7 was prepared by dissolving 783 tablets of the above Developer Replenishing tablet E and 1031 tables of Developer Replenishing tablet F in water and finished to 16.5 1. To the above solution, 330 ml of the following starter added to the developing solution so that the pH value of the solution was adjusted to 10.45.

| Composition of developer | |
|---|---|
| Potassium carbonate | 100.0 g/l |
| Hydroquinone | 57.0 g/l |
| Dimeson S | 25.0 g/l |
| DTPA | 2.05 g/l |
| 5-methylbenzotriazole | 0.25 g/l |
| 1-phenyl-5-mercaptotetrazole | 0.18 g/l |
| 2-mercaptohypoxanthine | 0.13 g/l |
| Sodium sulfite | 75.0 g/l |
| Potassium sulfite | 62.5 g/l |
| Potassium hydroxide | 5.0 g/l |
| Diethylene glycol | 125.0 g/l |
| N-acetyl-D,L-penicilamine | 0.25 g/l |
| **Starter for developing solution** | |
| Glacial acetic acid | 2.98 g |
| Potassium bromide | 4.0 g |
| water to make | 1 liter |

The fixer replenisher tables were prepared by the following Procedures G and H.

Procedure G

In a manner similar to that in Procedure E, 14000 g of ammonium thiosulfate/sodium thiosulfate, mixing ratio of 70/30 in weight, and 1500 g of sodium sulfite were powdered and granulated in a manner similar to Procedure E. The amount of water for granulation was 500 ml. The granules thus obtained were dried for 30 seconds at 60 ° C. to remove moisture almost completely.

The granules thus obtained were tableted by the above-mentioned tableting machine in a rate of 6.202 g per tablet. Thus 2500 tablets of Fixer Replenisher Tablet G were prepared.

Procedure H

In a manner similar to that in Procedure E, 1000 g of boric acid, 1500 g of aluminum sulfate 18 hydrate, 3000 g of sodium hydrogen acetate obtained by drying an equimole mixture of glacial acetic acid and sodium acetate and 200 g of tartaric acid were powdered and granulated with 100 ml of water. The granules thus obtained were dried for 30 minutes at 50° C. to remove moisture almost completely.

The granules were tableted by the above-mentioned tableting machine in a rate of 4.562 g per tablet. Thus 1250 tablets of Fixer Replenisher Tablet H were prepared.

An initial fixing solution having the following composition was prepared by dissolving 925 tables of Fixing Replenisher Tablet G and 412 tables of Fixing Replenisher Tablet H.

| Composition of initial fixing solution having a pH f 4.50 | |
|---|---|
| Ammonium thiosulfate | 84.0 g/l |
| Sodium sulfite | 30.0 g/l |
| Boric acid | 20.0 g/l |
| Sodium hydrogen acetate | 60.0 g/l |
| Glacial acetic acid | 34.6 g/l |
| Aluminum sulfate 18 hydrate | 16.8 g/l |
| Sodium acetate | 25.4 g/l |
| Tartaric acid | 4.0 g/l |

Results of the evaluation are listed in Table 13.

TABLE 13

| Sample | Processing 1 | | Processing 2 | | |
|---|---|---|---|---|---|
| No. | Sensitivity | Fog | Sensitivity | Fog | Note |
| 5-(1) | 100 | 0.30 | 135 | 0.45 | Comp. |
| 5-(2) | 152 | 0.05 | 155 | 0.07 | Inv. |
| 5-(3) | 159 | 0.08 | 161 | 0.10 | Inv. |
| 5-(4) | 156 | 0.08 | 159 | 0.11 | Inv. |
| 5-(5) | 160 | 0.09 | 161 | 0.10 | Inv. |
| 5-(6) | 162 | 0.06 | 165 | 0.12 | Inv. |
| 5-(7) | 145 | 0.06 | 148 | 0.07 | Inv. |
| 5-(8) | 150 | 0.07 | 152 | 0.08 | Inv. |
| 5-(9) | 155 | 0.07 | 159 | 0.10 | Inv. |
| 5-(10) | 148 | 0.06 | 150 | 0.10 | Inv. |

Tables 12 and 13 show that the samples according to the invention a each has a high sensitivity and low fog even when the samples are processed by a developer containing no hydroquinone.

Results similar to the above were obtained when silver iodobromide emulsion was used.

What is claimed is:

1. A monochromatic silver halide photographic light-sensitive material comprising a support, and a silver halide emulsion layer and a non-light-sensitive hydrophilic colloid layer provided on the support, wherein a compound represented by Formula 1 is contained in either said emulsion layer, said colloid layer or both said emulsion layer and said colloid layer, and said silver halide emulsion is sensitized by a sulfur sensitizer, a gold sensitizer, and a selenium compound or a tellurium compound and said emulsion contains tabular silver halide grains having an average aspect ratio of not less than 2.0, said grains accounting for at least 50% of a total grain projected area of said emulsion, and said tabular grains have an average silver iodide content of not more than 1 mole %, and said emulsion layer contains a spectral sensitizing dye represented by Formula 5;

$$R_{11}—(S)_n—R_{12}$$

wherein $R_{11}$ and $R_{12}$ each represent an aliphatic, an aromatic group or a heterocyclic group, the groups represented by $R_{11}$ and $R_{12}$ may be the same or different and they may be bonded with together to form a ring; and n is an integer of from 2 to 6

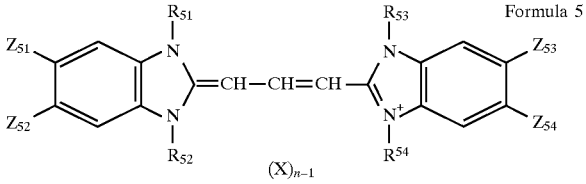

wherein $R_{51}$ and $R_{53}$ are each an alkyl group, which may have a substituent; $R_{52}$ and $R_{54}$ are each a lower alkyl group having 1 to 4 carbon atoms and at least one of $R_{52}$ and $R_{54}$ is a lower alkyl group having 1 to 4 carbon atoms which has a hydrophilic substituent; X is an ion necessary for neutralizing the intramolecular electric charge, n is 1 or 2, provided that n is 1 when an intramolecular salt is formed; $Z_{51}$, $Z_{52}$, $Z_{53}$ and $Z_{54}$ are each a halogen atom, an alkyl group, an alkoxyl group, an alkylthio group, a trifluoromethyl group, a cyano group, a carboxyl group, an alkoxycarbonyl group, an acyl group, a sulfonyl group, a carbamoyl group, a sulfamoyl group, an acetylamino group, an acetyloxy group or an aryl group.

2. The light-sensitive material of claim 1, wherein n in Formuls 1 is 2.

3. The light-sensitive material of claim 1, wherein said compound represented in Formula 1 is contained in at least one of said silver halide emulsion layer and said non-light-sensitive hydrophilic colloid layer in an amount of $1 \therefore 10^{-8}$ moles to $5\times10^{-1}$ moles per mole of silver halide contained in said emulsion layer.

4. The light-sensitive material of claim 1, wherein said tabular silver halide grain has two parallel (100) major faces and has a silver chloride content of not less than 20 mole-%.

5. The light-sensitive material of claim 1, wherein at least one of said silver halide emulsion layer or said non-light-sensitive hydrophilic colloid layer contains a compound capable of releasing a development inhibitor by oxidation reaction with a oxidation product of a developing agent.

6. The light-sensitive material of claim 1, wherein at least one of said silver halide emulsion layer and said non-light-sensitive hydrophilic colloid layer further contains a compound represented by the following Formula 2;

Formula 2

$$R_{21}—I^+R_{22}\ I^-$$

wherein $R_{21}$ and $R_{22}$ are each independently an aromatic group or an aromatic heterocyclic group, and $R_{11}$ and $R_{22}$ may be the same or different.

7. The light-sensitive material of claim 1, wherein at least one of said silver halide emulsion layer and said non-light-sensitive hydrophilic colloid layer further contains a compound represented by the following Formula 3;

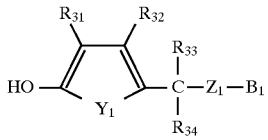

In Formula 3, R31, R32, R33 and $R_{34}$ are each independently a hydrogen atom, a halogen atom, an alkyl group, an aralkyl group, a cycloalkyl group, an aryl group, an alkoxyl group, an aryloxy group, a cyano group,, an acylamino group, an alkylthio group, an arylthio group, a sulfonylamino group, a ureido group, a sulfamoylamino group, a carbamoyl group, a sulfamoyl group, an alkoxycarbonyl group, aryloxycarbonyl group, an acyl group, a hydroxyl group, a nitro group, an imido group or a heterocyclic group; $Y_1$ is a group of atoms for forming an aromatic carbon ring or an aromatic heterocyclic ring; $Z_1$ is an oxygen atom or a sulfur atom; and $B_1$ is a group having an ability of adsorption to silver halide solely or in a form of $—Z_1—B_1$.

8. The light-sensitive material of claim 1, wherein at least one of said silver halide emulsion layer and said non-light-sensitive hydrophilic colloid layer contains a tetrazolium compound.

9. The light-sensitive material of claim 8, wherein said tetrazolium compound is a compound represented by the following Formula 4;

Formula 4

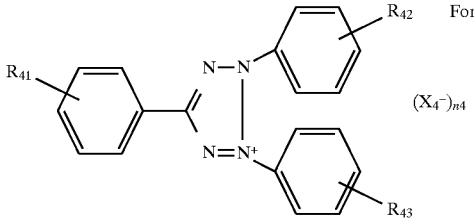

In the above formula, $R_{41}$, $R_{42}$ and $R_{43}$ are each independently a hydrogen atom, an aliphatic group, an aromatic group or a heterocyclic group; $X_4$ is an ion for neutralizing the electric charge; and $n_4$ is a number of ions necessary for neutralizing the charge.

* * * * *